US010047547B2

(12) United States Patent
Waugh et al.

(10) Patent No.: US 10,047,547 B2
(45) Date of Patent: Aug. 14, 2018

(54) LOCKING LINK

(71) Applicant: PACIFIC LOCK COMPANY, Valencia, CA (US)

(72) Inventors: Gregory Waugh, Stevenson Ranch, CA (US); Matthew Watson Yuen, Los Angeles, CA (US)

( * ) Notice: Subject to any disclaimer, the term of this patent is extended or adjusted under 35 U.S.C. 154(b) by 346 days.

(21) Appl. No.: 14/718,023

(22) Filed: May 20, 2015

(65) Prior Publication Data

US 2016/0340934 A1 Nov. 24, 2016

(51) Int. Cl.
*E05B 67/00* (2006.01)

(52) U.S. Cl.
CPC ..... *E05B 67/003* (2013.01)

(58) Field of Classification Search
CPC ..... E05B 67/003
USPC ..... 70/2–9, 14, 18
See application file for complete search history.

(56) References Cited

U.S. PATENT DOCUMENTS

| | | | | |
|---|---|---|---|---|
| 695,347 | A | 3/1902 | Soley | |
| 1,490,987 | A | 4/1924 | Soref | |
| 1,564,463 | A | 12/1925 | Best | 70/380 |
| 1,788,396 | A * | 1/1931 | Johnson | E05B 67/003 70/15 |
| 1,921,434 | A * | 8/1933 | Stone | B62D 43/007 70/14 |
| 2,460,615 | A | 2/1949 | Andrew | 70/369 |
| 3,143,872 | A | 8/1964 | Check | 70/38 A |
| 3,172,279 | A | 3/1965 | Patriquin | 70/38 A |
| 3,404,549 | A | 10/1968 | Best | |
| 3,690,130 | A * | 9/1972 | Eutzler | E05B 69/006 211/4 |
| 3,817,062 | A | 6/1974 | Randel | E05B 67/38 70/11 |
| 3,820,360 | A | 6/1974 | Best | |
| 3,882,699 | A | 5/1975 | Flack et al. | 70/38 A |
| 3,901,058 | A | 8/1975 | Best | E05B 57/36 70/32 |
| 3,996,774 | A | 12/1976 | Best | |
| 4,068,510 | A | 1/1978 | Neary | 70/379 R |
| 4,075,878 | A | 2/1978 | Best | 70/49 |
| 4,102,161 | A | 7/1978 | Proefrock | E05B 67/14 70/350 |
| 4,109,496 | A | 8/1978 | Allemann et al. | 70/380 |
| 4,112,716 | A * | 9/1978 | Wippich | E05B 67/003 70/38 C |
| 4,228,669 | A | 10/1980 | Bischoff | 70/379 R |
| 4,254,648 | A | 3/1981 | Dietrich | 70/380 |
| 4,328,690 | A | 5/1982 | Oliver | 70/369 |

(Continued)

FOREIGN PATENT DOCUMENTS

WO WO 2012054839 A1 4/2012 ..... E05B 67/383

OTHER PUBLICATIONS

Johnson, Gale, Xperinetix Has a Better Idea, The Locksmith Ledger, Dec. 2000, 5 pages, San Diego, CA.

(Continued)

*Primary Examiner* — Suzanne Lale Dino Barrett
(74) *Attorney, Agent, or Firm* — Patent Law Agency, LLC; Peter Ganjian

(57) ABSTRACT

The present invention discloses a locking link, composed of a cover moveably engaged with a link. The cover at a first engaged position is locked with the link, and at a second engaged position is unlocked from the link.

32 Claims, 78 Drawing Sheets

(56) References Cited

U.S. PATENT DOCUMENTS 4,347,720 A * 9/1982 Kenyon ..... E05B 67/003 70/14
4,672,828 A 6/1987 Theriault
4,793,166 A 12/1988 Marks
4,926,670 A 5/1990 Deforrest, Sr. ..... 70/374
5,121,618 A 6/1992 Scott ..... 70/367
5,127,244 A 7/1992 Myers
5,174,136 A 12/1992 Thwing ..... 70/38 A
5,193,372 A 3/1993 Sieg et al. ..... 70/369
D336,030 S 6/1993 Falk et al.
5,233,851 A 8/1993 Florian
5,345,794 A 9/1994 Jenks
5,361,611 A 11/1994 Hisler ..... A01K 97/00 211/4
5,765,408 A 6/1998 Sanseverino ..... B60R 25/02147 70/14
5,878,504 A 3/1999 Stone ..... E05B 13/002 292/148
5,878,604 A 3/1999 Stone et al.
6,005,306 A 12/1999 Pickard
6,009,731 A 1/2000 Emmons et al.
6,109,080 A 8/2000 Chen et al.
6,146,356 A 11/2000 Wang et al. ..... 604/96.01
6,233,984 B1 5/2001 Blehi, III ..... E05B 13/002 70/2
6,338,261 B1 1/2002 Liu ..... E05B 67/38 70/14
6,374,653 B1 4/2002 Gokcebay et al.
6,425,274 B1 7/2002 Laitala et al. ..... 70/394
6,467,317 B1 * 10/2002 Hillabush ..... B60D 1/60 280/507
6,581,419 B1 6/2003 Strodtman
6,606,890 B1 8/2003 Widen
6,609,739 B1 * 8/2003 Avganim ..... E05B 67/36 292/288
6,634,196 B2 10/2003 Huang
6,758,075 B1 7/2004 Thwing ..... 70/389
6,766,671 B2 7/2004 Haczynski et al. ..... 70/23
6,854,303 B2 * 2/2005 Shiao ..... E05B 67/38 70/2
6,883,356 B1 4/2005 Wu ..... 70/379 R
6,915,670 B2 * 7/2005 Gogel ..... E05B 13/001 292/148
6,948,345 B1 9/2005 Ruan ..... 70/370
RE38,832 E 10/2005 Thwing
7,003,994 B2 2/2006 Ruan ..... 70/416
7,047,774 B1 5/2006 Gogel ..... 70/32
7,278,284 B1 10/2007 James ..... E05B 13/002 292/205
7,412,855 B2 * 8/2008 Dolev ..... E05B 9/08 70/11
7,543,466 B2 7/2009 Loughlin et al.
7,770,422 B1 * 8/2010 Sierra ..... E05B 67/36 70/2
7,836,736 B2 11/2010 Humphris
7,946,142 B2 * 5/2011 Matyko ..... E05B 67/36 292/302
8,004,393 B2 8/2011 Haber
8,281,624 B2 * 10/2012 Rizzi ..... E05B 73/0017 211/7
8,776,557 B2 7/2014 Wang
8,935,944 B2 1/2015 Boesel ..... E05B 55/48 292/285
8,938,998 B2 1/2015 Haber
8,978,426 B2 3/2015 Wang
9,212,508 B2 * 12/2015 Loughlin ..... E05B 67/003
2004/0083777 A1 5/2004 Vito ..... E05B 67/36 70/32
2004/0093914 A1 5/2004 Vito
2004/0144141 A1 7/2004 Ng
2004/0221626 A1 11/2004 Palzkill ..... E05B 13/002 70/34
2004/0244442 A1 12/2004 Shiao ..... E05B 67/38 70/56
2005/0199027 A1 9/2005 Mannella
2005/0252257 A1 * 11/2005 Woods ..... E05B 67/04 70/33
2005/0262257 A1 11/2005 Woods ..... E05B 67/04 70/33
2006/0144100 A1 * 7/2006 Thomsen ..... E05B 83/12 70/2
2006/0236730 A1 * 10/2006 Wyers ..... B60D 1/065 70/14
2008/0105004 A1 5/2008 Wang ..... E05B 57/35 70/2
2008/0105005 A1 5/2008 Wang ..... E05B 57/35 70/32
2011/0316291 A1 12/2011 Loughlin ..... E05B 13/001 292/101
2012/0011682 A1 1/2012 Boonstra ..... E05B 57/383 16/384
2012/0210754 A1 8/2012 Thomsen ..... E05B 13/002 70/14
2013/0276488 A1 10/2013 Haber
2014/0223974 A1 * 8/2014 Dolev ..... E05B 67/36 70/14
2015/0075231 A1 * 3/2015 Waugh ..... E05B 67/36 70/2

OTHER PUBLICATIONS

Letter from Mr. John Ulaszek to Mr. Gregory Waugh, President of Pacific Lock Company, the Assignee of the current application, 3 pages, Jan. 22, 2007.
Letter from Mr. John Ulaszek to Mr. Gregory Waugh, President of Pacific Lock Company, the Assignee of the current application, 3 pages, Feb. 9, 2007.
Provisional application cover sheet for U.S. Appl. No. 60/220,416, filed Jul. 24, 2000 and an attached page with a figure.
Security Padlock Uses IC Core Cylinders, Gale Johnson, Locksmith Ledger, vol. 60, No. 13 (4 pages).
Pacific Lock, Gregory B. Waugh, The National Locksmith, Jan. 2006, 6 pages.
Pacific Lock Introduces the World's First Hockey-Pucks for SFIC's and KiK Cylinders, The National Locksmith, Jan. 2007, 6 pages.
Lynk, William M., "Interchangeable Cores Small Format," The National Locksmith, 2000, 44 pages.
Brouchure—4000D-X Dry Van Series; Utitlity Manurfacturing Company; 2005.
Brouchure—The Enforcer High Security Locking Systems; Cargoard 8075 ; Transport Security, Inc. www.transportsecurity.comk.
Polar Steel Cam Type Clok on; Polar Hardware Manuractuirng Co., Inc. ; www.polarmfg.com.
Photo of Pad Lock-1.
Photo of Pad Lock-2.
THPXL Internal Shackle Door Lock; www.trimaxlocks.com.
U.S. Appl. No. 11/907,149, filed Oct. 10, 2007 ; File History.
Digital Seal From Babaco; www.babaco.com ; 2011.
Truk Lok III ; www.babaco.com ; 2011.
Truk Lok II ; www.babaco.com ; Jul. 29, 2013.
Lock-Style Pull Solenoid—12VDC ; https://www.adafruit.com/product/1512 ; https://www.youtube.com/watch?v=92kwSeiwI3U; 2013.
Lockitron Motoorized Door Lock Body; https://www.adafruit.com/product/2579 ; 2011.
WO 2012/054839; Apr. 26, 2012.

* cited by examiner

LOCKING LINK

BACKGROUND OF THE INVENTION

Field of the Invention

One more or more embodiments of the present invention relate to a link device and, more particularly, to a locking link device.

Description of Related Art

Conventional security link devices are well known and have been in use for a number of years. Regrettably, most known security link devices are actually only link devices with no security. That is, the link device itself requires the use of an additional padlock (e.g., a cylindrical hidden shackle padlock, etc.) to actually become a "security" link device, with the padlock securing or locking a connection of a securing element such as a chain with the link device. Otherwise, without the padlock the link device is simply a very heavy, useless, unsecure linking mechanism.

The must-have requirement of an additional padlock to secure a connection of a link member such as chain with the link device is very cumbersome, compounds the problem in terms of weight (of link device plus the weight of the padlock), and complicated in terms of handling a very heavy combination link/padlock to lock and unlock a securing member such as a chain. For example, the padlock must always be manually mounted and locked onto link device to lock securing member and then manually unlocked and dismounted from link device to allow securing member to be released from the link device. More specifically, users must hold the entire locked unit in one hand and use their other hand for a key to unlock the padlock. Thereafter, the users must then physically remove and detach the padlock from the link device. This is generally done with both hands where one hand holds the padlock and the other is held onto the link device. This is especially true if the padlock is a cylindrical hidden shackle padlock where both the padlock and the link device are bulky and heavy. Afterwards, while holding onto the heavy padlock (now detached), users must then unlink the securing member (such as a heavy chain) from the link device with their other free hand. Still while holding onto the heavy padlock users must then open a gate or other closure that was secured by the link and padlock devices.

Unfortunately, the locking process is as cumbersome as the described unlocking process where a user must first link both ends of the securing member with the link device, then with both hands properly align and orient the padlock with the link device (due to heavy weights of both), thereafter, hold both with one hand and use a key with a free hand to lock securing member with link device. Accordingly, each device (link device or padlock) on its own is difficult and cumbersome to use, with difficulty and cumbersomeness compounded when used together to lock a securing member.

Accordingly, in light of the current state of the art and the drawbacks to current link devices mentioned above, a need exists for a true security link that would actually lock a securing member without the use of a separate lock device and further, not be cumbersome to operate.

BRIEF SUMMARY OF THE INVENTION

A non-limiting, exemplary aspect of an embodiment of the present invention provides a locking link, comprising:

a cover moveably engaged with a link;

the cover at a first engaged position is locked with the link, and at a second engaged position is unlocked from the link.

These and other features and aspects of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

FIGS. 1A to 1B-6 are non-limiting, exemplary illustrations of a locking link in accordance with one or more embodiments of the present invention; FIGS. 1B-1 to 1B-6 are non-limiting, exemplary illustrations of the locking link illustrated in FIG. 1A, which progressively illustrate a non-limiting, exemplary method of unlocking (FIGS. 1B-1 to 1B-5) and re-locking (FIG. 1B-6) of the locking link in accordance with one or more embodiments of the present invention;

FIGS. 2A-1 to 2A-4 are non-limiting, exemplary illustrations of various perspective views of a cover of the locking link illustrated in FIGS. 1A to 1C in accordance with one or more embodiments of the present invention;

FIGS. 2B-1 to 2B-8 are non-limiting, exemplary illustrations of various perspective views of a link of the locking link illustrated in FIGS. 1A to 1C in accordance with one or more embodiments of the present invention;

FIGS. 2C-1 to 2C-4 are non-limiting, exemplary illustrations of various views of details of link of posts illustrated in FIGS. 1A to 2B-8 in accordance with one or more embodiments of the present invention;

FIGS. 8A-1 to 8J-7 are non-limiting, exemplary illustrations of various views and sectional views of a locking link that uses a securing member that is rigid in accordance with another embodiment of the present invention;

FIGS. 9A to 9G-3 are non-limiting, exemplary illustrations of various views and sectional views of a locking link that uses a single support and a lock that has a shackle in accordance with another embodiment of the present invention.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

It is to be appreciated that certain features of the invention, which are, for clarity, described in the context of separate embodiments, may also be provided in combination in a single embodiment. Conversely, various features of the invention that are, for brevity, described in the context of a single embodiment may also be provided separately or in any suitable sub-combination or as suitable in any other described embodiment of the invention.

Further, although the invention is described below in terms of various exemplary embodiments and implementations, it should be understood that the various features and aspects described in one or more of the individual embodiments are not limited in their applicability to the particular embodiment with which they are described, but instead can be applied, alone or in various combinations, to one or more of the other embodiments of the invention.

In the description given below and or the corresponding set of drawing figures, when it is necessary to distinguish the various members, elements, sections/portions, components, parts, or any other aspects (functional or otherwise) or features or concepts or operations of a device(s) or method(s) from each other, the description and or the corresponding drawing figures may follow reference numbers with a small alphabet character such as (for example) "support 204*a*, 204*b*, and etc." If the description is common to all of the various members, elements, sections/portions, components, parts, or any other aspects (functional or otherwise) or features or concepts or operations of a device(s) or method(s) such as (for example) to all supports 204*a*, 204*b*, etc., then they may simply be referred to with reference number only and with no alphabet character such as (for example) "support 204."

Figure 1A:
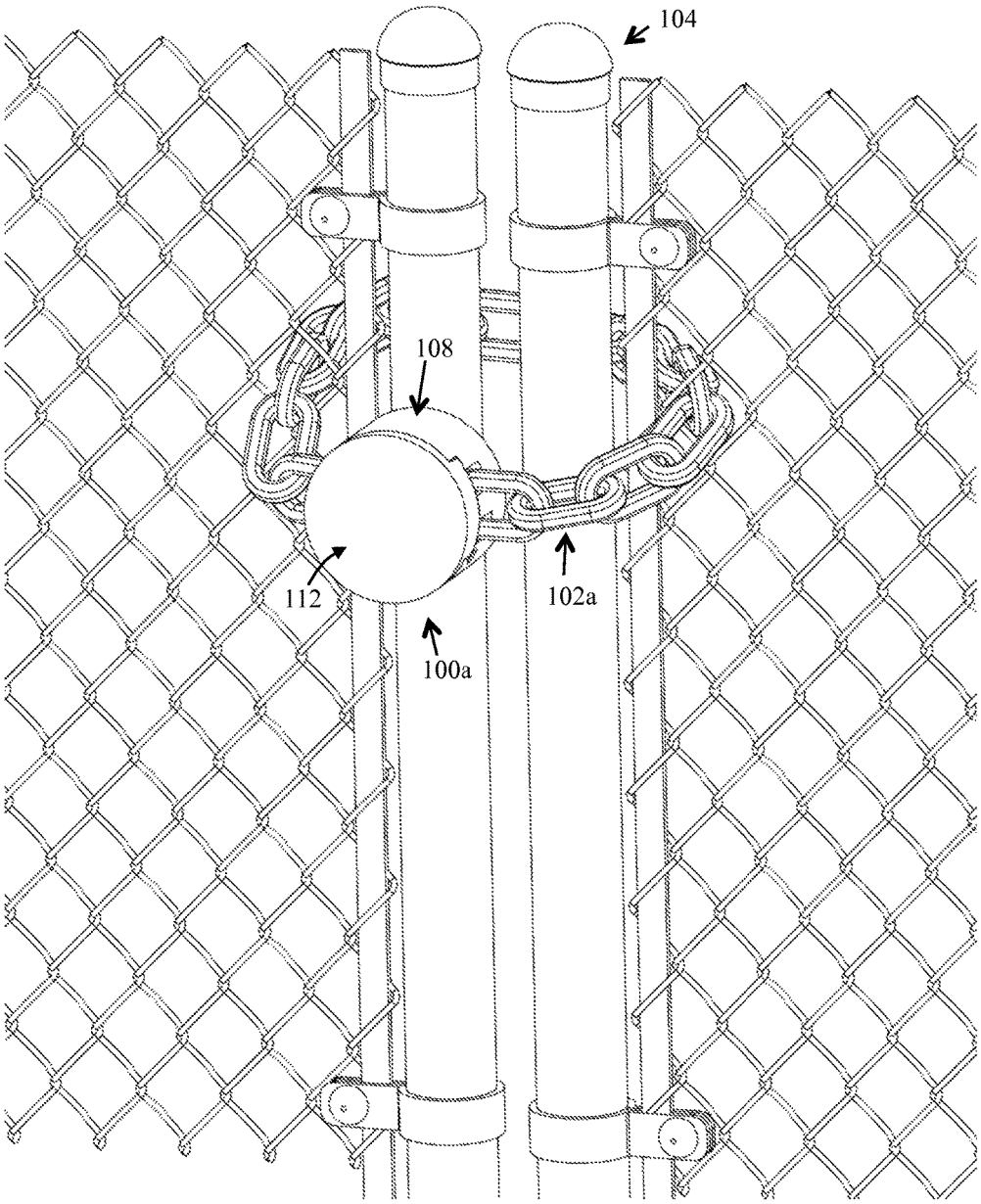
Figures 1, 1B:
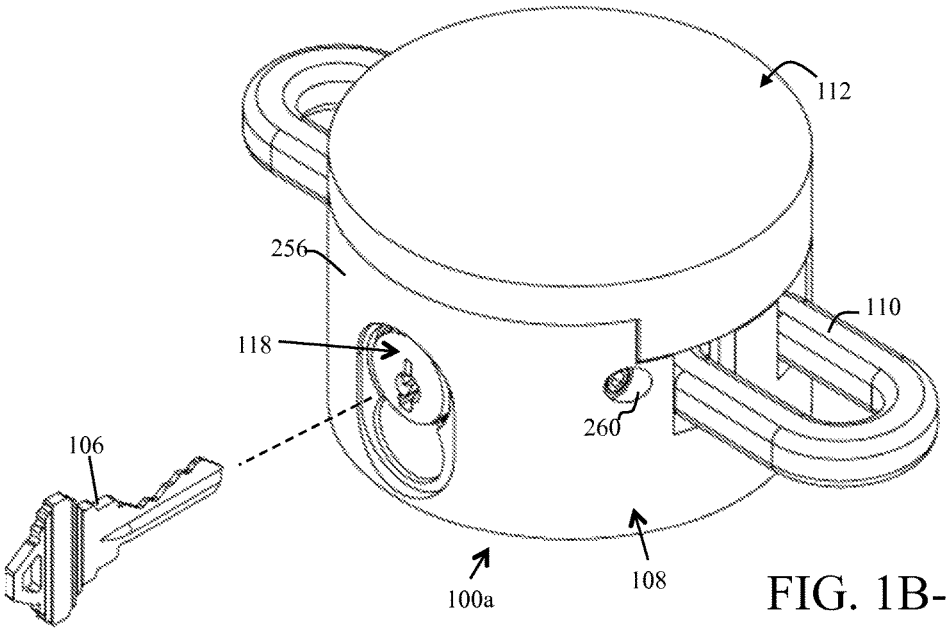
Figures 1, 1B, 2:
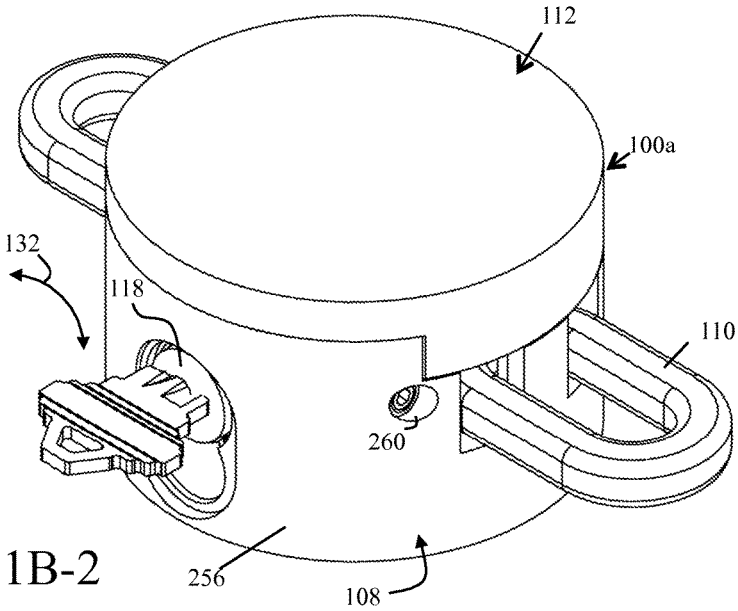
Figures 1, 1B, 2, 3:
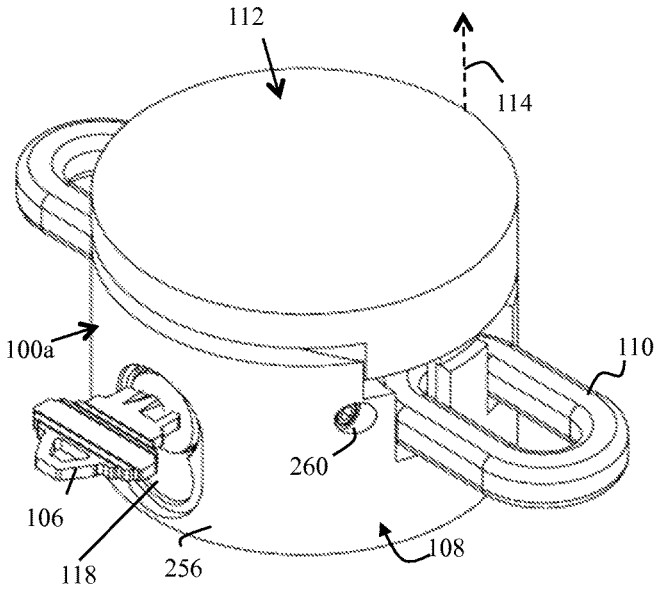
Figures 1, 1B, 2, 3, 4:
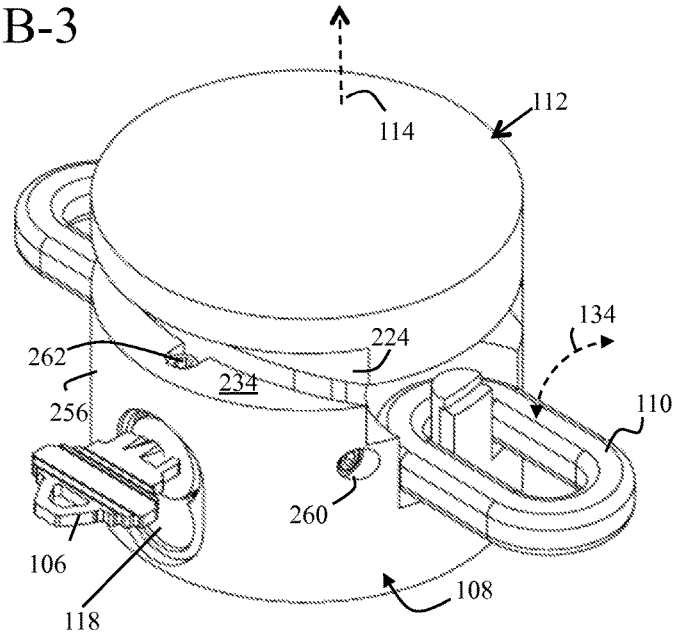
Figures 1, 1B, 2, 3, 4, 5:
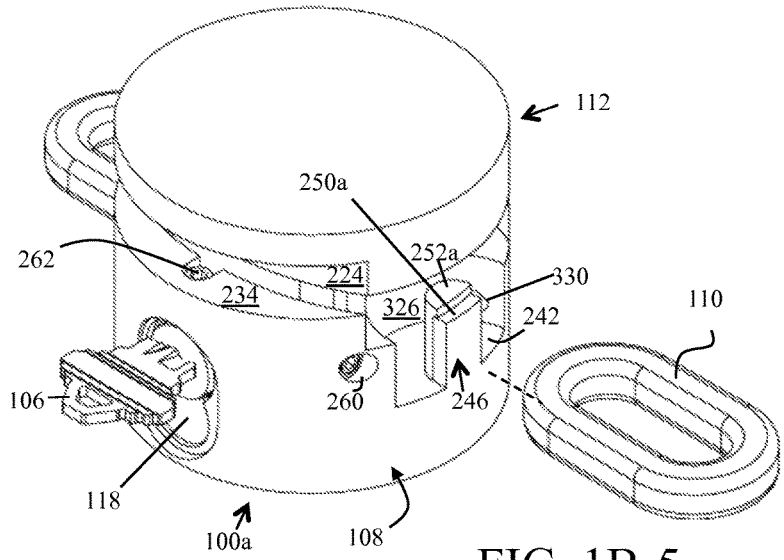
Figures 1, 1B, 2, 3, 4, 5, 6:
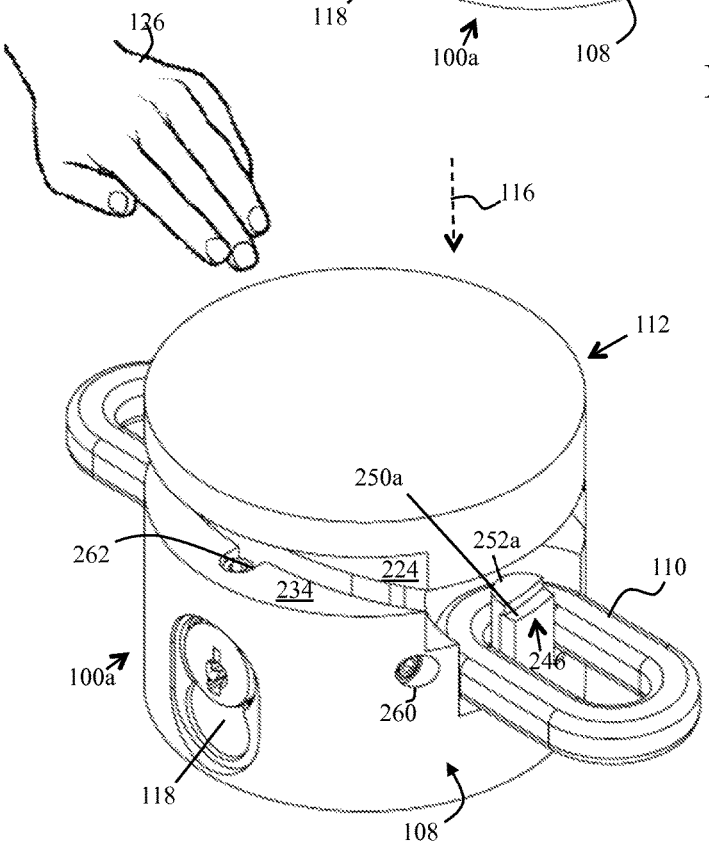

FIGS. 1A to 1B-6 are non-limiting, exemplary illustrations of a locking link in accordance with one or more embodiments of the present invention. FIGS. 1B-1 to 1B-6 are non-limiting, exemplary illustrations of the locking link illustrated in FIG. 1A, which progressively illustrate a non-limiting, exemplary method of unlocking (FIGS. 1B-1 to 1B-5) and re-locking (FIG. 1B-6) of the locking link in accordance with one or more embodiments of the present invention.

As illustrated in FIGS. 1A to 1B-6, locking link 100*a* of the present invention may be used to lock a securing member 102*a* onto a gate 104. It should be noted that securing member 102*a* may be a chain or other flexible objects, a non-limiting example of which may be a cable. Alternatively and as detailed below, securing member 102*b* (detailed below) may comprise of non-flexible objects, a non-limiting example of which may be a hasp, which may be hinged or non-hinged, etc.

As best illustrated in FIGS. 1A and 1B-1 to 1B-6, locking link 100*a* is actually a true security link device. That is, locking link 100*a* does not require the use of an additional conventional padlock or cylindrical hidden shackle padlock—also known as hockey puck padlock, etc. to lock and secure securing member 102*a*. Accordingly, use and operation of locking link 100*a* is not cumbersome, is very simple, and is extremely easy since an additional conventional locking device (which is very bulky and heavy) is no longer required to lock securing member 102*a* with a conventional link (which is also bulky and heavy).

As best illustrated in FIGS. 1B-1 to 1B-6, removing securing member 102*a* from locking link 100*a* is a very simple and easy operation that may be accomplished with one hand, which includes insertion of a key 106 into a key-cylinder 120 of a lock 118 of locking link 100*a* (FIG. 1B-1), turning key 106 along path 132 to an unlock position (FIG. 1B-2), and removing 134 a linking-end 110 of securing member 102*a* from locking link 100*a* (FIG. 1B-5). Upon turning key 106 to the unlock position a cover 112 of locking link 100*a* automatically (or mechanically) "pops" up (or opens) away from a link 108 as indicated by arrow 114 to enable users to remove and release linking-end 110 of securing member 102*a* (FIGS. 1B-4 and 1B-5).

As best illustrated in FIG. 1B-6, locking securing member 102*a* to locking link 100*a* is as simple and easy as unlocking, which only requires a simple and easy operation of users mounting linking-end 110 of securing member 102*a* onto link 108 of locking link 100*a*, and simply pressing down (as shown by arrow 116 in FIGS. 1B-6) with one hand 126 cover 112 to lock securing member 102*a* with locking link 100*a*. Accordingly, one or more embodiments of the present invention provide a true security link that actually locks a securing member without the use of a separate lock device (such as a padlock or hockey puck lock, etc.) and further, is very easy and simple to operate.

Figure 1C:
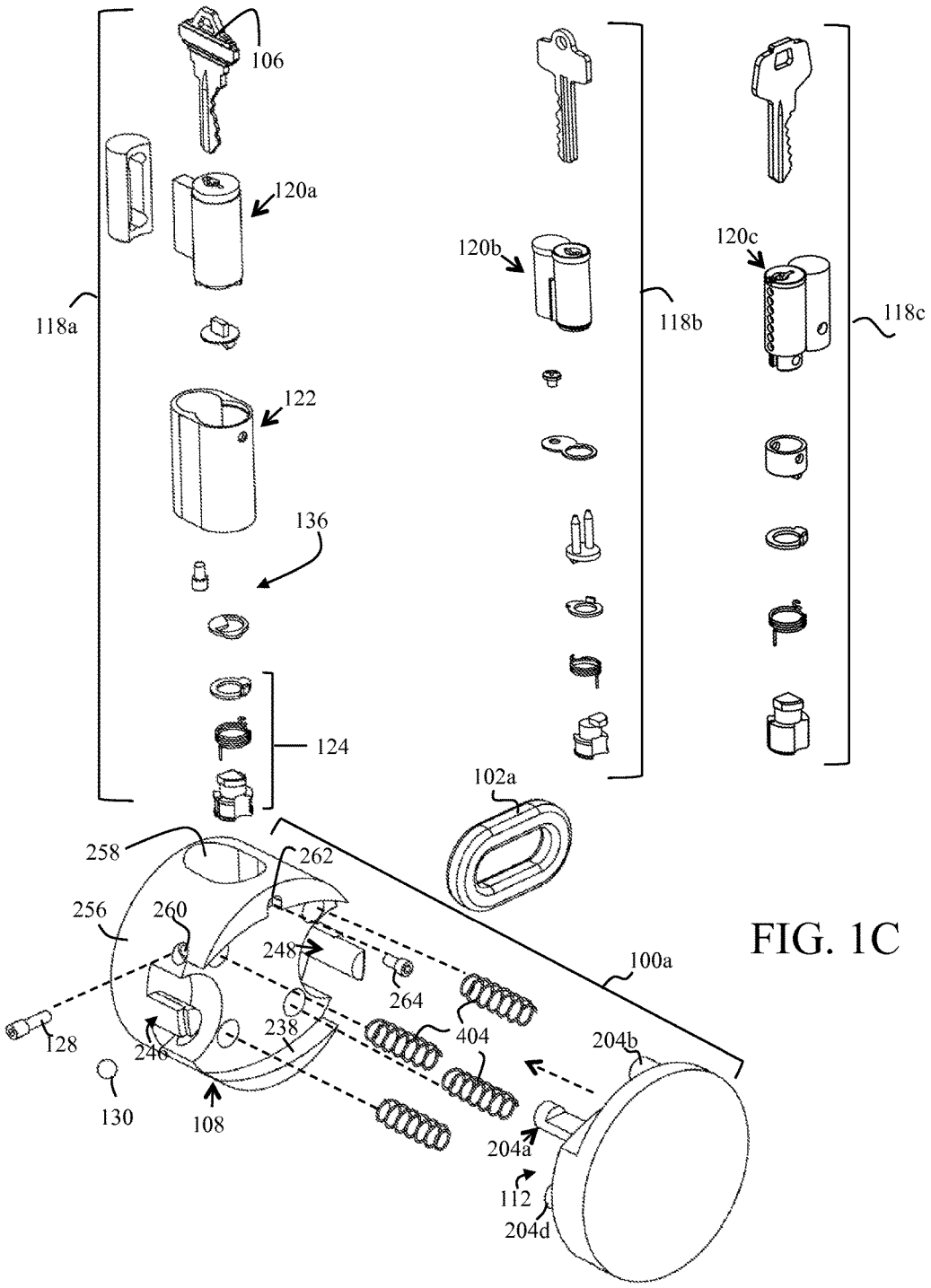
FIG. 1C is a non-limiting, exemplary exploded view of the locking link illustrated in FIGS. 1A to 1B-6 in accordance with one or more embodiments of the present invention, including a lock.

FIG. 1C is a non-limiting, exemplary exploded view of the locking link illustrated in FIGS. 1A to 1B-6 in accordance with one or more embodiments of the present invention, including a lock. As illustrated, one or more embodiments of locking link 100*a* accommodate lock 118, which may comprise of a well-known key-cylinder 120 that may be associated with link 108 of locking link 100. Non-limiting, non-exhaustive examples of a key-cylinder 120 may include, for example, a Key-In-Knob type (or KiK) key-cylinder 120*a* that may optionally use sleeve 122, a Small Format Interchangeable Core (SFIC) key-cylinder 120*b* that may or may not use an optional sleeve 122, a standard re-key-able key-cylinder 120*c*, etc. Other non-limiting examples of key-cylinder 120 may include, for example, Large Format Interchangeable Core (LFIC), Full size Schlage Interchangeable Core, and so on. Accordingly, most conventional locks 118 may be used with any one of the one or more embodiments of locking link 100*a*.

Optional uses of sleeves 122 with various types of key-cylinders 120 is disclosed in U.S. Pat. Nos. 8,776,557 and 8,978,426, the entire disclosures of which are incorporated by references herein. It should be noted that where a definition or use of a term in the incorporated patents is inconsistent or contrary to the definition of that term provided herein, the definition of that term provided herein applies and the definition of that term in the incorporated patents does not apply. Further and as detailed below, lock 118 may operate with known types of drive mechanisms and actuators, including shackles.

Accordingly, locking link 100*a* is comprised of cover 112 and a link 108, wherein cover 112 moves in relation to link 108 while continuously interlocked (or engaged) with link 108. This way, cover 112 does not dislodge from link 108, facilitating ease of locking and unlocking Cover 112 locks with link 108 at a first interlocked (or engagement) position (FIGS. 1A and 1B-1), and unlocks from link 108 at a second interlocked (or engagement) position (FIG. 1B-6). At second interlock position (FIG. 1B-6) cover 112 continues to remain interlocked (or engaged) with link 108. In general, cover 112 automatically (or mechanically) moves from the first interlock position to the second interlock position, and cover is manually moved from the second interlock position to the first interlock position to lock with link 108. Cover 112 secures and interlocks linking end 110 of a securing member 102*a* with link 108 when cover 112 is locked with link 108 at the first interlock position.

FIGS. 2A-1 to 2A-4 are non-limiting, exemplary illustrations of various perspective views of a cover of the locking link illustrated in FIGS. 1A to 1C in accordance with one or more embodiments of the present invention. As illustrated, cover 112 has a first (or bottom) side 202 that includes one or more support 204 that protrudes from the first cover side 202 at an angle (e.g., 90° degrees), one or more offset surface 216, and one or more reinforcement structure 206. A first support 204*a* is comprised of an engagement portion 210 that includes a notched cut-out along a first portion of the support 204*a* that moveably maintains engagement of cover 112 interlocked with link 108. First support 204*a* functions as "retainer" support or retainer "leg" to retain or maintain engagement of cover 112 with link 108. A second support 204*b* is comprised lock portion 208 comprised of a recess that locks cover 112 with link 108 using a locking member 130 (detailed below). Second support 204*b* functions a "shackle" or the locking "leg" to lock cover 112 with link 108. It should be noted that the selection of support 204 to include recess 208 for locking cover 112 with link 108 is dictated by a position of actuator 320 of key-cylinder 120 that is housed within link 108, which is to actuate a locking member 130 in relation to recess 208. As further illustrated, a bottom surface 270 of any one of the supports 204 is generally flat and includes chamfered periphery 214 for ease of assembly with link 108.

The benefit of having four supports 204 (engagement support 204*a*, lock support 204*b*, and the additional supports 204*c* and 204*d*) is that when cover 112 is in an unlock position, all supports 204 help to block securing member 102*a* from accidentally being inserted into an open area between bottom side 202 of cover 112 and top side 228 of link 108, which may encumber the user from relocking locking link 100*a*. Accordingly, the additional supports 204 physically block securing member 102*a* from being captured or trapped in between cover/link when cover 112 is in unlock position in relation to link 108.

Alternatively, cover 112 may comprise of support 204 that includes an engagement portion 210 that moveably maintains engagement of cover 112 interlocked with link 108 and a lock portion 208 that locks cover 112 with link 108. In other words, a single support 204 of the plurality of supports may comprise both an indentation 210 and a recess 208. As a further alternative, cover 112 may comprise of only two supports 204 instead of the illustrated four supports 204*a*, 204*b*, 204*c*, and 204*d*. If only two supports are used, the locking support 204*b* and the retaining support 204*a* may be positioned at diametrically opposite positions to provide balance. As yet another alternative, a hybrid version may include two supports 204 with the similar position, but only one support having both the lock and engagement portions 208 and 210. As further detailed below, still a further alternative embodiment provides a single support 204 that includes an engagement portion 210 that moveably maintains engagement of cover 112 interlocked with link 108 and a lock portion 208 that locks cover 112 with link 108. Accordingly, many number of different combinations and permutations of supports 204 and their respective arrangements are possible.

As indicated above, bottom side 202 of cover 112 is comprised of planer surfaces 218, 220, and 222 that are offset in relation to one another. The bottom side 202 includes offset, planer surfaces 220 and 222 that form raised edges 224 and 226 in relation to the highest elevation offset surfaces 218, with the offset surfaces 220 and 222 and the resulting raised edges 224 and 226 forming reliefs or recessed areas 216*a* and 216*b*. In general, preferably, first relief or recess area 216*a* has a larger expanse than the second relief or recess area 216*b* to cover over a retaining hole 262 of a retaining member 264 of a lock device 118. Another reason for variation is size of reliefs 216*a* and 216*b* is that the size differences function as an "index" or "keying" or "guiding" feature during initial assembly, guiding users to orient cover 112 properly in which only one orientation is the proper orientation with link 108 for inserting supports 204 of cover 112 into link 108. As further detailed below, first recess area 216*a* and second recess area 216*b* contact respective first and second top surfaces 234 and 232 of link 108, with the raised edges 240 and 238 of link 108 mating with raised edges 224 and 226 of cover 112 to form anti-torque steps, which counter potential torque attacks on locking link 100*a*.

As further indicated above, cover 112 further includes one or more reinforcement structure 206 that is comprised of cavities on surface 218 of cover 112 that provides reinforcement for posts 246 and 248 of link 108, with a free end of post 246 and 248 received within cavities 206*a* and 206*b* and interlocked when cover 112 is locked with link 108 (FIGS. 2C-1 and 2C-4). As detailed below, cavity wall portions 268*a* and 268*b* engaged (contacting) with free end of post 246 and 248 to block or prevent the post 246 and 248 from being bent due to tampering. When in locked position, the free end of the post 246 and 248 are inserted into the cavity 206*a* and 206*b*, with cavity walls 268*a* and 268*b* preventing the post 246 and 248 from being bent when an attempt is made to pull the securing member 102*a* out of link 108 because wall portions 268*a* and 268*b* of cavity 206*a* and 206*b* contacting post end 246 and 248 will block it from bending. Accordingly, cavity walls 268*a* and 268*b* provide reinforcements to counter tensile (pulling) forces on posts 246 and 248.

FIGS. 2B-1 to 2B-8 are non-limiting, exemplary illustrations of various perspective views of a link of the locking link illustrated in FIGS. 1A to 1C in accordance with one or more embodiments of the present invention. As illustrated, in this non-limiting, exemplary embodiment, link 108 is comprised of a generally cylindrical configuration having a top side 228 that includes at least one support hole 230 for receiving and securing a support 204. Link 108 further optionally may include bottom side fastener holes 280 to fasten link 108 to a structure or gate 104. It should be noted that as with supports 204, the number and position of support holes 230 may be varied in accordance with number and position of supports 204. Top side 228 has a topography that is generally a negative topography of bottom surface 202 of cover 112. That is, top side 228 is comprised of a plurality of offset surfaces that define raised edges, with the offset surfaces and resulting raised edges forming recesses that accommodate complementary raised edges of cover 112. Specifically, top side 228 is comprised of offset, planer surfaces 232 and 234 that form raised edges 238 and 240 in relation to the lowest elevation offset surface 236, with the lowest offset surface 236 and the resulting raised edges 238 and 240 forming a relief or recessed area that receives highest elevation surface 218 of bottom side 202 of cover 112.

As illustrated, offset surface 234 has a larger expanse to accommodate retainer opening 262 for retaining member 264 of lock 118. Retainer opening 262 is generally positioned at interior portion of the offset surface 234 (within indentation 274) so that at a first interlock position, offset surface 220 of bottom 202 of the cover 112 in combination with walls defined by indentation 274) cover over and blocks access to the retainer member 264. This prevents a person trying to pry open retainer member 264. As illustrated, recesses or reliefs 216*a* and 216*b* formed from offset surfaces 220 and 222, including their respective raised edges 224 and 226 of bottom side 202 of cover 112 mate or come into contact with respective offset surfaces 234 and 232 and their raised edges 240 and 238, a combination of which form anti-torque structure.

As further illustrated, link 108 further includes a first and a second linking recesses 242 and 244 that includes respective link posts 246 and 248 for assembly of securing member 102*a* onto link 108. The depth of recesses 242 and 244 and the height of posts 246 and 248 may be varied and is dictated by the thickness of securing member 102*a* used. It should be noted that in this embodiment, one end of securing member 102*a* may be coupled with a first door of a gate 104 and a second end, (linking-end 100) to be linked with link 108. This would mean that locking link 100*a* may comprise of only a single recess and a single post rather than a multiplicity thereof as illustrated.

As also illustrated in FIGS. 2C-1 to 2C-4, first and second posts 242 and 244 of link 108 include a top end that has offset surfaces 250 and 252 that defines a raised edge 254, formed from a notched step, with a lower surface 250 of the offset surfaces engaging bottom periphery side 266 of cover 112. Upper surface 252 (and raised edges 254) of the offset surfaces is received within the cavity 206. Raised edges 254 within cavity 206 contact a portion 268 of a wall of cavity 206. In other words, the free end of post 242 and 244 includes offset surfaces 250 and 252 that defines raised edge 254, formed from a notched step, with lower surface 250 of the offset surfaces engaging the bottom periphery side 266 of cover 112, an upper surface 252 of the offset surfaces received within cavity 206, and raised edge 254 within the cavity 206 contacting a portion 268 of a wall of cavity 206. It should be noted that the post structure defined (notched step, offset surfaces, etc.) are oriented or face away from recesses 242 and 244.

In general, it is preferable that second post 248 be longer than first post 244 (which means that cavity 206*b* has more depth than cavity 206*a*), with the second, longer post 248 retaining linking end 110 of securing member 102*a* when cover 112 is at the second interlocked position (FIGS. 2C-3 and 2C-4), unlocked from link 108. This way, securing member 102*a* does not come out or off link 108 as cover 112 opens and is at the unlock position. This further facilitates in ease of use of locking link 100*a* in that at least one end of security member 102*a* is already interlocked within link 108 and need not be reengaged after every use of locking link 100*a*.

It should be noted that the actual physical position of posts 246 and 248 and their respective recesses 242 and 244 may be varied in relation to each other (and hence, cavities 206 may also be repositioned accordingly) so long as they comfortably accommodate each end 110 of securing member 102*a*. For example, first and second posts 246 and 248 (and recesses 242 and 244) need not be positioned directly opposite each other, at diametrically opposite ends of the link 108 as illustrated, but may in fact, be positioned next to (or adjacent) one another or some location (e.g., at 90 degrees separation) in between the two extremes (i.e., diametrically opposed verses adjacent positions). As further illustrated, link 108 is further comprised of a curved side 256 that includes side recesses 242 and 244, posts 248 and 248, a side hole 258 and an engagement opening 260. As detailed below, side hole 258 receives and houses lock 118, and engagement opening 260 receives and houses an engagement member 128.

FIGS. 3A to 3J are non-limiting, exemplary sectional views of the link illustrated in FIGS. 1A to 2C-4 in accordance with one or more embodiments of the present invention. As best illustrated in FIGS. 1C and 3A to 3J, link 108 detachably accommodates a well-known and conventional lock 118, which may be inserted into the side hole 258 such that a longitudinal axis of lock 118 is substantially collinear with longitudinal axis 302 of side hole 258.

Lock 118 may have any shape and shape of internal surfaces 304 and 308 of respective first and second chambers 310 and 312 of side hole 258 may resemble the shape of the external surface of lock 118, such that the external surface of the lock 118 and internal surfaces 304 and 308 of side hole 258 form substantially associated surfaces. The term "associated surfaces" within the context of the above sentence only, refers to surfaces that, at any location, may be substantially parallel to each other. That is, the tangent at any point on one surface is substantially parallel to a tangent from the corresponding point of the other surface (for example, a hand and glove relationship). The external dimensions of lock 118 and the internal dimensions of side hole 258 may be such that lock 118 may be able to slide freely within side hole 258 without interference. It is also contemplated that portions of the external surface of lock 118 may be in contact with internal surfaces 304 and 308 of side hole 258.

As further illustrated, link 108 further includes a retaining hole 262 through which a retaining member 264 passes. Retaining member 264 may be threaded on its external surface. The internal surface of retaining hole 262 may also be threaded to mate with threads on the retaining member 264. A longitudinal axis 306 of retaining hole 262 may perpendicularly intersect longitudinal axis 302 of side hole 258. When retaining member 264 is screwed into the retaining hole 262, a portion of the retaining member 264 may protrude into side hole 258.

Lock 118 may also include an outer surface with a keyway (well known and hence, not shown) that may comprise of a slot with the retaining member 264 extend into the keyway slot. The dimensions of the retaining member 264 may be such that it permits the lock 118 to slide freely (travel) a certain distance within side hole 258 while preventing the lock 118 from being pulled out of side hole 258.

Side hole 258 is comprised of first and second chambers 310 and 312, with the first chamber 310 of side hole 258 larger than second chamber 312. The first chamber 310 accommodates key-cylinder 120 of lock 118 and the second chamber 312 accommodates an actuator assembly 124 of the lock 118. Key-cylinder 120 includes well known driver mechanism assembly 136 that interface with well known actuator assembly 124 that moves well known locking member 130 from one of a lock to unlock position in accordance with the motion of the driver mechanism. Actuator assembly 124 is well known and in this non-limiting, exemplary embodiment is comprised of an arrestor 314 that retains one end 336 of a torsion spring 316, with the second end 338 of torsion spring 316 positioned with a groove 318 of an actuator 320, with the actuator 302 actuating a lock member 130. In this non-limiting, exemplary embodiment, locking member 130 is a ball bearing, wherein a rotation of the actuator 320 moves ball bearing 130 from one of a locked to an unlocked position (as detailed below).

The non-limiting, exemplary side hole 258 (including its chambers 310, 312, notch 340, etc.) is configured to house a particular lock 118 and actuator assembly 124 illustrated as a non-limiting, example for this embodiment. However, the structure defining side hole 258 may be varied depending on the types of lock 118 used (as detailed below with respect to further non-limiting, exemplary embodiments disclosed).

Just as link 108 has side hole 258 to accommodate and house lock 118, it also includes tunneling 322 and 324 for insertion (as shown by arrow 328) and positioning of locking member 130 inside link 108 in cooperative working relationship with actuator 320 (detailed below). As illustrated, an opening 330 of first tunnel 322 may be bored from a wall 326 of recess 242 of link 108, leading to support hole 230*b*. Thereafter, a second tunnel 324 may be bored, opening into second chamber 312, which would enable insertion of lock member 130 within link 108 and in cooperative relation with actuator 320. As illustrated tunneling 322 and 324 is oriented transverse side hole 258, parallel the engagement hole 260. It should be noted that opening 330 to tunnel 322 starts at link recess 242 so that when cover 112 is in locked position, securing member 102*a* would block access to the tunnels. Further, the position and orientation of tunnels is in relation to support 204*b* that includes lock portion 208 and hence, the position and orientation of tunnels 322 and 324 may vary if the position of support 204*b* is changed.

Figure 4A:
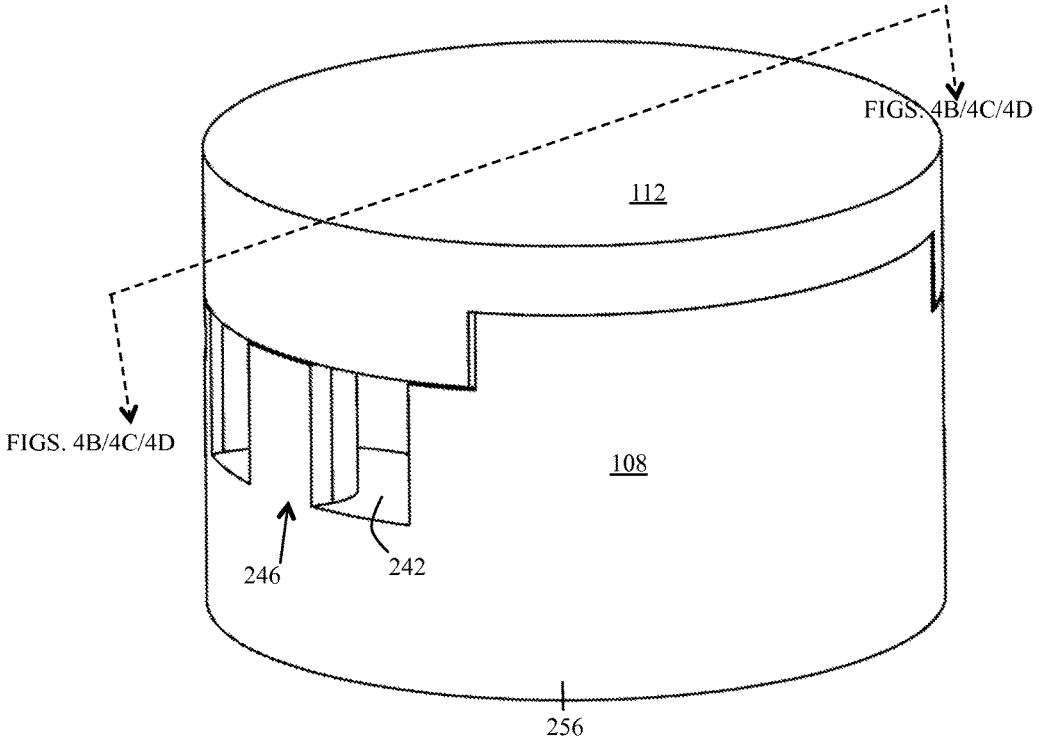
FIG. 4A is a non-limiting, exemplary perspective view illustration of lock link illustrated in FIGS. 1A to 3J in accordance with one or more embodiments of the present invention.
Figure 4B:
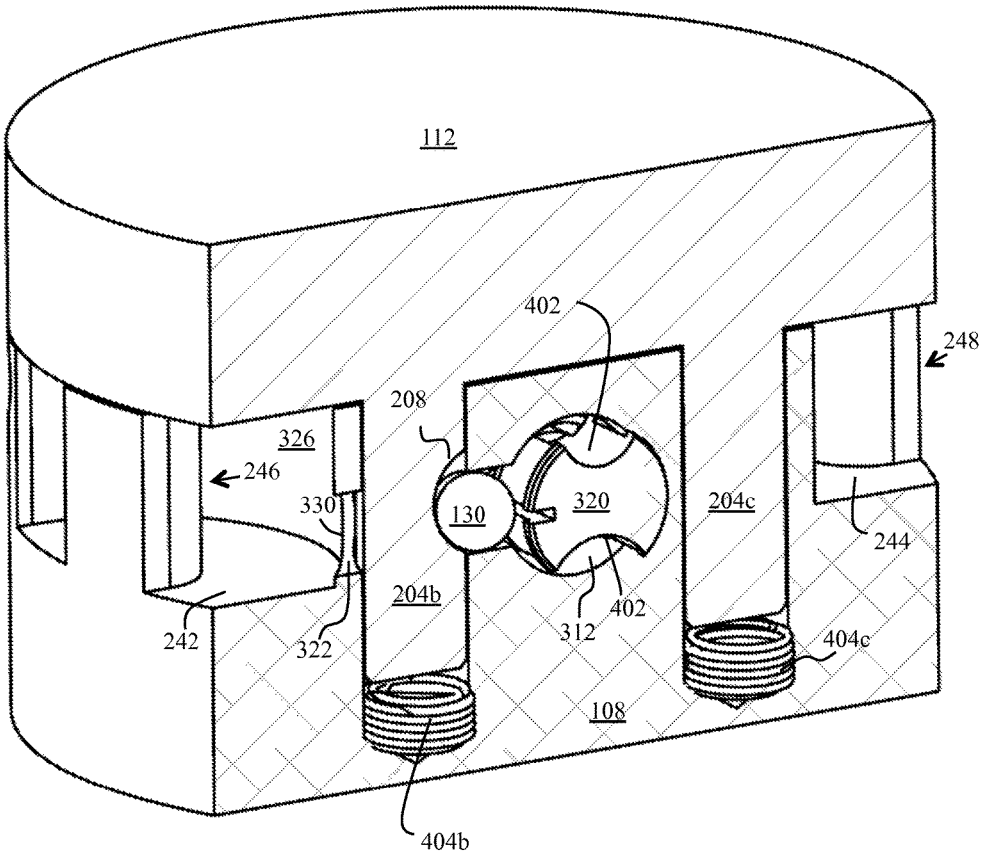
FIGS. 4B to 4D are non-limiting, exemplary sectional illustrations, detailing cover—link assembly in view of actuator assembly and supports, and progressively illustrating unlocking of cover from link in accordance with one or more embodiments of the present invention.
Figure 4C:
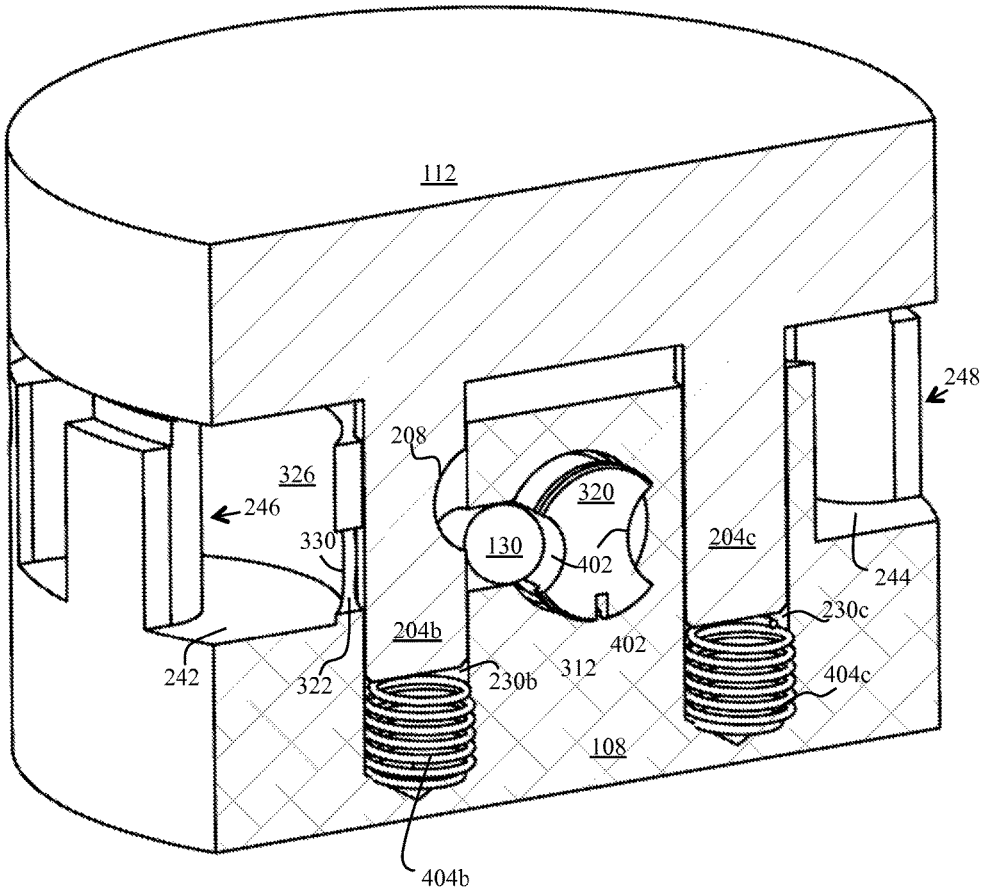
Figure 4D:
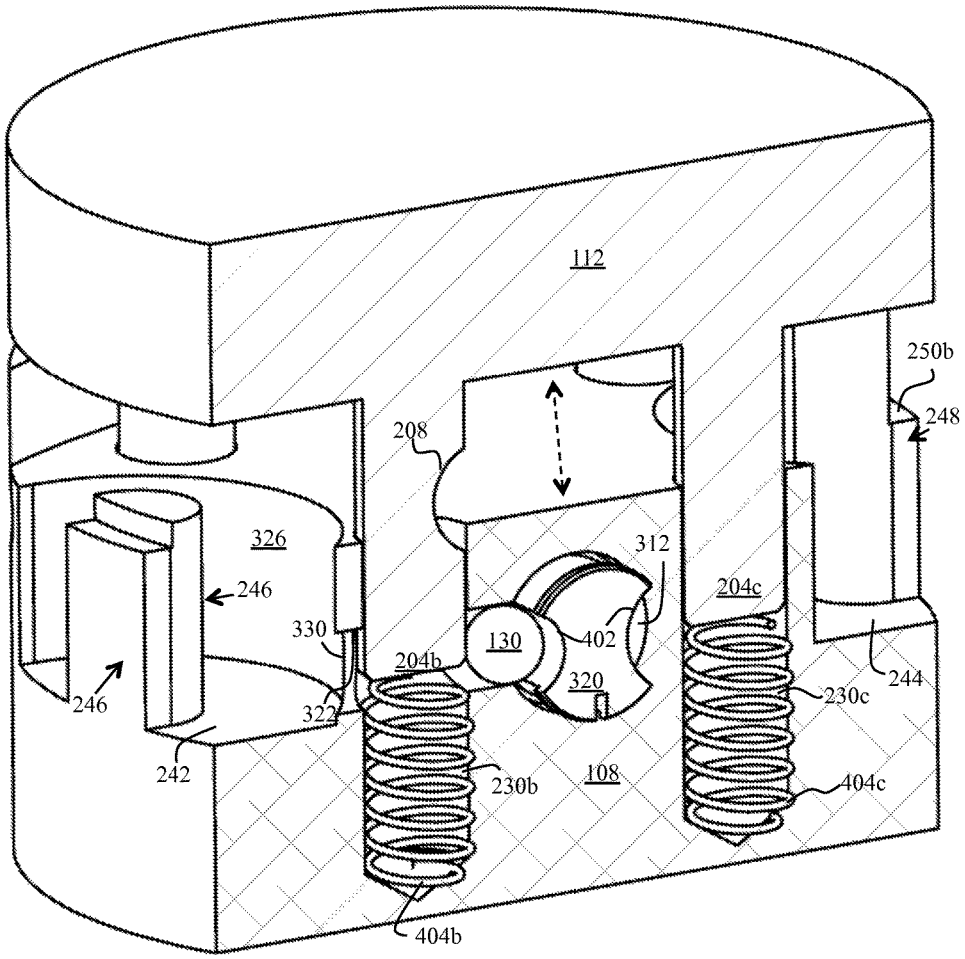

FIG. 4A is a non-limiting, exemplary perspective view illustration of lock link illustrated in FIGS. 1A to 3J in accordance with one or more embodiments of the present invention. FIGS. 4B to 4D are non-limiting, exemplary sectional illustrations, detailing cover—link assembly in view of actuator assembly and supports, and progressively illustrating unlocking of cover from link in accordance with one or more embodiments of the present invention. As illustrated in FIGS. 4A to 4D, in this non-limiting, exemplary embodiment locking member 130 is comprised of a ball bearing that may be accommodated by concave portion 402 of actuator 320 when cover 112 is in unlocked position (FIG. 4D), and is accommodated by recesses 208 of the support 204*b* when cover 112 is in locked position (FIG. 4B). That is, motion of actuator 320 moves locking member 130 from concave portion 402 and into recess 208 of support 204*b* to lock cover 112 with link 108. Locking member 130 is moved from recess 208 of support 204*b* and back into concave portions 402 of actuator 320 to unlock cover 112 from link 108. It should be noted that a first biasing mechanism (torsion spring) 316 is biased to a default, rest position when actuator 320 is in locked position (FIG. 4B), and as detailed below, stores mechanical energy when actuator 320 is in the unlocked position (FIG. 4D).

As progressively illustrated in FIGS. 4B to 4D, it is well known that torsion spring 316 stores mechanical energy when actuator 320 is in unlock position (FIG. 4D). This means that actuator 320 is biased to move to a locked position by torsion spring 316. However, actuator 320 is prevented from moving to a locked position (FIG. 4B) by locking member 130 now positioned in between concave portion 402 of actuator 320 and support 204*b* (FIG. 4D). This prevents or blocks torsion spring 316 from releasing stored mechanical energy to move actuator 320 from unlocked (FIG. 4D) to a locked position (FIG. 4B). Locking member 130 now stuck in between concave portion 402 of actuator 320 and support 204*b* has no room to move. At this phase (FIG. 4D), supports 204 are biased by coil springs 404 to unlock position and therefore, prevent cover 112 moving from unlocked position (FIG. 4D) to a locked position (FIG. 4B).

When a user pushes onto cover 112 to a locked position (FIGS. 1B-6), coil springs 404 compress, and supports 204 are lowered against the compression force of coil springs 404. As the supports 204 are lowered to the final locked position (FIG. 4B), lock recess 208 of support 204*b* aligns with position of locking member 130 and concave portion 402 of actuator 320. The recess 208 provides an "open space" to allow lock member 130 to move. At this phase, torsion spring 316 releases stored mechanical energy to move actuator 320, which in turn, pushes locking member 130 out of concave portion 402 of actuator 320 and into recess 208 of support 204. This automatically (or mechanically) locks cover 112 with the link 108. At this locked phase (FIG. 4B), coil springs 404 store mechanical energy and the torsion spring 316 has released mechanical energy and cover 112 is fully locked with link 108.

When unlocking lock 118, the turn of the key rotates actuator 320 from its locked position to unlocked position against the bias of torsion spring 316. This enables torsion spring 316 to again store mechanical energy. When actuator 320 is rotated to an unlock position, concave portion 402 of actuator 320 is aligned with recess 208 of support 204*b* that now accommodates locking member 130. At this phase, coil springs 404 release their mechanical energy to push cover 112 away from link 108. This motion of cover 112 and hence, support 204*b*, moves or rolls out locking member 130 from recess 208 of support 204*b* and into concave portion 402 of actuator 320, automatically allowing the supports 204 and cover 112 to an unlock position.

Figure 5A:
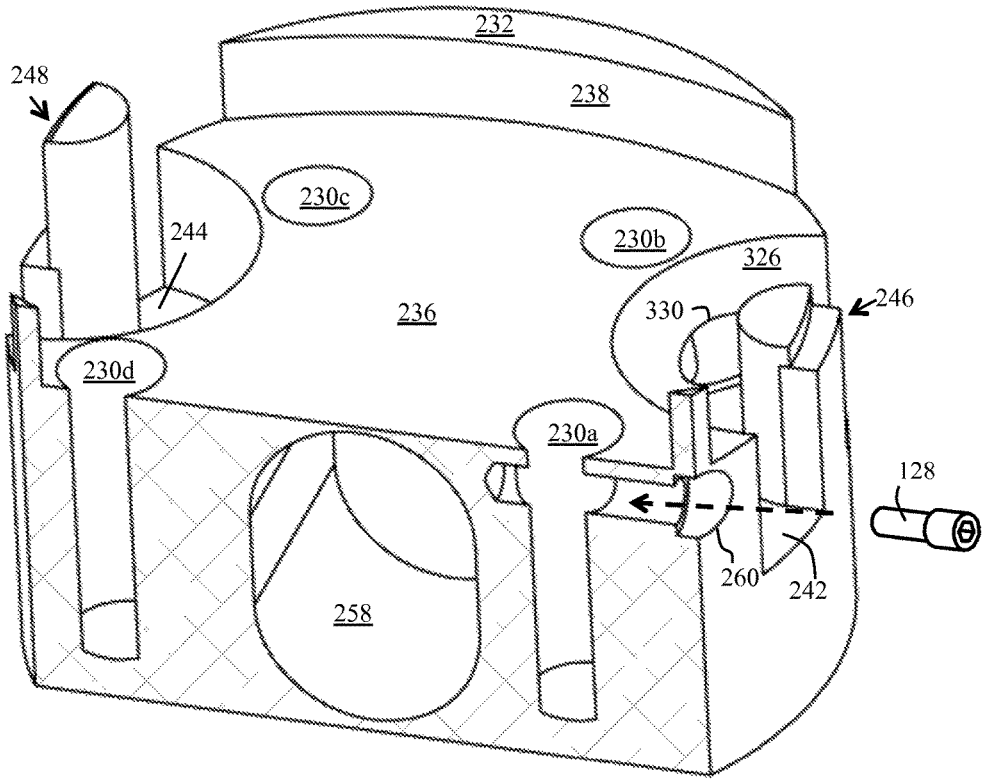
FIGS. 5A and 5B are non-limiting, exemplary sectional views of the link illustrated in FIGS. 1A to 4D that detail an engagement hole in accordance with one or more embodiments of the present invention.
Figure 5B:
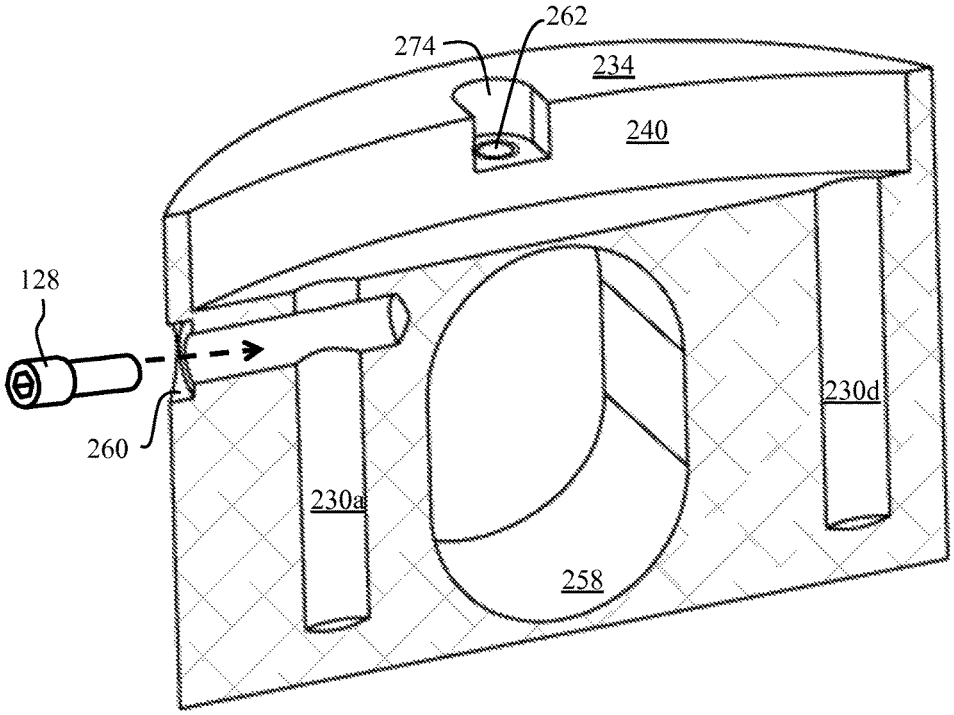
Figure 5C:
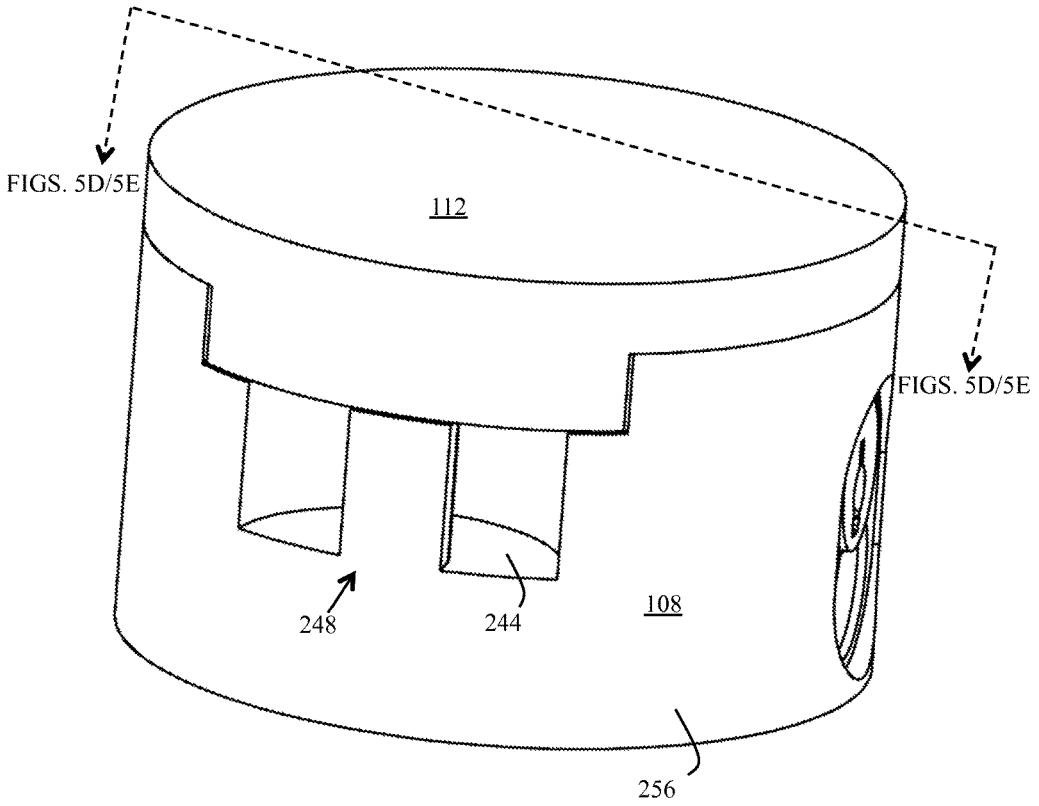
FIGS. 5C to 5E are non-limiting, exemplary sectional illustrations, detailing cover—link assembly in view of engagement opening and engagement member, and progressively illustrating continuous interlocking or engagement of cover with link from locked to unlocked position in accordance with one or more embodiments of the present invention.
Figure 5D:
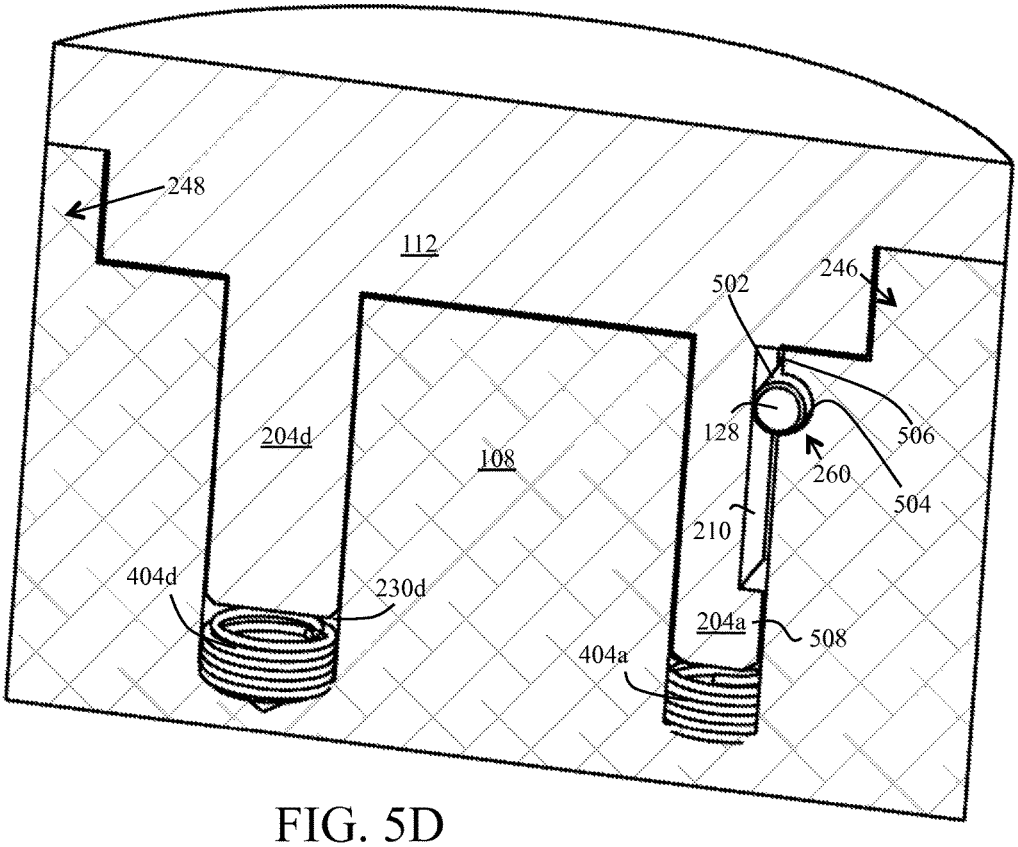
Figure 5E:
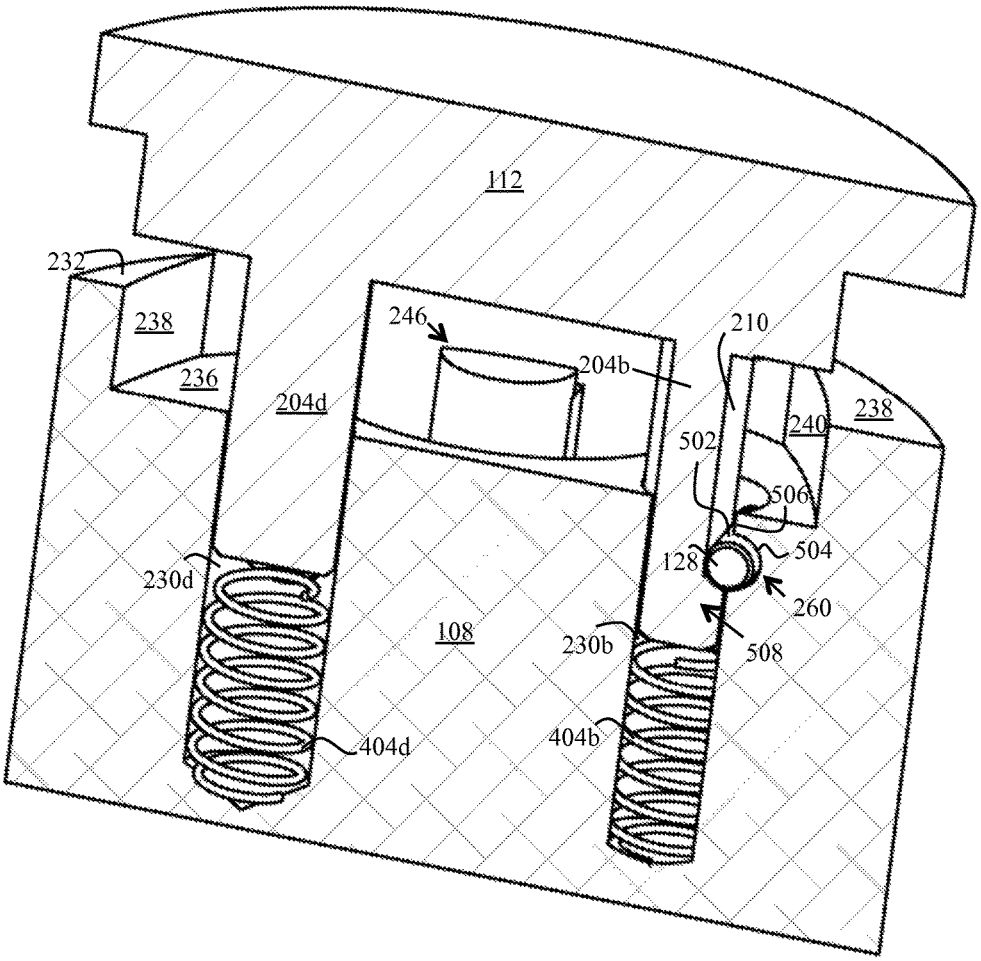
Figure 6A:
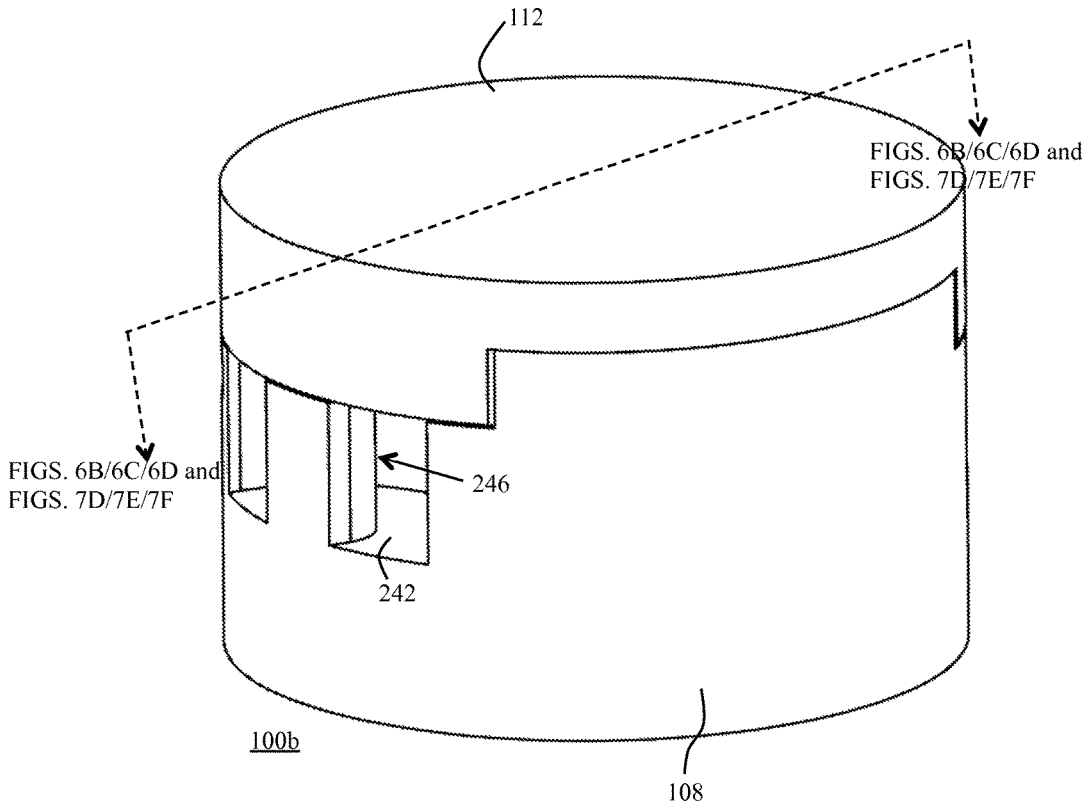
FIGS. 6A to 6I are non-limiting, exemplary illustrations of various views and sectional views of a locking link with dual lock member in accordance with another embodiment of the present invention.
Figure 6B:
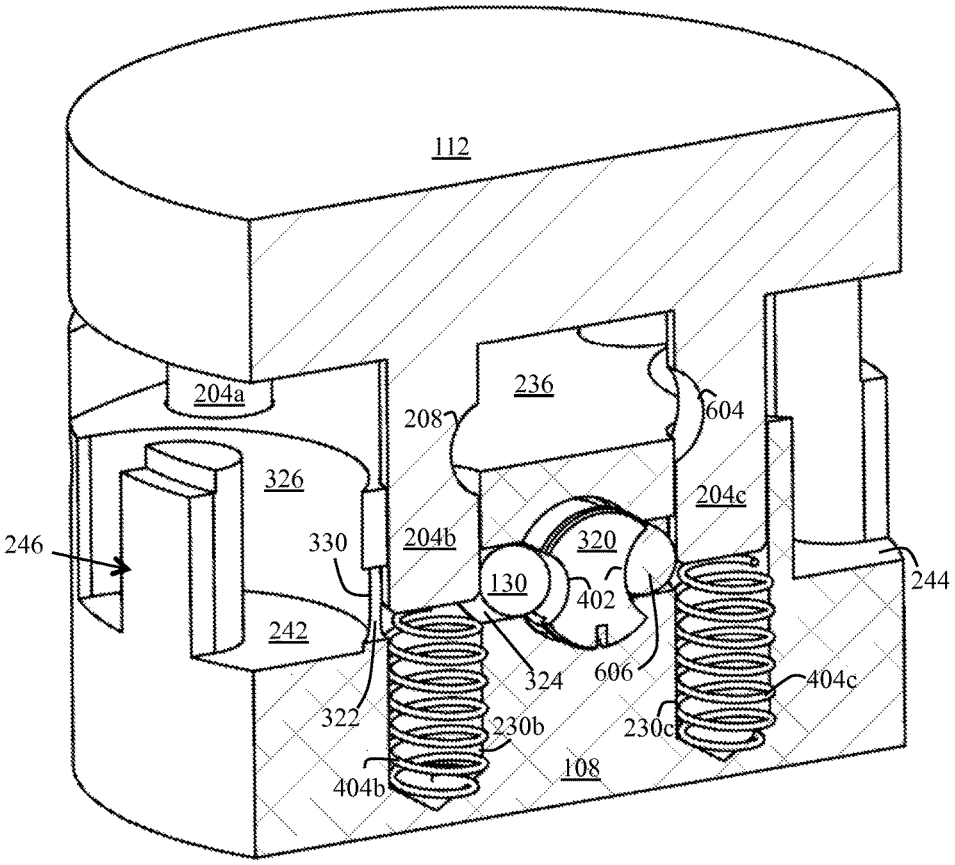
Figure 6C:
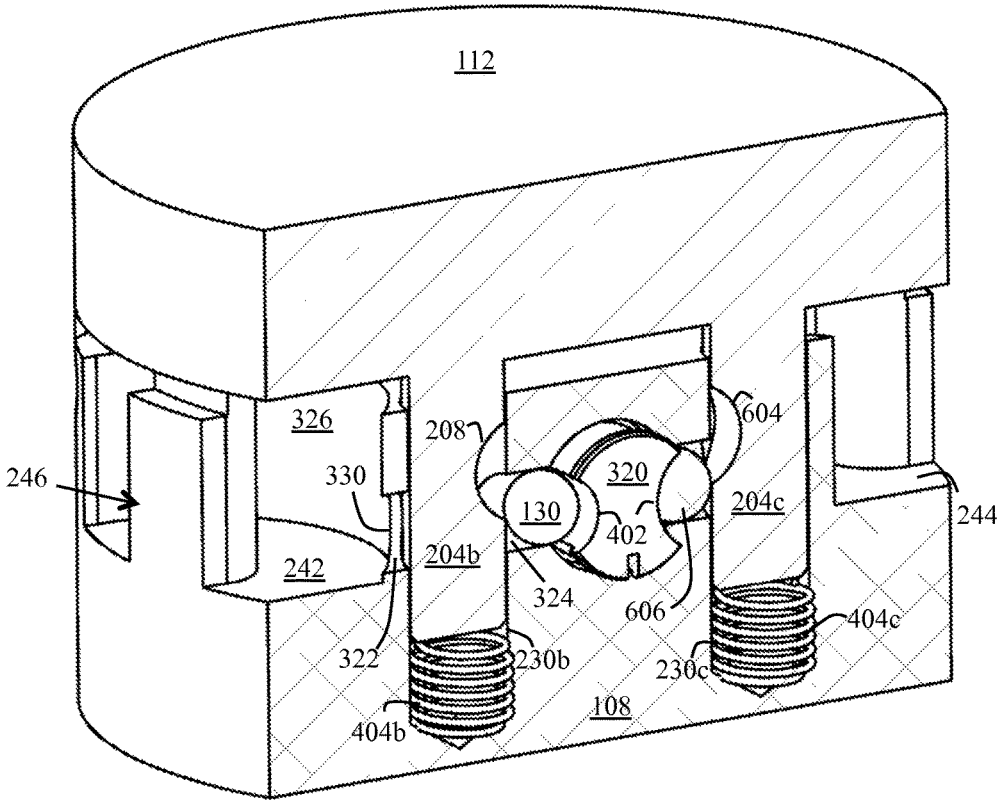
Figure 6D:
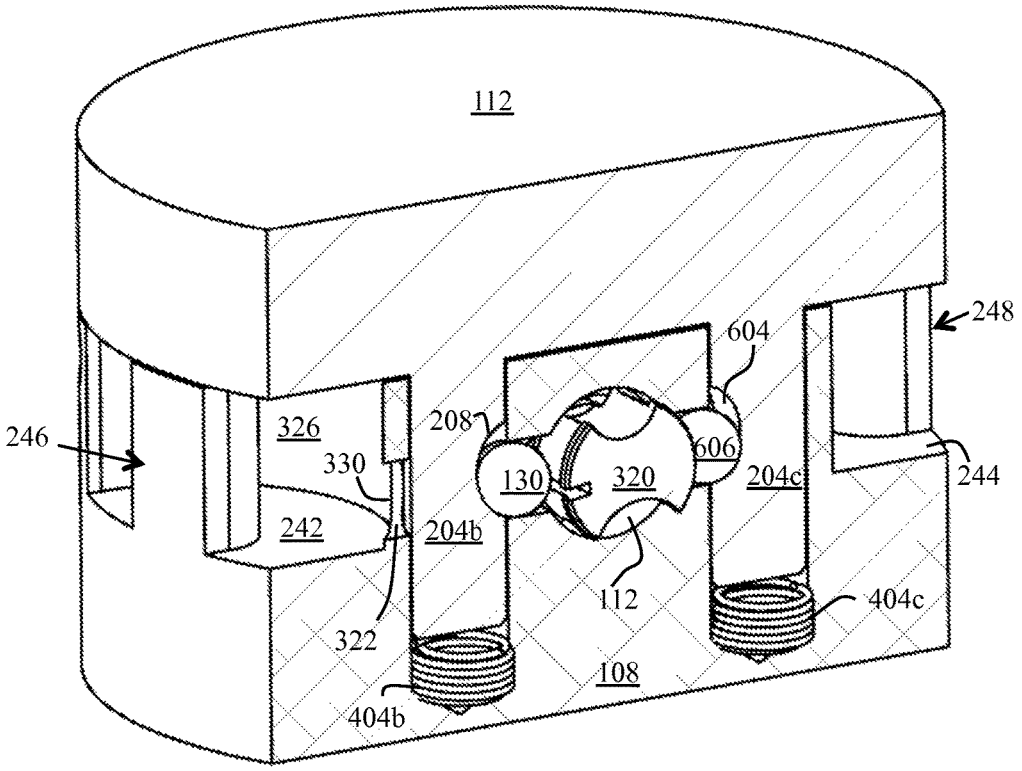
Figure 6E:
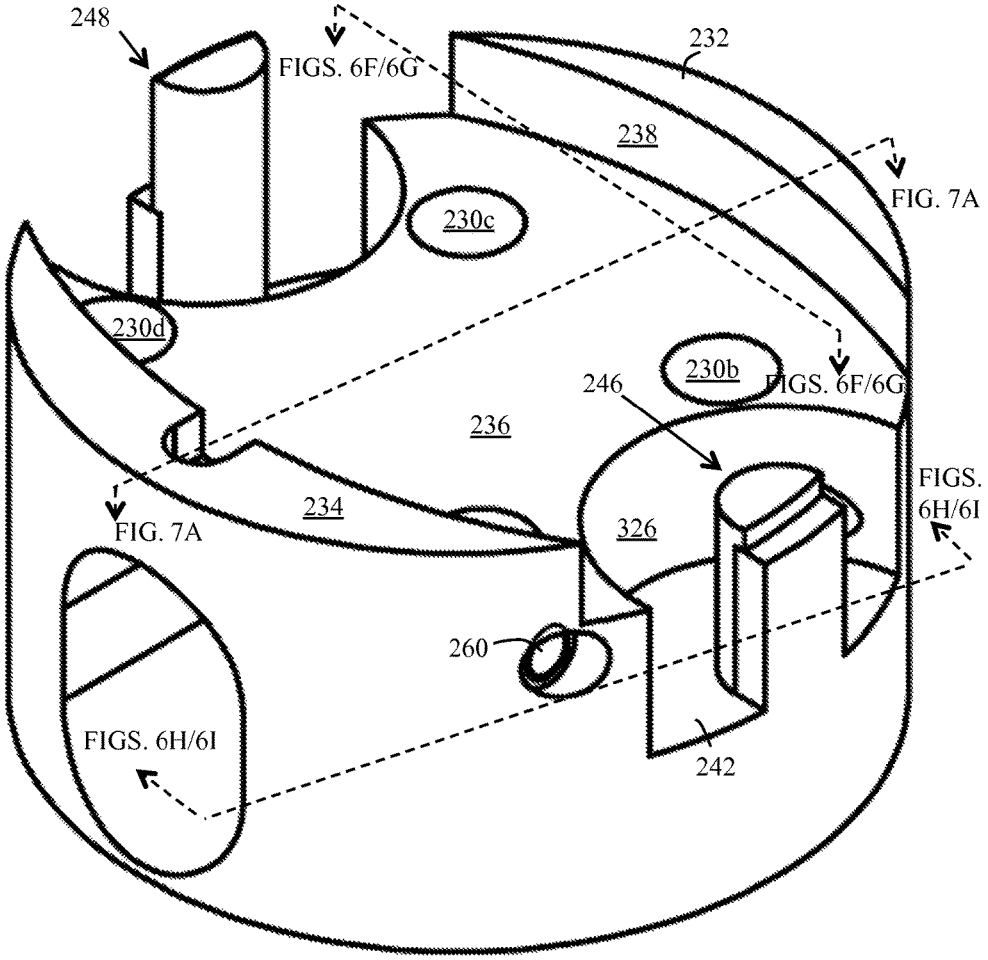
Figure 6F:
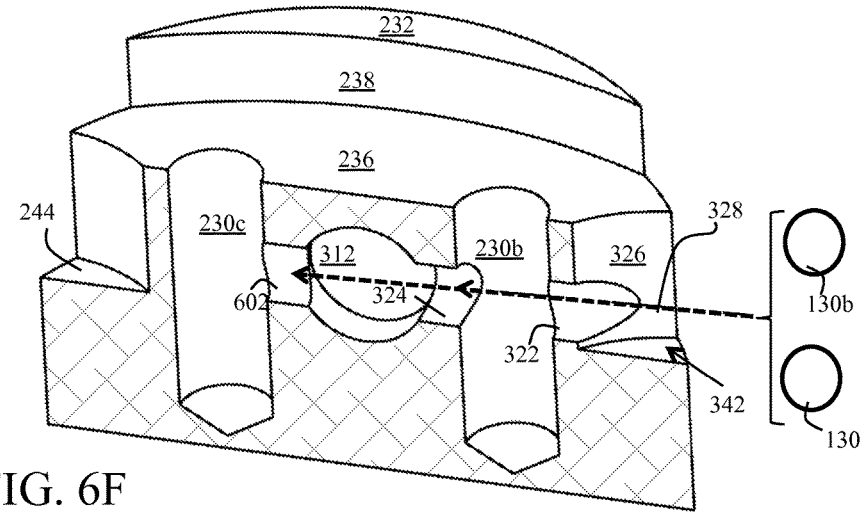
Figure 6G:
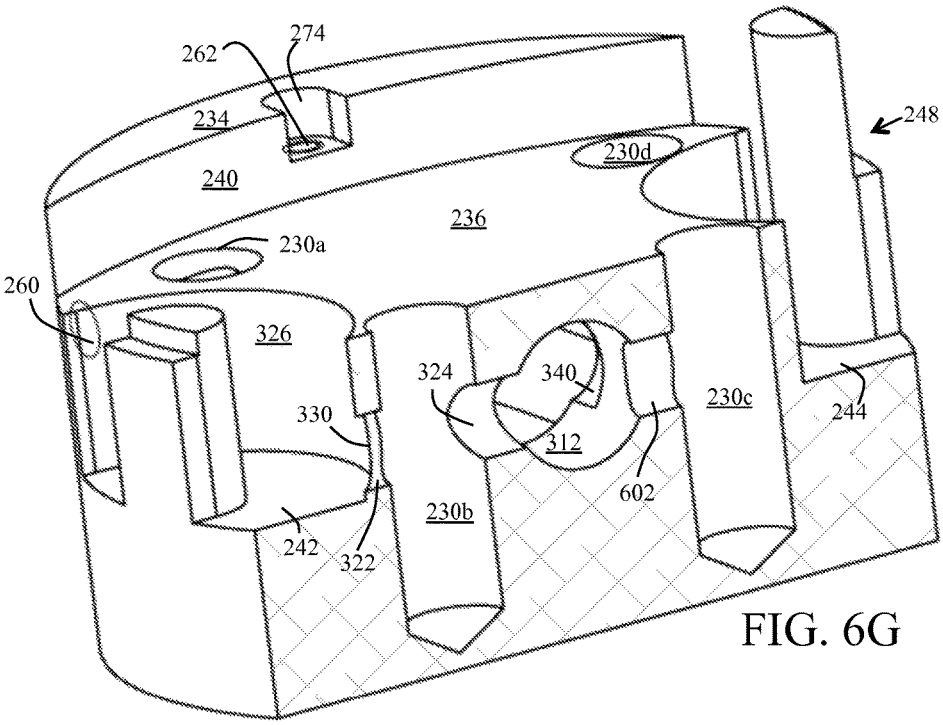
Figure 6H:
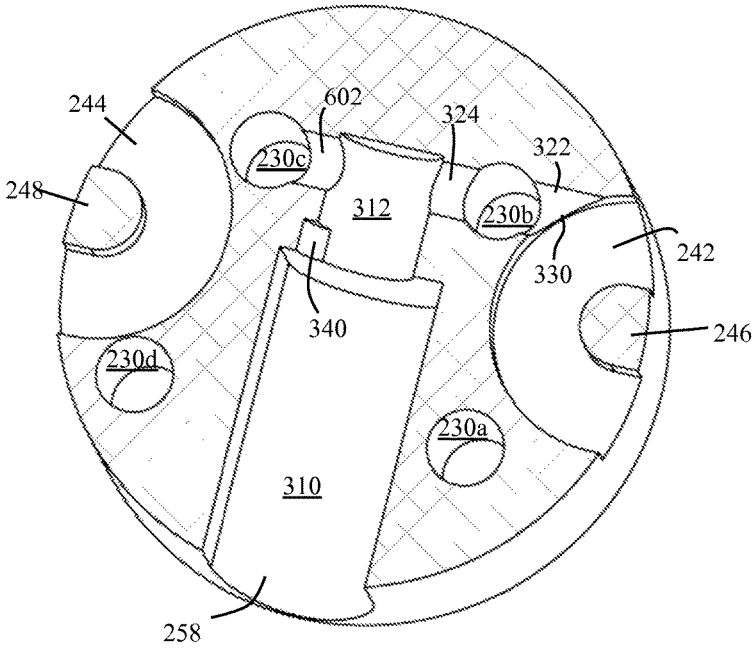
Figure 6I:
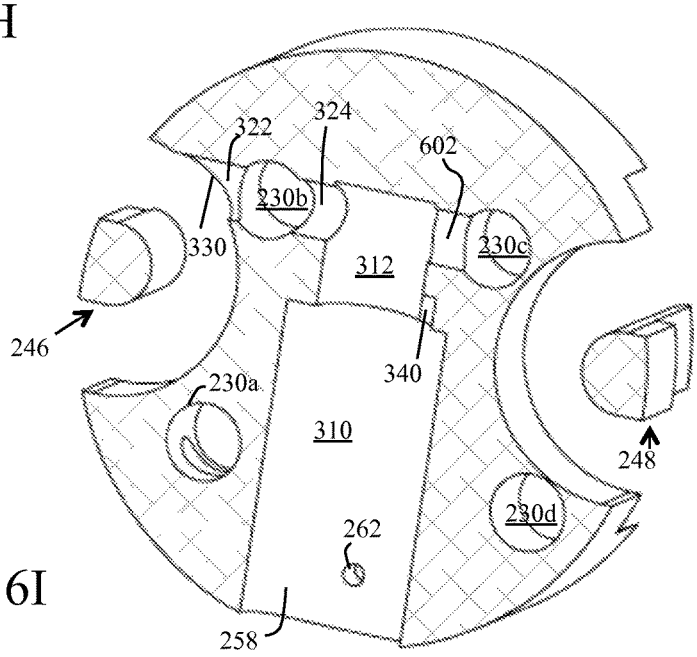
Figure 7A:
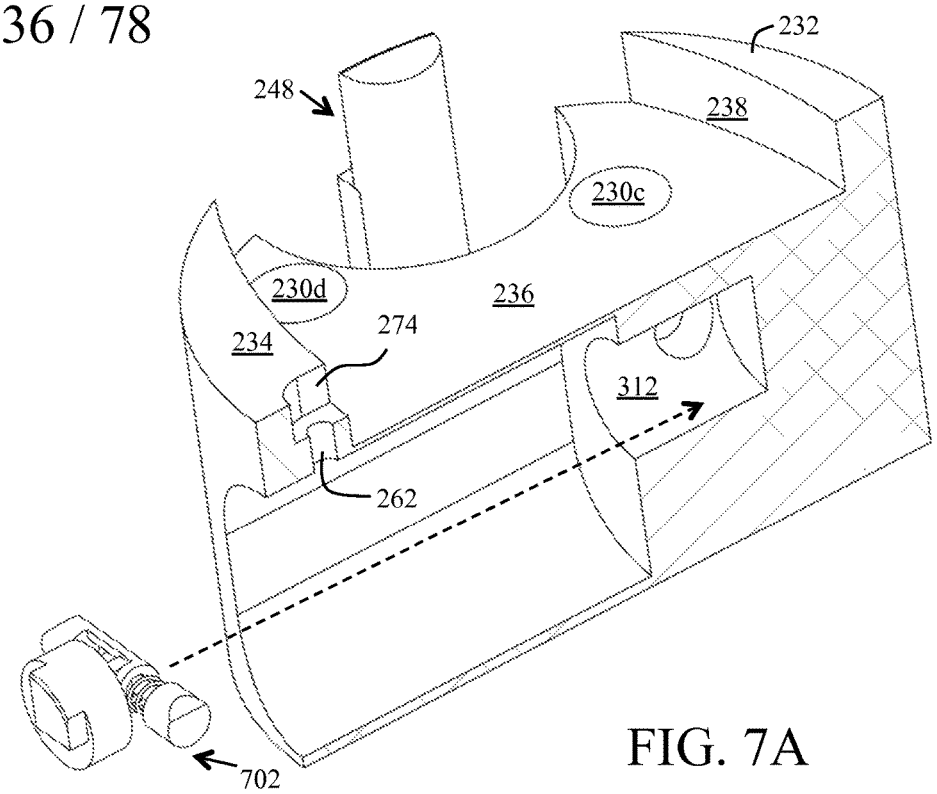
FIGS. 7A to 7F are non-limiting, exemplary illustrations of various views and sectional views of a locking link with lever type lock member in accordance with another embodiment of the present invention.
Figure 7B:
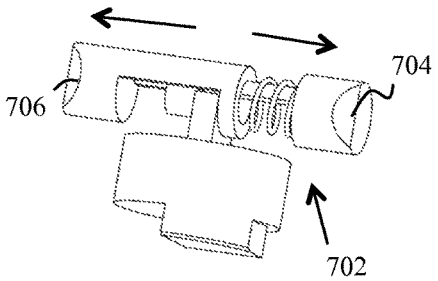
Figure 7C:
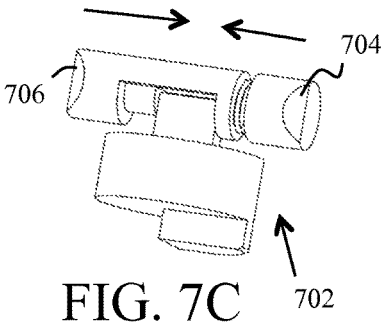
Figure 7D:
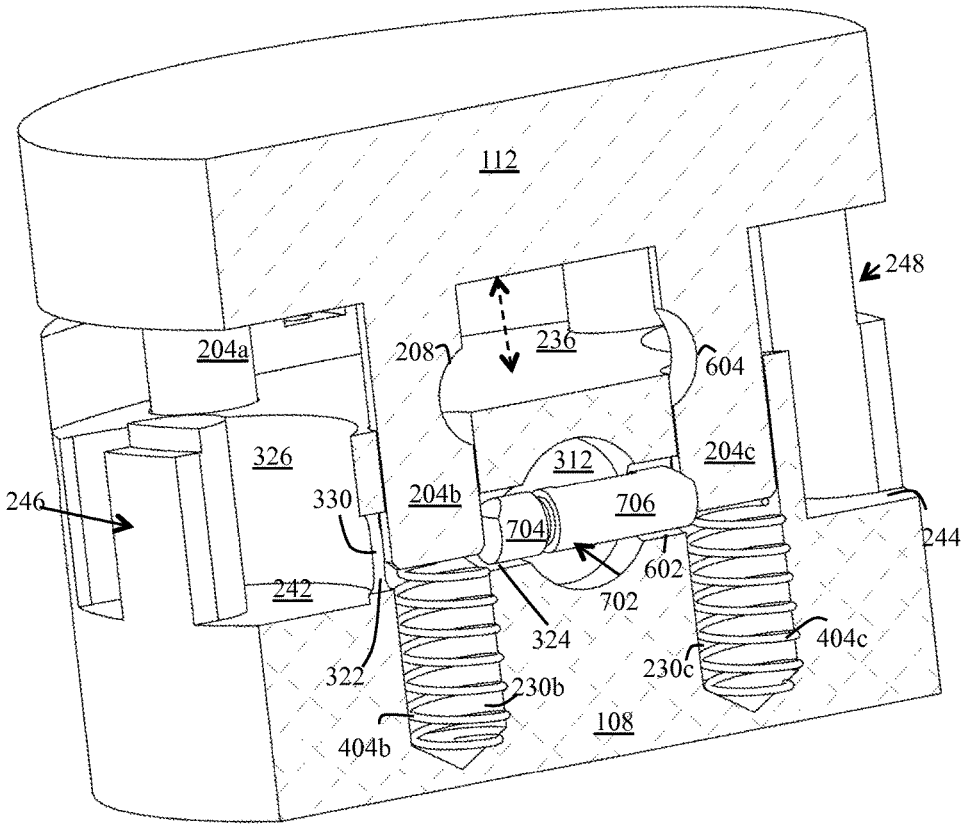
Figure 7E:
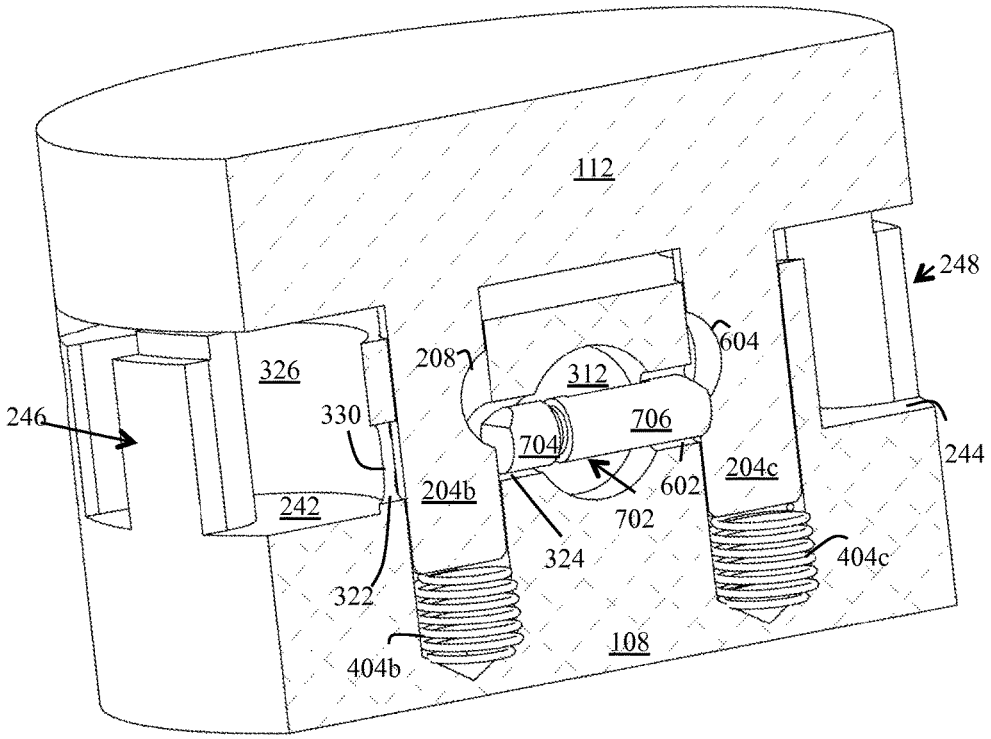
Figure 7F:
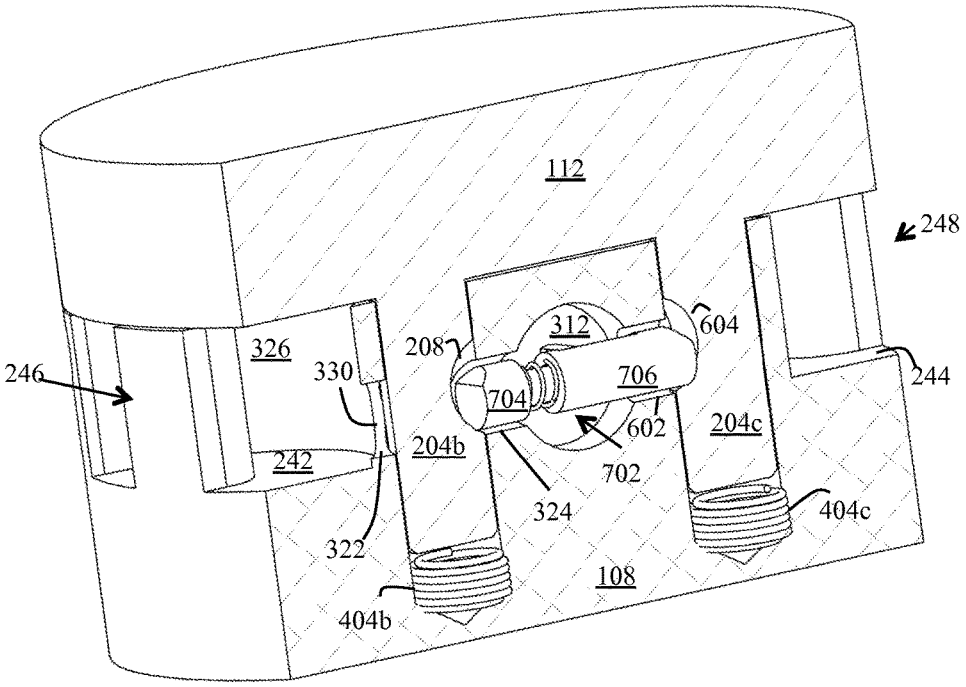

FIGS. 5A and 5B are non-limiting, exemplary sectional views of the link illustrated in FIGS. 1A to 4D that detail an engagement hole in accordance with one or more embodiments of the present invention. FIGS. 5C to 5E are non-limiting, exemplary sectional illustrations, detailing cover—link assembly in view of engagement opening and engagement member, and progressively illustrating continuous interlocking or engagement of cover with link from locked to unlocked position in accordance with one or more embodiments of the present invention.

As illustrated in FIGS. 5A to 5E, link 108 includes opening 260 for housing engagement member 128 (for example, a screw) that engages a support 204*a* of cover 112, which enables cover 112 to moveably remain interlocked (or engaged) with link 108 even in the unlocked position (FIG. 5E). In other words, engagement member 128 is a mechanism that is used that prevents cover 112 from dislodging from link 108. A preferred mechanism used is to have a fastener 128 so that it could be unfastened and allow cover 112 to be fully dislodged to enable a user to move or replace securing member 102*a* (if need be). However, other mechanisms may be used to prevent dislodging of cover 112. The essence is to have a mechanism to prevent dialoging of cover 112 from link 108 during normal use of locking link 108 (versus when a need arises to replace securing member 102*a*, for example).

As illustrated in FIGS. 5A to 5E, engagement member 128 engages the engagement portion 210 of support 204*a*. Opening 260 has internal threading, and is positioned adjacent support 204*a* and oriented to enable engagement member 128 to block and prevent detachment of detachable cover 112. Engagement member 128 has a external threading that fastens with internal threads of opening 260. When engagement member 128 is housed within opening 260, a portion 502 of engagement member 128 protrudes from opening 260 to engage with engagement portion 210 of support 204*a*. Opening 260 has an elongated cylindrical configuration with a first part 504 that has a circular, closed profile that secures engagement member 128, and a second part 506 that has a semi-circular, partially open profile. A side 502 of the engagement member 128 along a longitudinal axis thereof protrudes out of the second part 506, accommodated within engagement portion 210 of support 204*a*. As illustrated, engagement portion 210 is a cut-out or groove or notch along part of the longitudinal axis of support 204*b* that enables support 204*b* to have limited move up and down, a bottom 508 of support 204*b* is not cut and hence, when cover 112 moves up, bottom 508 engages engagement member 128 and is blocked to thereby block further move of cover 112 and prevent disengagement of the cover 112 from link 108.

It should be noted that instead of a single opening for housing a single engagement member that engages cover 112, two or more openings and respective set of engagement members 128 may also be used, one for each support for redundancy. However, use of a single opening 260 and a single engagement member 128 that engages a single support 204*a* is sufficient and therefore, is preferred. It should further be noted that the position or placement of opening 260 may be at any desired location so long as engagement member 128 housed within opening 260 may engage a support 204 (any one of the supports 204). Finally, it should be noted that once locked, even if engagement member 128 is tampered and removed, cover 112 would not unlock from link 108. However, when locking link 100*a* is properly unlocked by an authorized user with a proper key, cover 112 will be disengaged from link 108 (assuming engagement member 128 is tampered and removed), which would indicate to the user that the locking link 100*a* has been tampered.

FIGS. 6A to 6I are non-limiting, exemplary illustrations of a locking link with dual lock member in accordance with another embodiment of the present invention. Locking link 100*b* illustrated in FIGS. 6A to 6I includes similar corresponding or equivalent components, interconnections, functional, operational, and or cooperative relationships as the locking link 100*a* that is shown in FIGS. 1A to 5E, and described above. Therefore, for the sake of brevity, clarity, convenience, and to avoid duplication, the general description of FIGS. 6A to 6I will not repeat every corresponding or equivalent component, interconnections, functional, operational, and or cooperative relationships that has already been described above in relation to locking link 100*a* that is shown in FIGS. 1A to 5E.

As illustrated, locking link 100*b* incorporates lock 118 that actuates two locking members 130 and 606. In this embodiment, locking link 100*b* includes two supports 204*b* and 204*c*, with each having a lock portion (or recess) 208 and 604 that cooperate with locking members 130 and 606, similar to operations described for locking link 100*a*. This embodiment also includes tunneling 322, 324, and 602 for insertion (as shown by arrows 328) and positioning of locking members 130 and 606 inside link 108 in cooperative working relationship with actuator 320. As further illustrated with locking link 100*b*, the illustrated tunnels 602 may be bored in the same method as described for tunnels 322 and 324. It should be noted that the use of a single locking member 130*a* is preferred due to simplicity and reduction in number of parts used while maintaining locking functionality.

FIGS. 7A to 7F are non-limiting, exemplary illustrations of a locking link with lever lock member in accordance with another embodiment of the present invention. Locking link 100*c* illustrated in FIGS. 7A to 7F includes similar corresponding or equivalent components, interconnections, functional, operational, and or cooperative relationships as locking links 100*a* and 100*b* that are shown in FIGS. 1A to 6I, and described above. Therefore, for the sake of brevity, clarity, convenience, and to avoid duplication, the general description of FIGS. 7A to 7F will not repeat every corresponding or equivalent component, interconnections, functional, operational, and or cooperative relationships that has already been described above in relation to locking links 100*a* and 100*b* that are shown in FIGS. 1A to 6I.

As illustrated in FIGS. 7A to 7F, locking link 100*c* uses a well known, conventional lever lock actuator 702 that replaces rotating actuator 320 and two locking members 130*a* and 606 illustrated in relation to locking links 100*a* and 100*b* otherwise, locking link 100*c* itself is identical to locking link 100*b*. In fact, lever actuator 702 occupies the same exact position in second chamber 312 of side hole 258 as the rotating actuator 320. In this non-limiting example, notch 340 of chamber 112 may be eliminated, as lever actuator 702 does not require one for operation. In general, lever based locks 118 are very well known and have been in use for a number of years and therefore, their operation is well known. In fact, their method of operation or function with respect to locking link 100*c* (where cover 112 locks or unlocking from link 108) is identical to that of rotating actuator 320 functions and operations with two ball bearings 130 and 606. For example, instead of locking members 130*a* and 606 moving in and out of recesses 208 and 604 of supports 204*a* and 204*c*, it is arms 704 and 706 of lever actuator 702 that contracts (FIG. 7C) or expands (FIG. 7B) from recesses 208 and 604 as best progressively illustrated in FIGS. 7D to 7F. As indicated above, the structure defining side hole 258 may be varied depending on types of lock 118 used (as detailed with respect to the non-limiting, exemplary embodiments disclosed).

FIGS. 8A-1 to 8J-7 are non-limiting, exemplary illustrations of a locking link that uses a securing member that is rigid in accordance with another embodiment of the present invention. Locking link 100*d* illustrated in FIGS. 8A-1 to 8J-7 includes similar corresponding or equivalent components, interconnections, functional, operational, and or cooperative relationships as locking links 100*a*, 100*b*, 100*c* that are shown in FIGS. 1A to 7F, and described above. Therefore, for the sake of brevity, clarity, convenience, and to avoid duplication, the general description of FIGS. 8A-1 to 8J-7 will not repeat every corresponding or equivalent component, interconnections, functional, operational, and or cooperative relationships that has already been described above in relation to locking links 100*a*, 100*b*, 100*c* that are shown in FIGS. 1A to 7F.

Figures 1, 8A:
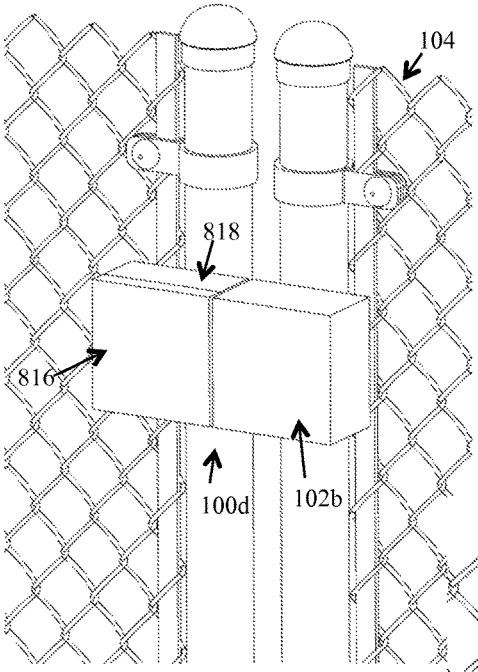
Figures 2, 8A:
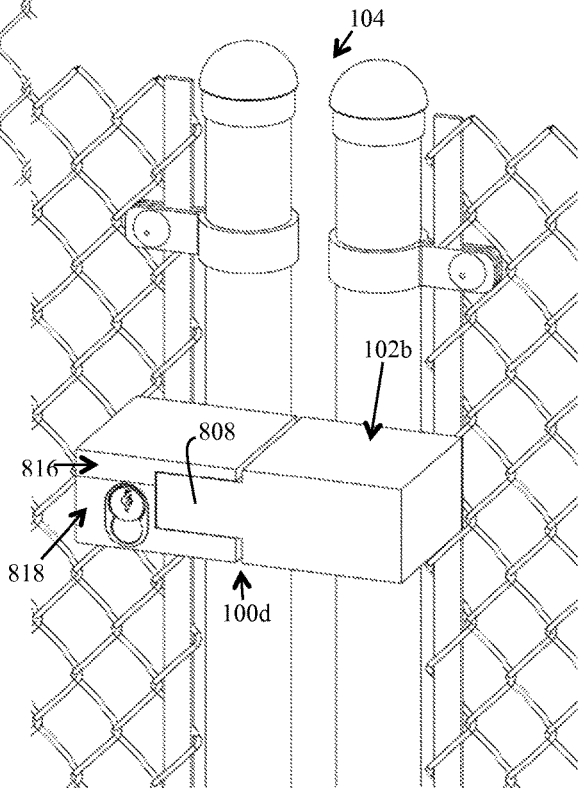

As illustrated, with this embodiment, a rigid securing member 102*b* is provided that is locked with locking link 100*d* instead of a flexible securing member 102*a*. Further, an outer shape of locking link 100*d* is not a cylindrical disc, but a generally rectangular cube. Locking link 100*d* and securing member 102*b* may be securely positioned on a gate or door 104 orientated vertically (FIG. 8A-1) or, alternatively, both may be oriented horizontally (FIG. 8A-2). FIGS. 8B to 8E are non-limiting, exemplary illustrations of the locking link 100*d* illustrated in FIGS. 8A-1 and 8A-2, which progressively illustrate a non-limiting, exemplary method of unlocking (FIGS. 8B to 8D) and re-locking (FIG. 8E) of the locking link in accordance with one or more embodiments of the present invention.

Figure 8B:
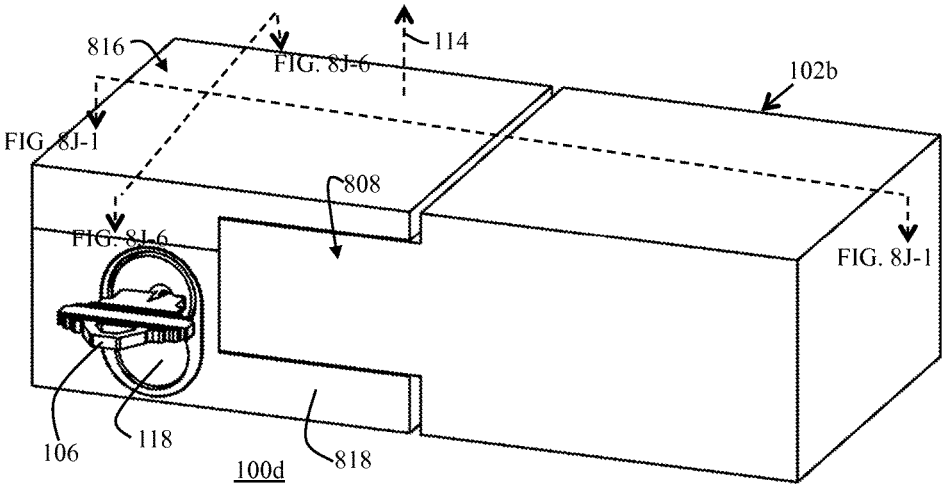
Figure 8C:
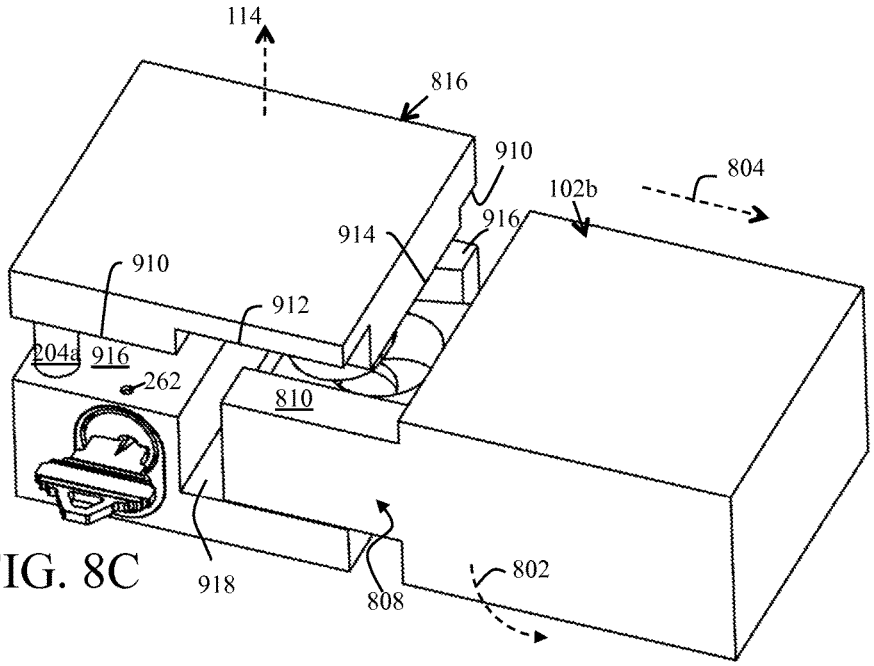
Figure 8D:
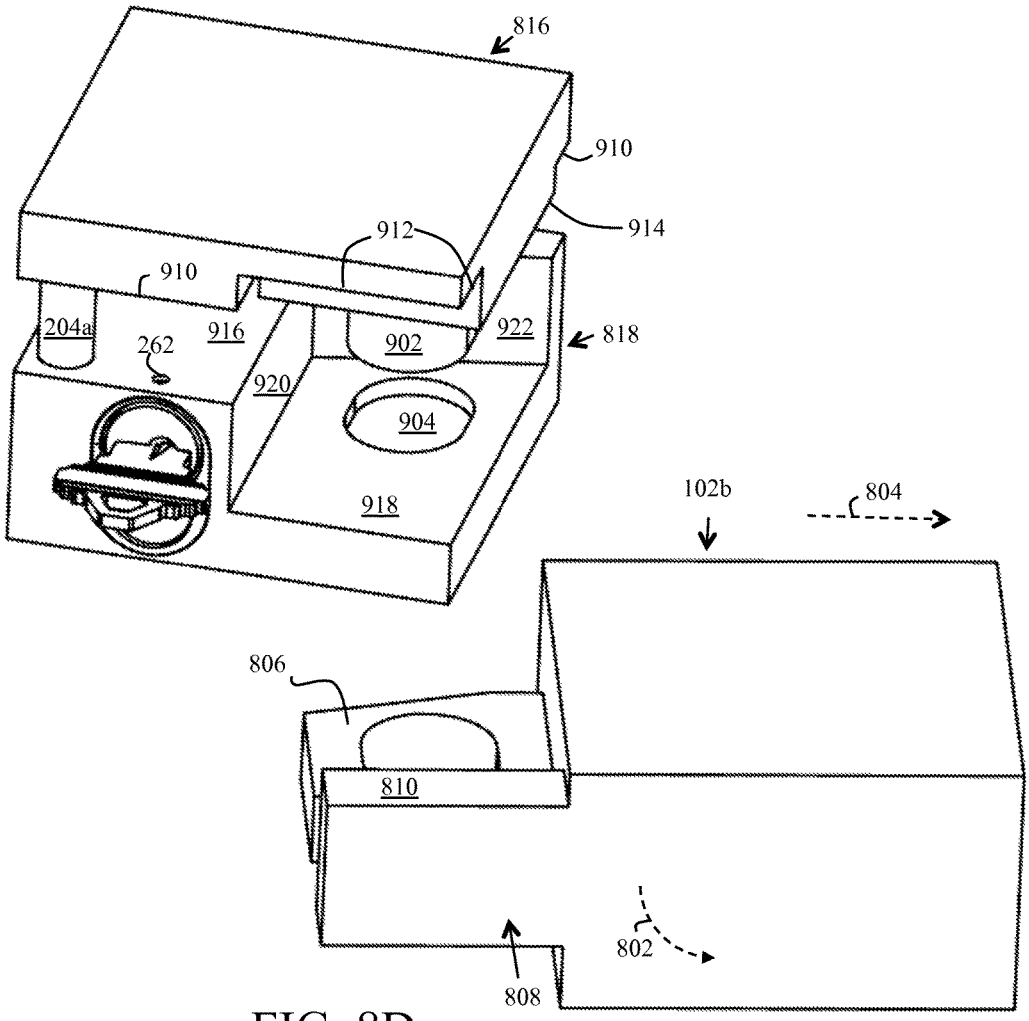

As best illustrated in FIGS. 8B to 8D, removing securing member 102*b* from locking link 100*d* includes insertion of key 106 into key-cylinder 120 of lock 118 of locking link 100*d* (FIG. 8B), turning key 106 to unlock position, and removing a linking-end 806 of securing member 102*b* from locking link 100*d* (FIG. 8D). Upon turning key 106 to the unlock position cover 816 of locking link 100*d* automatically (or mechanically) "pops" up (or opens) away from a link 818 as indicated by arrow 114 to enable users to remove and release linking-end 806 of securing member 102*b* as directed by arrows 802 and 804.

Figure 8E:
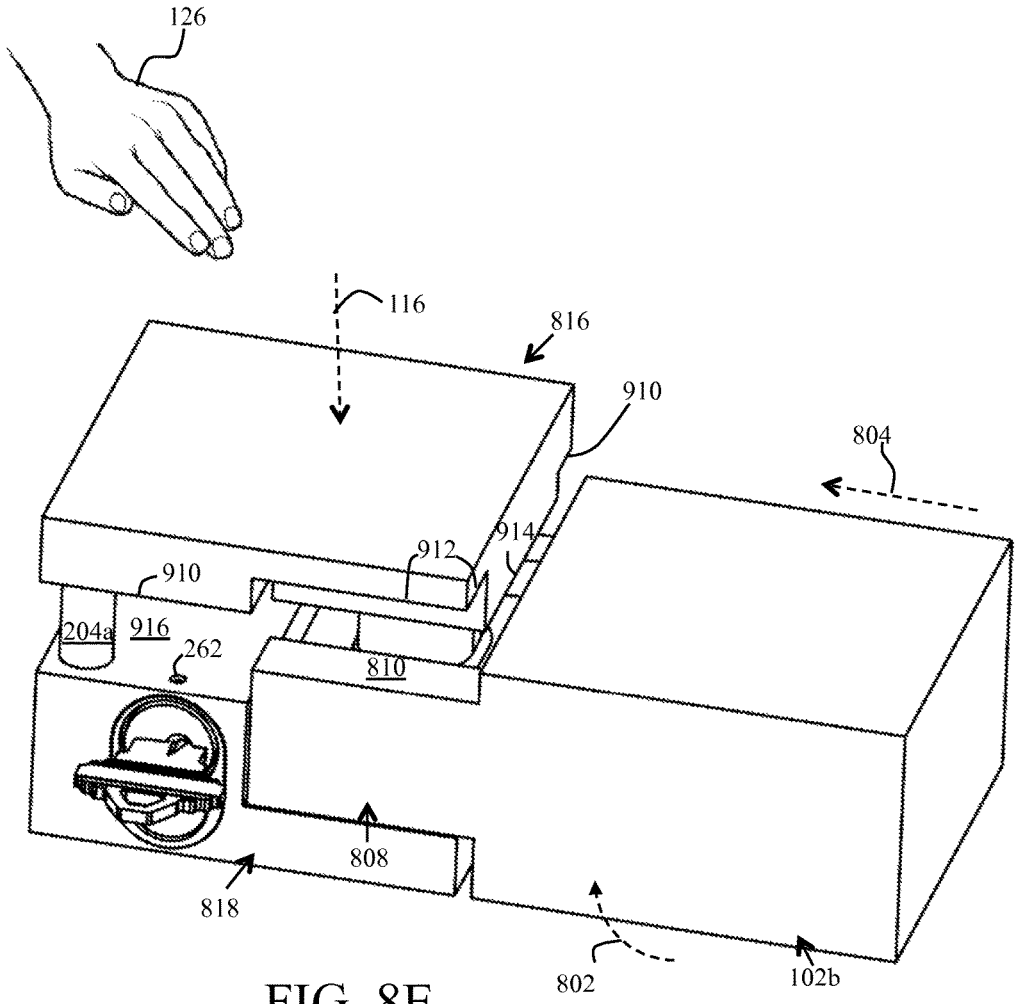

As best illustrated in FIG. 8E, locking securing member 102*b* to locking link 100*d* requires positioning linking-end 806 of securing member 102*b* onto link 818 of locking link 100*d*, and simply pressing down (as shown by arrow 116 in FIG. 8E) with one hand 126 cover 816 to lock securing member 102*b* with locking link 100*d*.

Figure 8F:
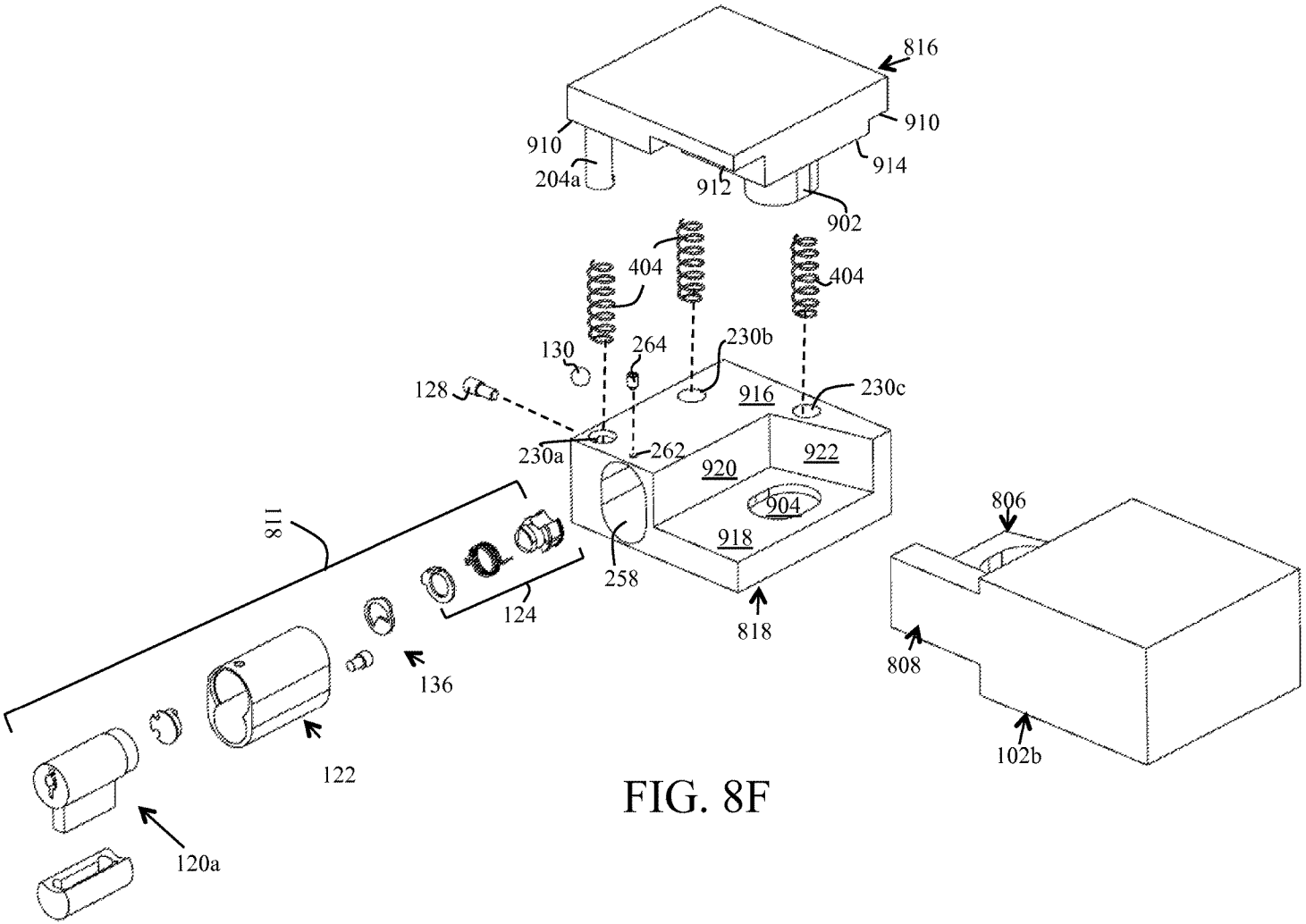

FIG. 8F is a non-limiting, exemplary exploded view of the locking link illustrated in FIGS. 8A-1 to 8E in accordance with one or more embodiments of the present invention, including a lock. As illustrated, one or more embodiments of locking link 100*d* accommodate well known lock 118 associated with link 818 of locking link 100*d*. Locking link 100*d* is comprised of cover 816 and link 818, wherein cover 816 moves in relation to link 818 while continuously interlocked (or engaged) with link 818 in the same method as previously above-described embodiments.

Figures 1, 8G:
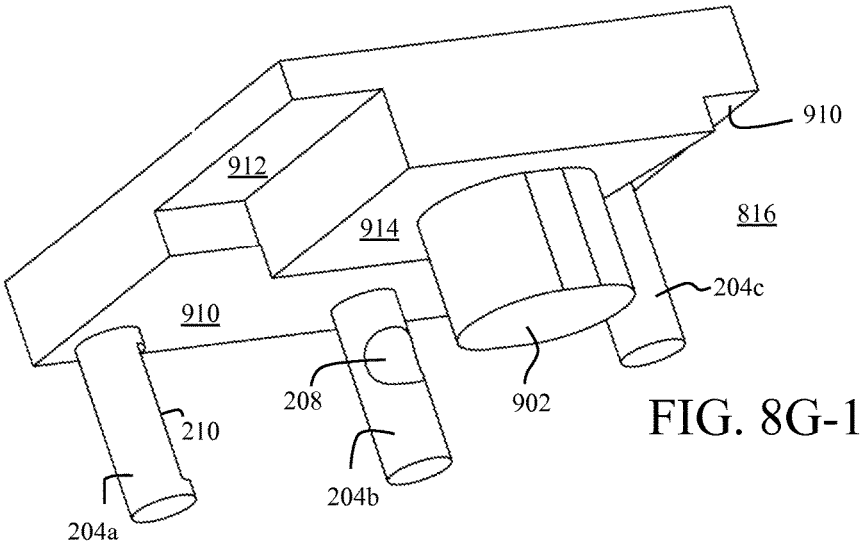
Figures 2, 8G:
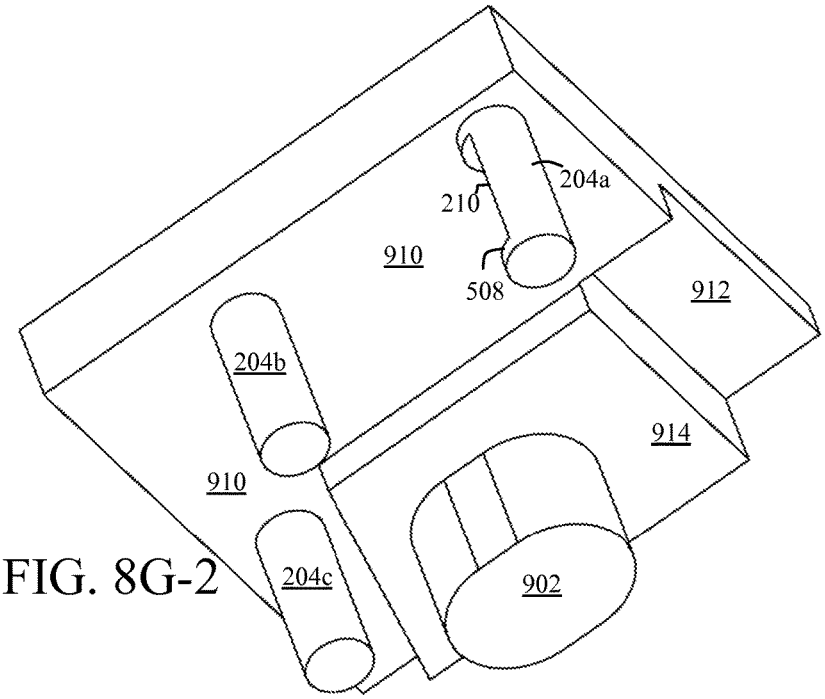
Figures 3, 8G:
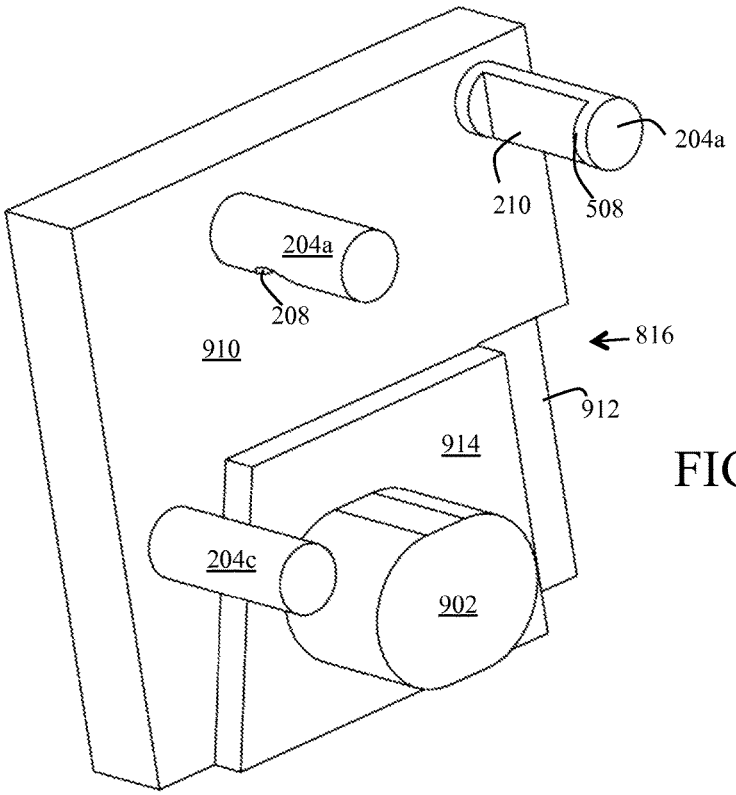
Figures 4, 8G:
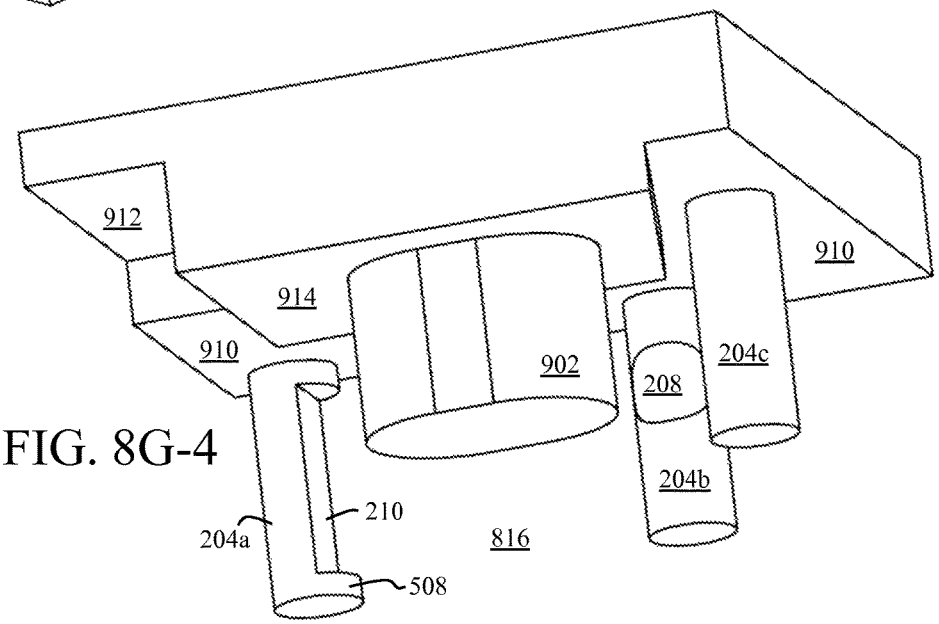
Figures 5, 8G:
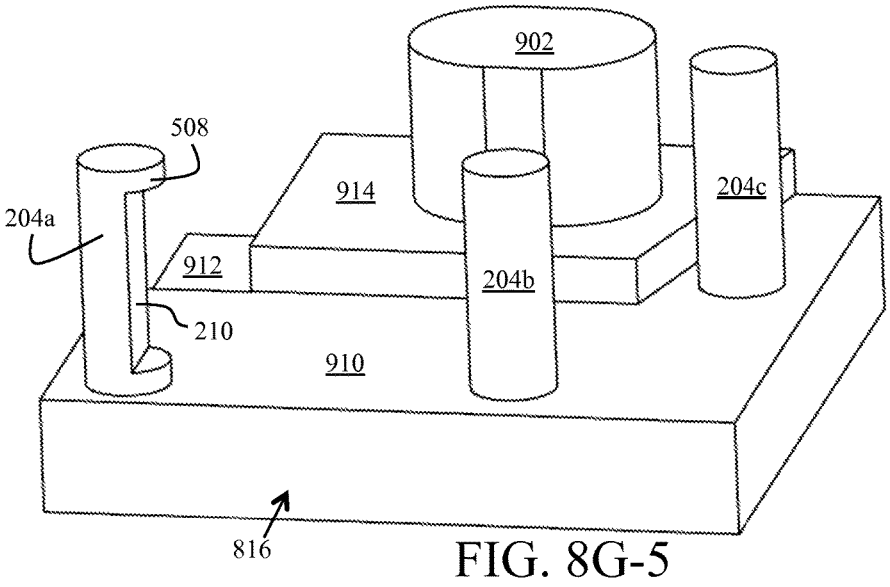
Figures 6, 8G:
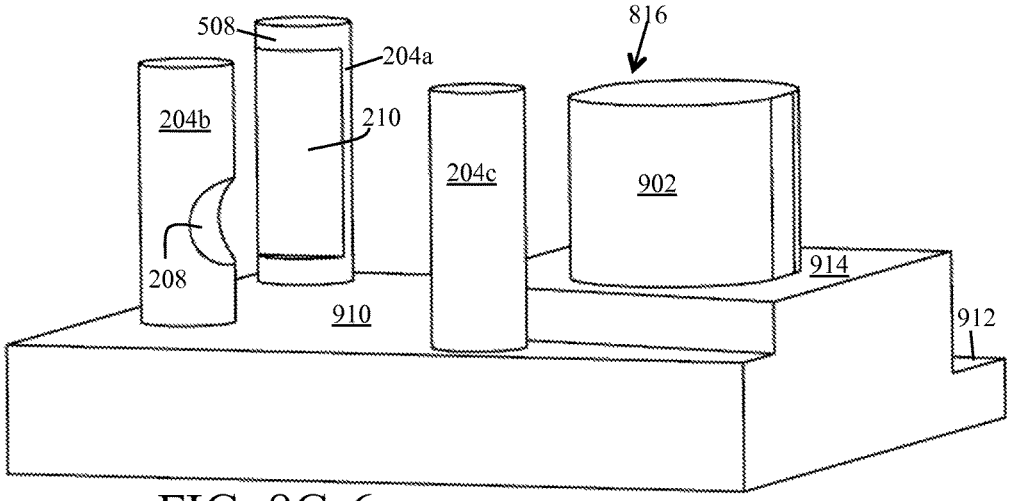
Figures 1, 8H:
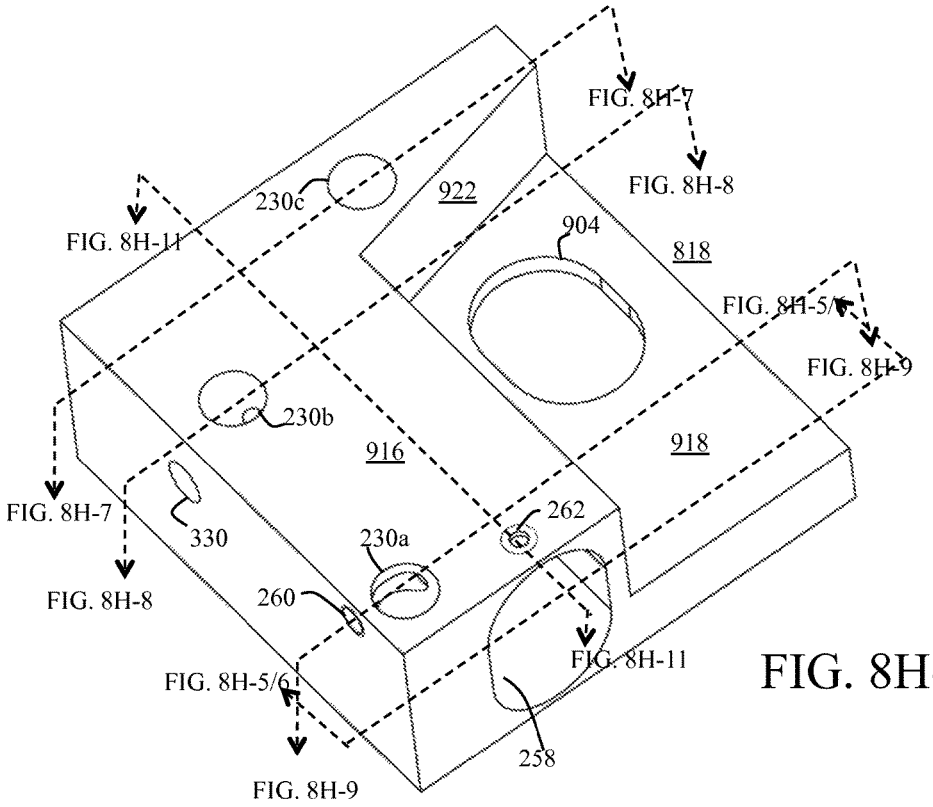
Figures 2, 8H:
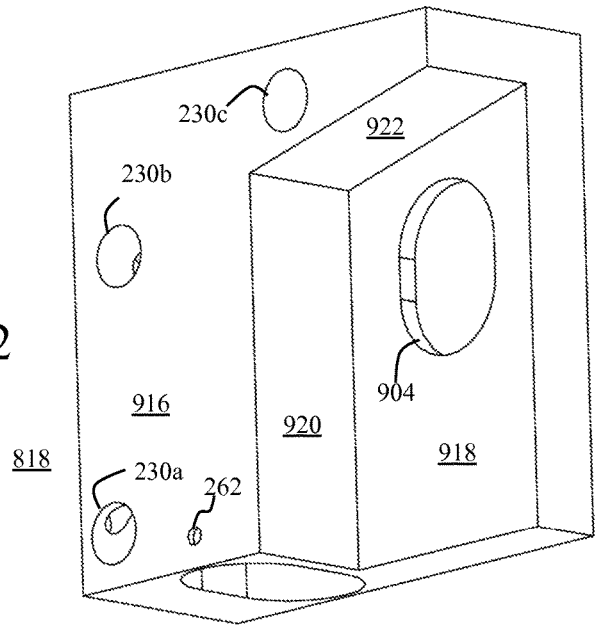
Figures 3, 8H:
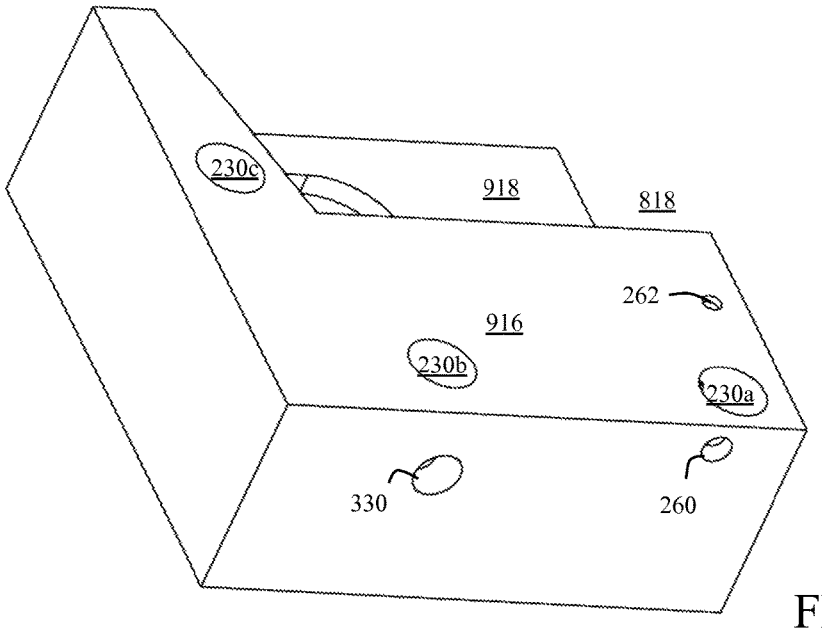
Figures 4, 8H:
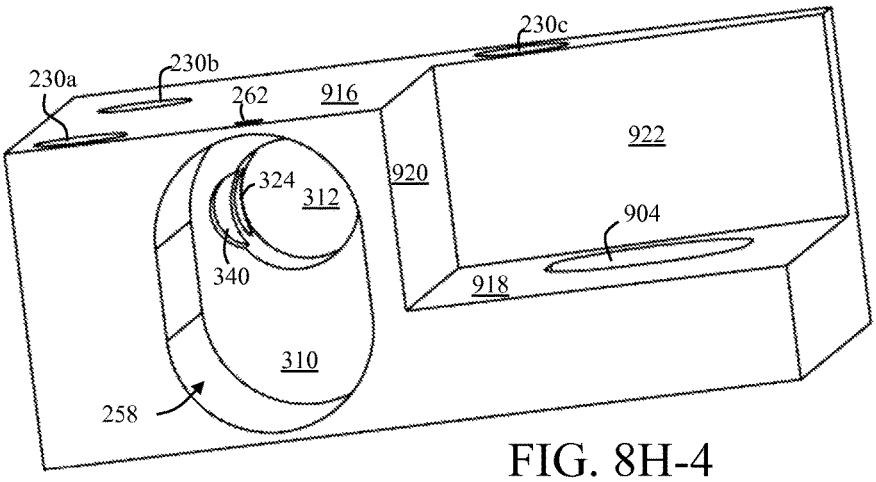
Figures 5, 8H:
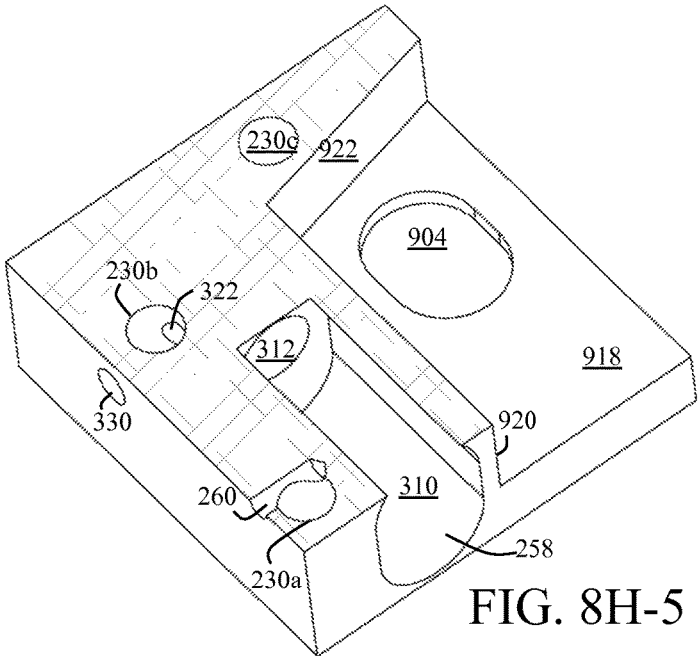
Figures 6, 8H:
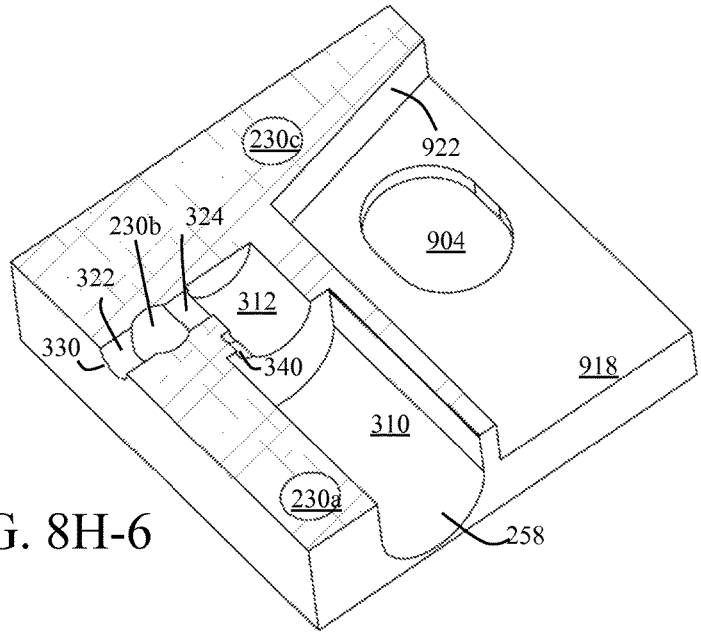
Figures 7, 8H:
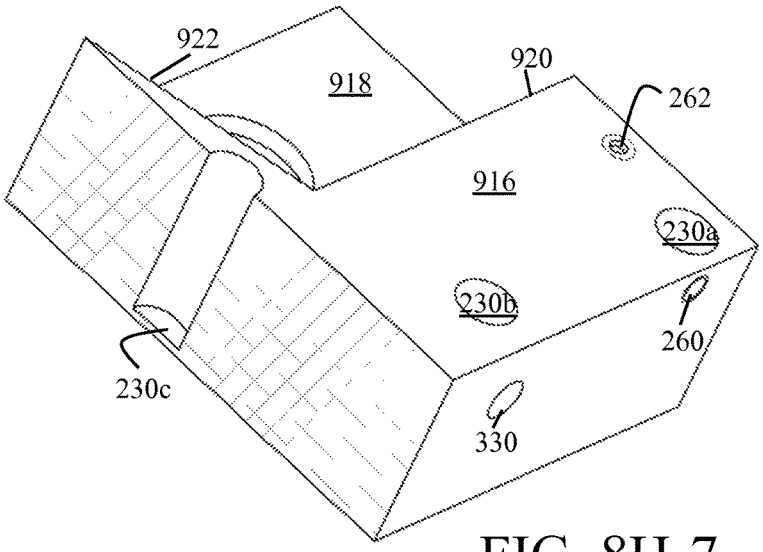
Figures 8, 8H:
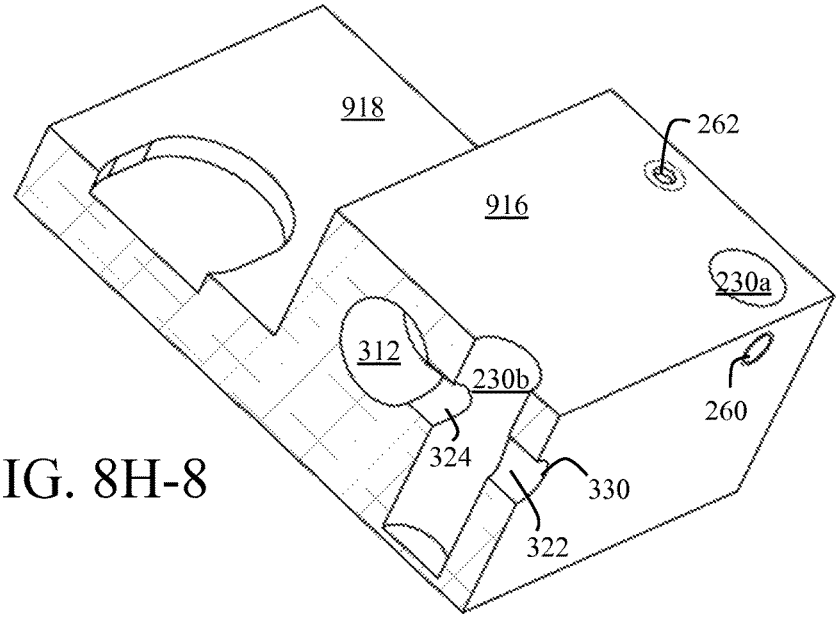
Figures 8, 8H, 9:
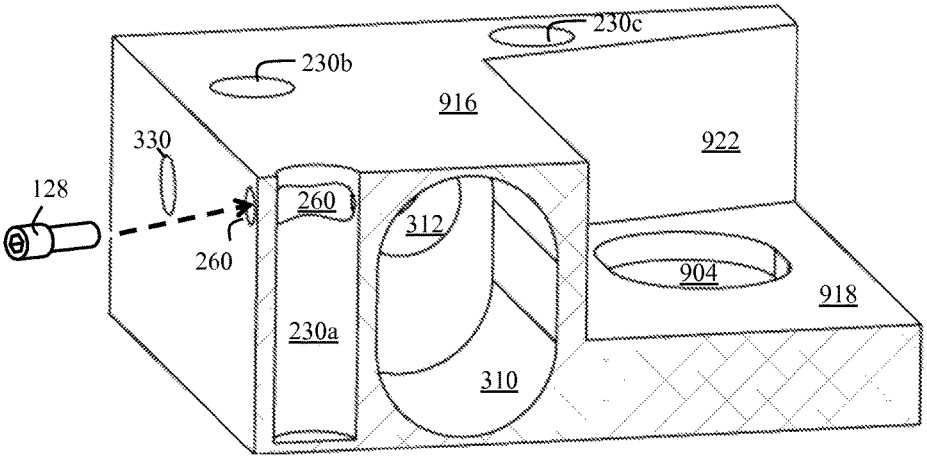
Figures 8, 8H, 9, 10:
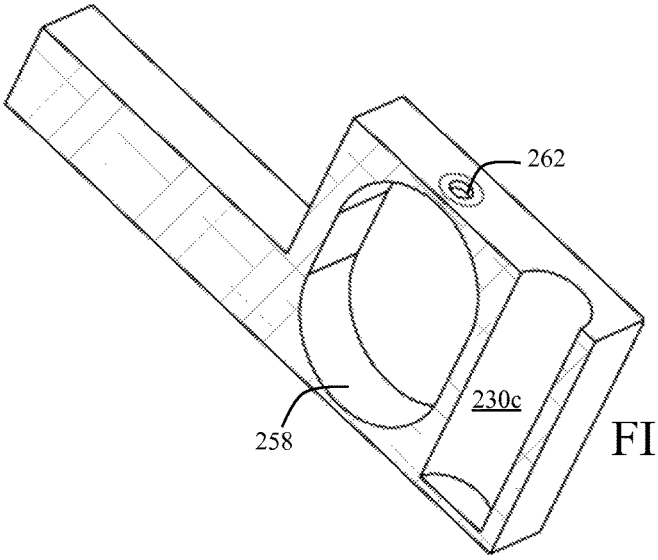
Figures 8, 8H, 9, 10, 11:
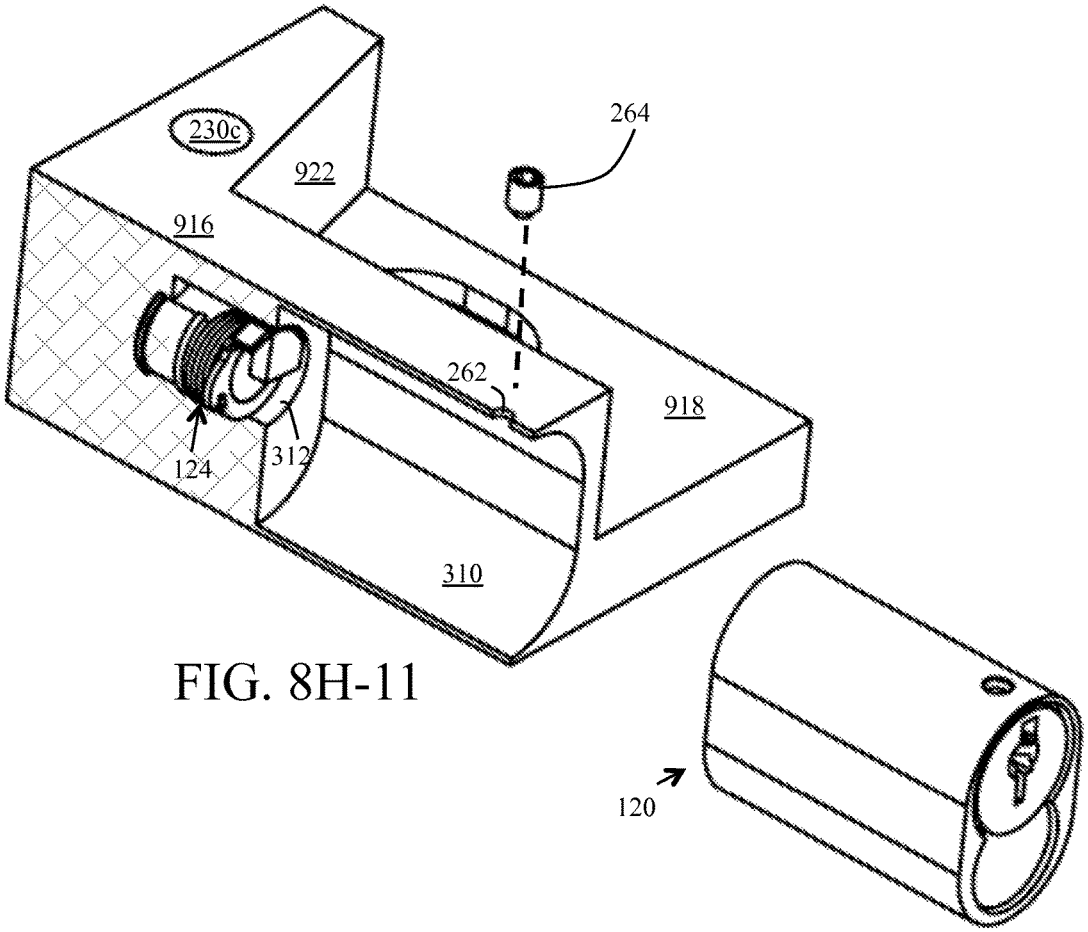
Figures 8, 8H, 9, 10, 11, 12:
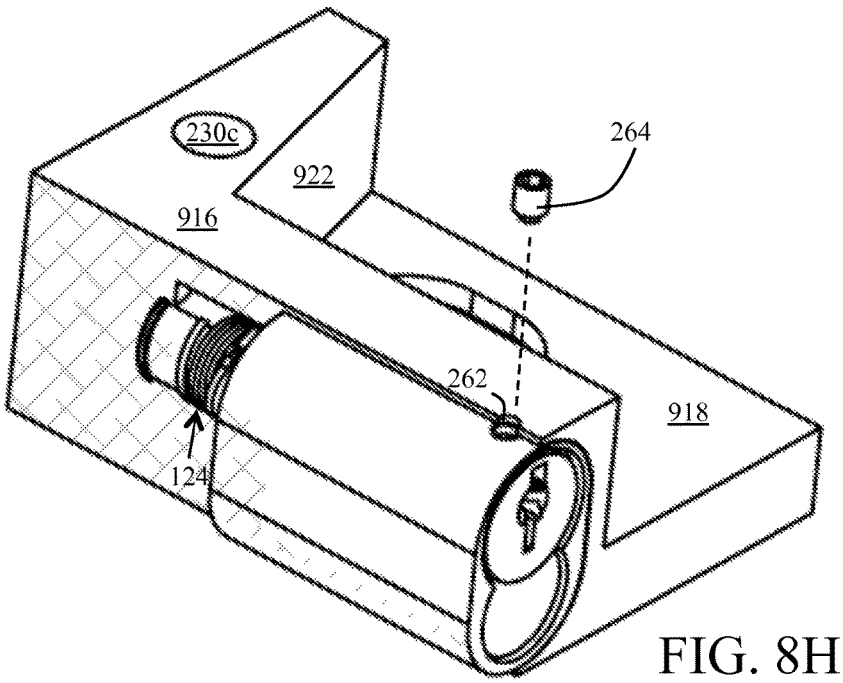
Figures 8, 8H, 9, 10, 11, 12, 13:
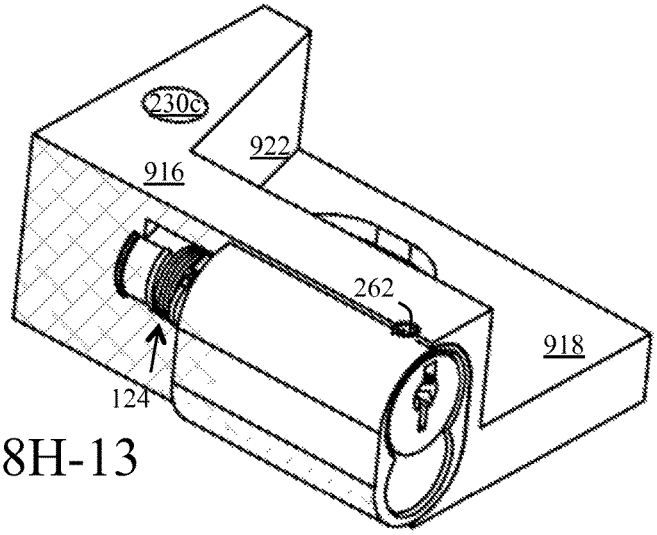

FIGS. 8G-1 to 8G-6 are non-limiting, exemplary illustrations of various perspective views a cover of the locking link illustrated in FIGS. 8A-1 to 8F in accordance with one or more embodiments of the present invention. As illustrated, cover 816 includes supports 204 and a post 902 that interlocks with linking-end 816 of securing member 102*b* in addition to a reinforcement structure 904 of link 818. A bottom side 820 of cover 816 is comprised of planer surfaces 910, 912, and 914 that are offset in relation to one another to form anti-torque steps in cooperation with complementary offset surfaces 920 and 922 of link 108*b* and guard 808 of securing member 102*b*, which counter potential torque attacks on locking link 100*d*.

As further indicated above, link 818 further includes a reinforcement structure 904 that is comprised of an opening that provides reinforcement for post 902 of cover 816, with a free end of post 902 received within opening 904 and interlocked when cover 816 is locked with link 818.

FIGS. 8H-1 to 8H-13 are non-limiting, exemplary illustrations of various perspective views and sectional views of link of the locking link illustrated in FIGS. 8A-1 to 8G-6 in accordance with one or more embodiments of the present invention. As illustrated, in this non-limiting, exemplary embodiment, link 818 has a top side 924 that is comprised of offset, planer surfaces 916 and 918 that form raised edges 920 and 922, with the lower offset surface 918 and the resulting raised edges 920 and 922 forming a relief or recessed area 820 that receives linking end 806 of securing member 102*b*. Surface 910 of cover 816 mates with surface 916 of link 818, with surface 914 of cover 816 mating with surface 814 of linking end 806. Surface 912 of cover 816 mates with surface 810 of guard 808 of securing member 102*b*.

Figures 1, 8I:
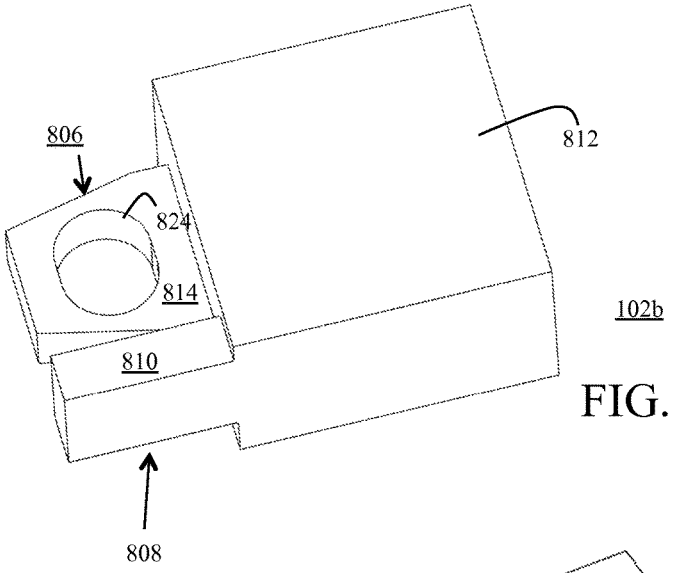
Figures 2, 8I:
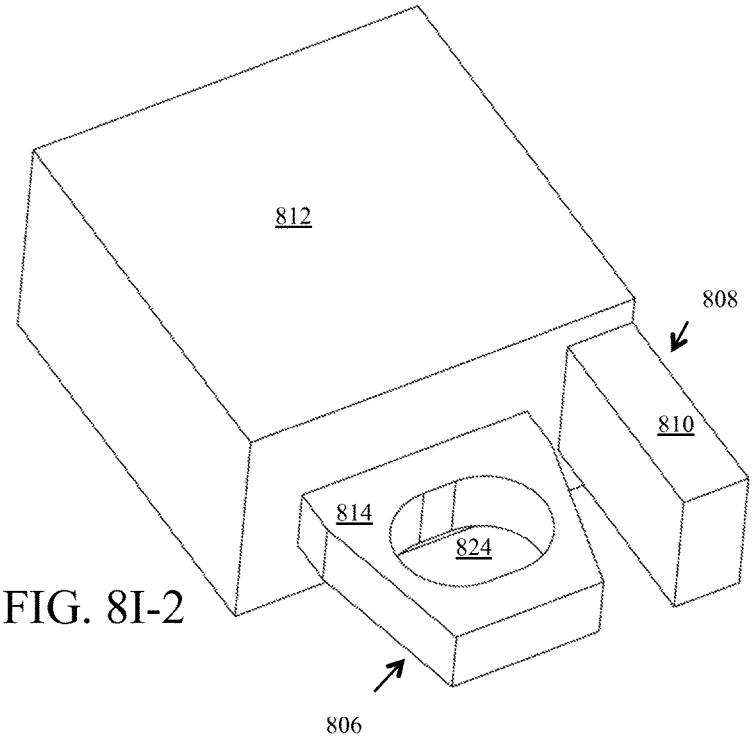
Figures 3, 8I:
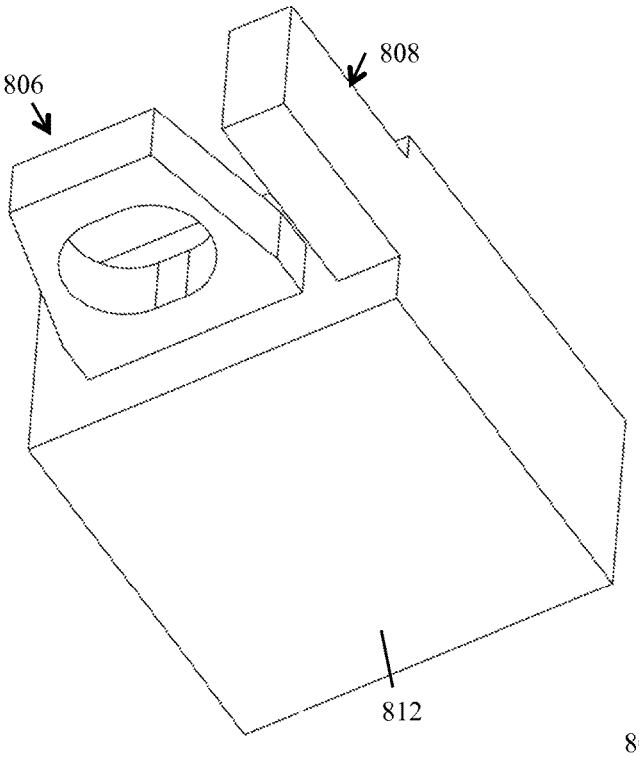
Figures 4, 8I:
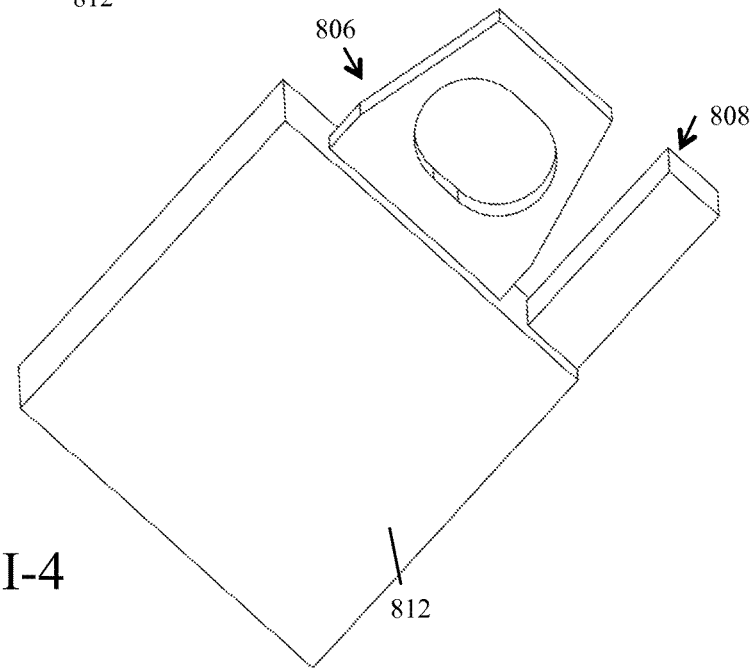

FIGS. 8I-1 to 8I-4 are non-limiting, exemplary illustrations of various perspective views of linking member of the locking link illustrated in FIGS. 8A-1 to 8H-13 in accordance with one or more embodiments of the present invention. As illustrated, securing member 102*b* is comprised of a mounting portion 812 that is coupled with a first door of gate 104 with linking end 806 linked with linking lock 100*d*. Securing member 102*b* further includes guard 808 that prevents tampering with locking link 100*d* by blocking access thereto by a prying tool. To fully lock cover 816, link 818, and securing member 102*b* together, opening 824 of securing member 102*b* and opening 904 of link 818 must be aligned to allow passage of post 902 through both.

Figures 1, 2A:
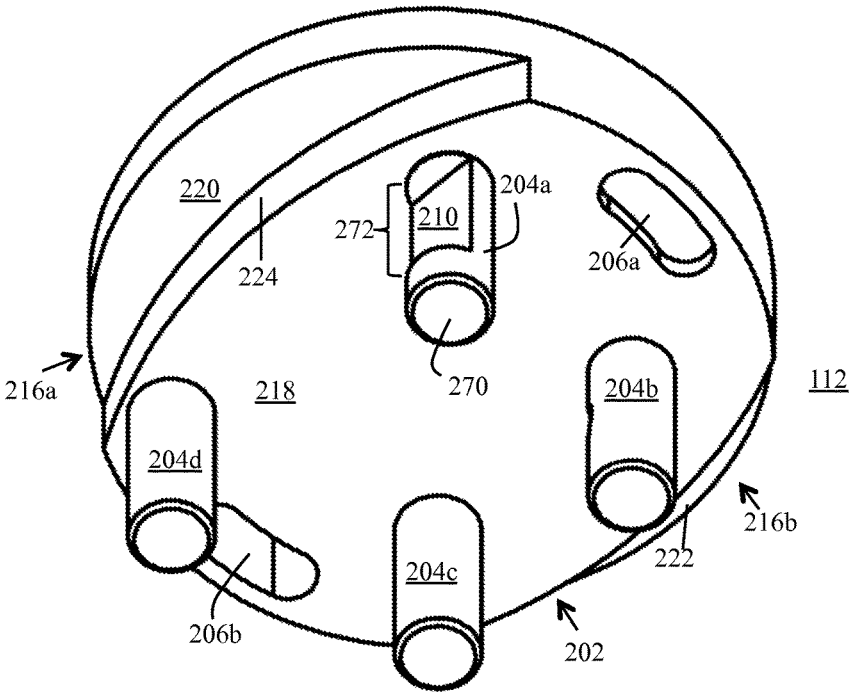
Figures 2, 2A:
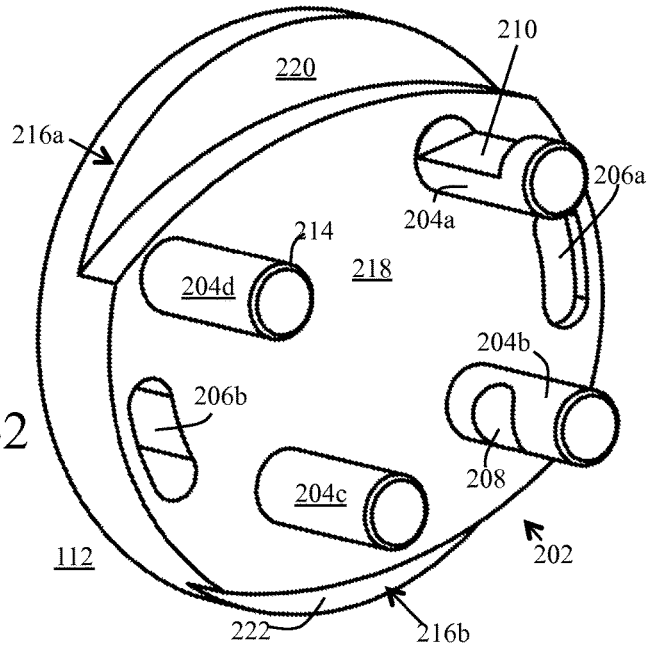
Figures 2, 2A, 3:
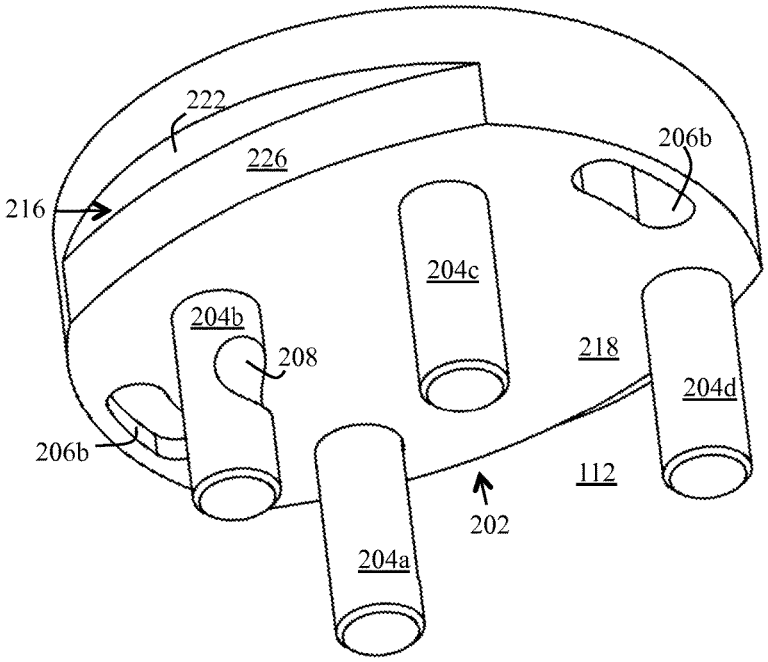
Figures 2, 2A, 3, 4:
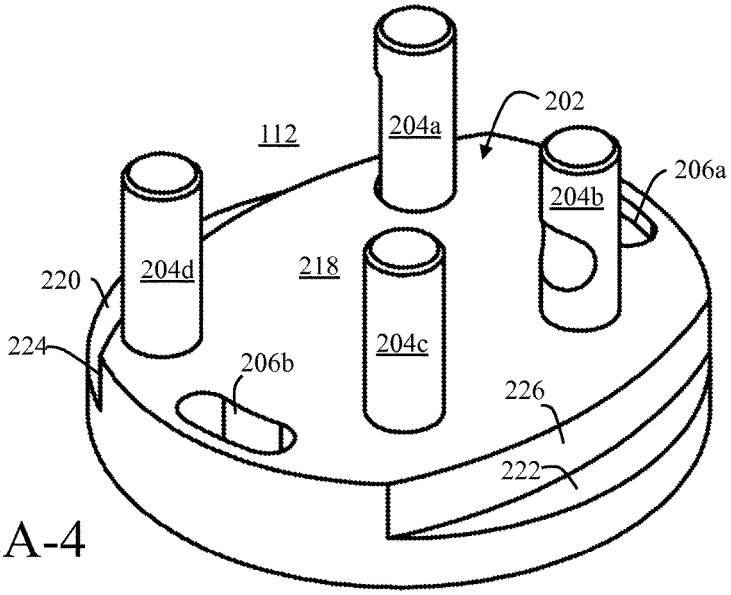
Figures 1, 2B:
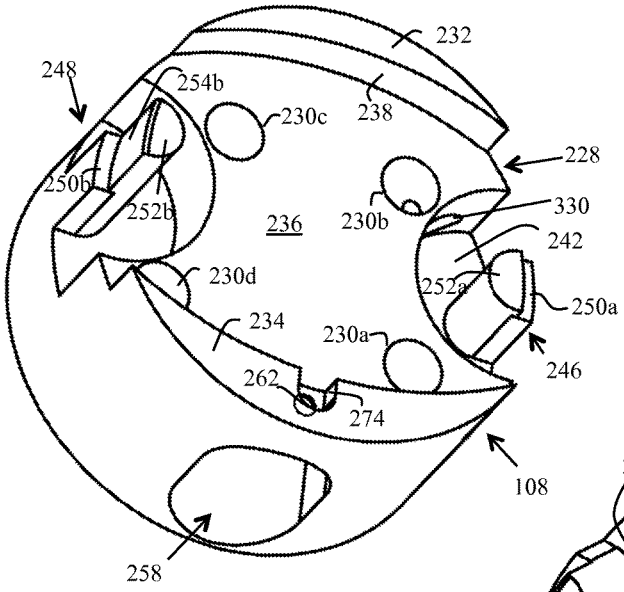
Figures 2, 2B:
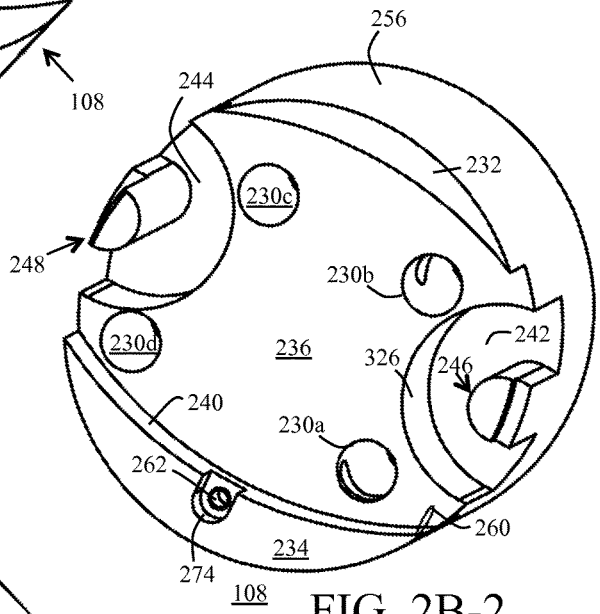
Figures 2, 2B, 3:
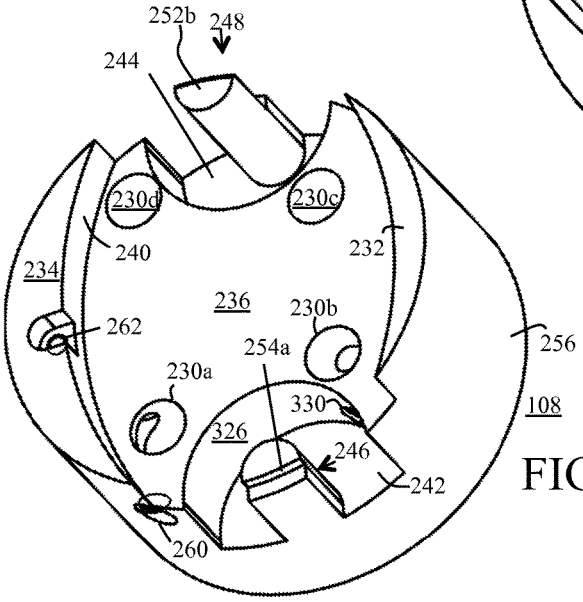
Figures 2, 2B, 3, 4:
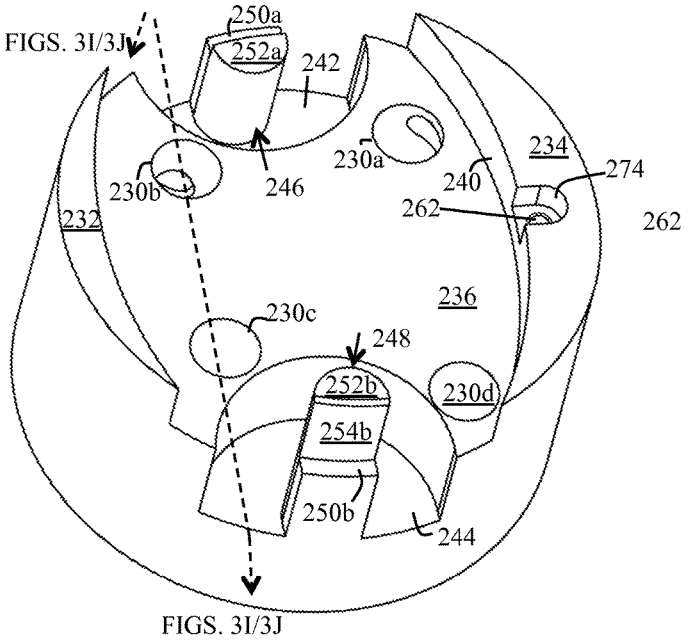
Figures 2, 2B, 3, 4, 5:
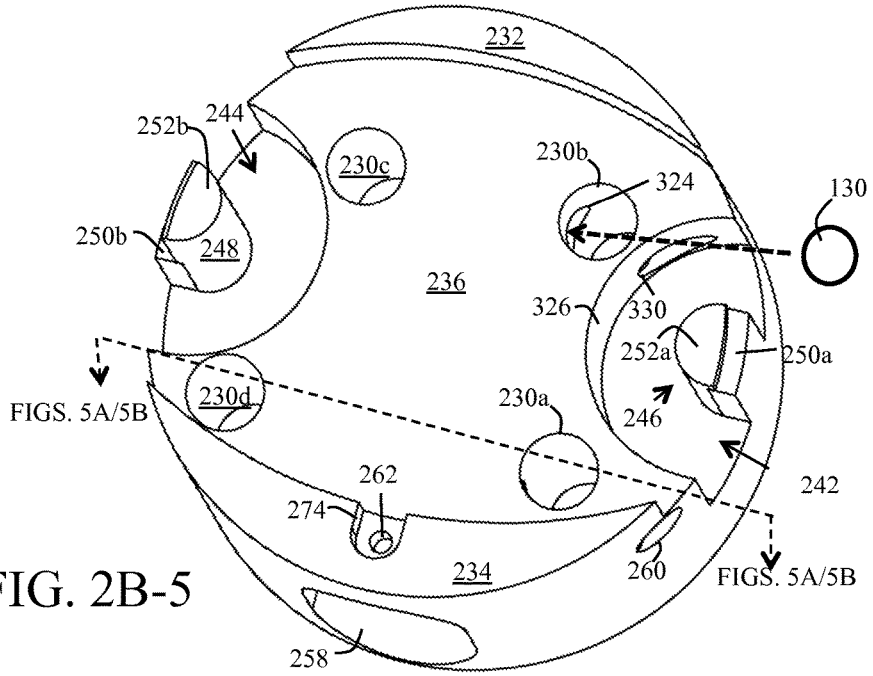
Figures 2, 2B, 3, 4, 5, 6:
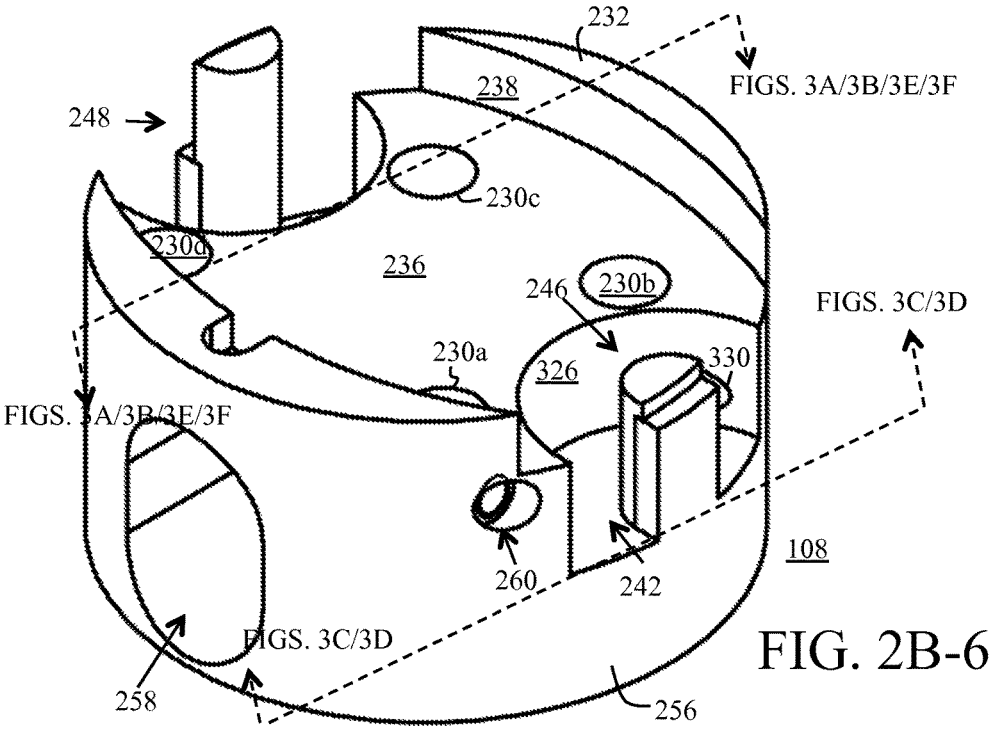
Figures 2, 2B, 3, 4, 5, 6, 7:
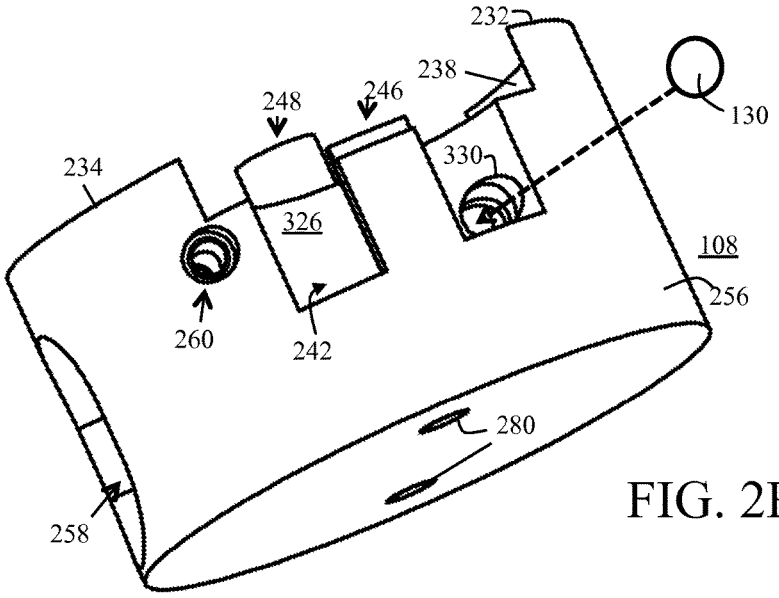
Figures 2, 2B, 3, 4, 5, 6, 7, 8:
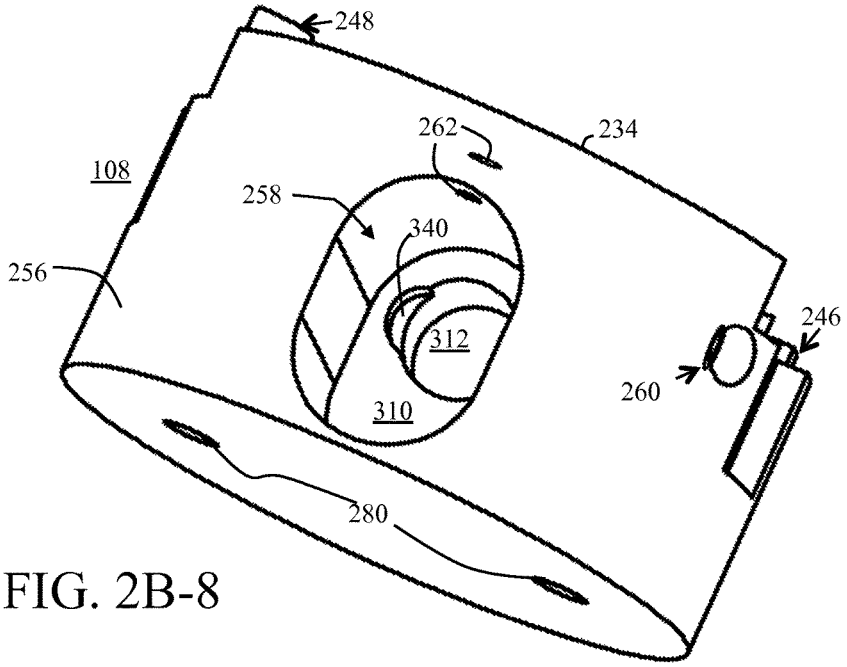
Figures 1, 2C:
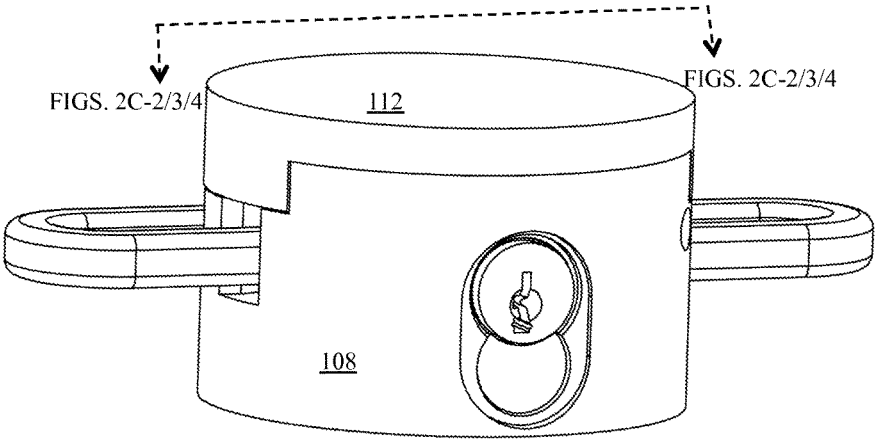
Figures 2, 2C:
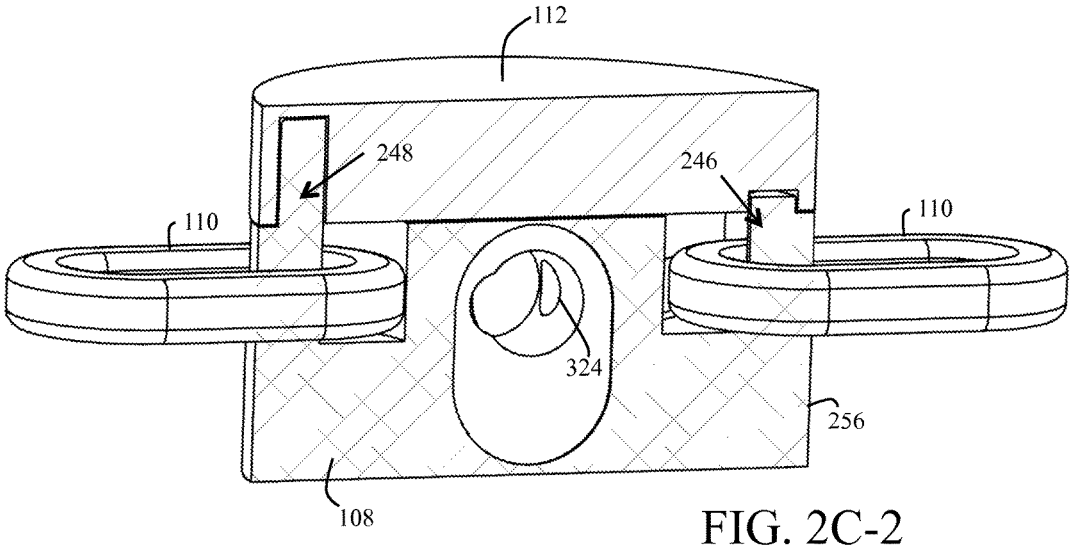
Figures 2, 2C, 3:
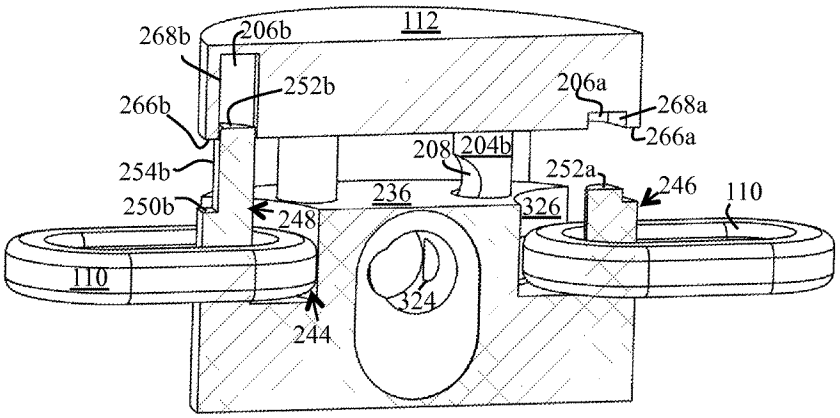
Figures 2, 2C, 3, 4:
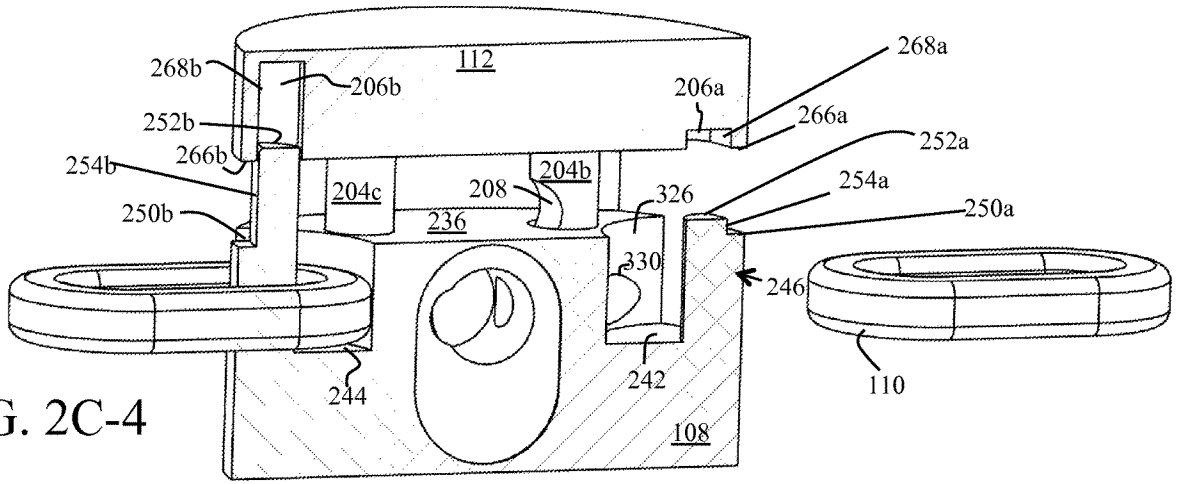
Figure 3A:
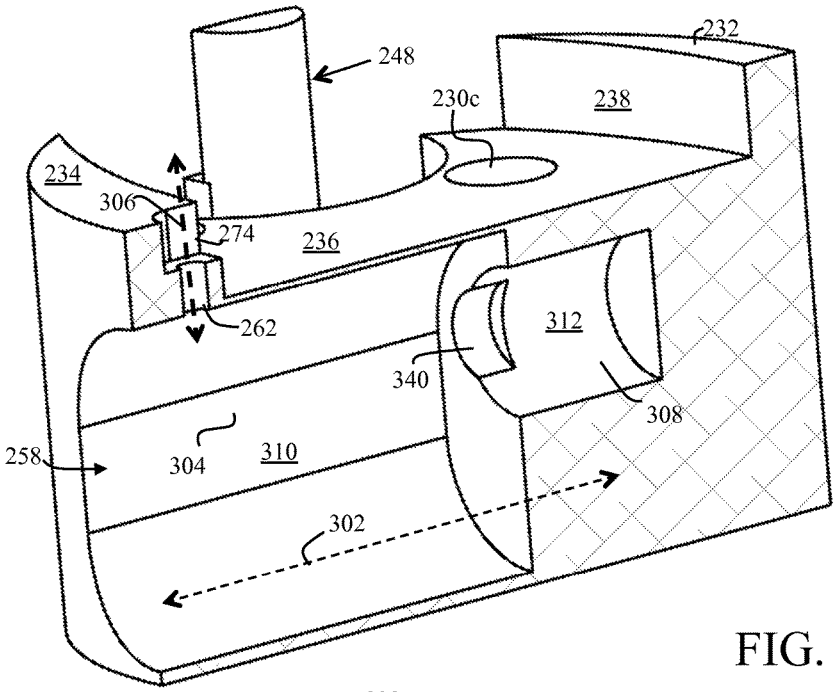
FIGS. 3A to 3J are non-limiting, exemplary sectional views of the link illustrated in FIGS. 1A to 2C-4 in accordance with one or more embodiments of the present invention.
Figure 3B:
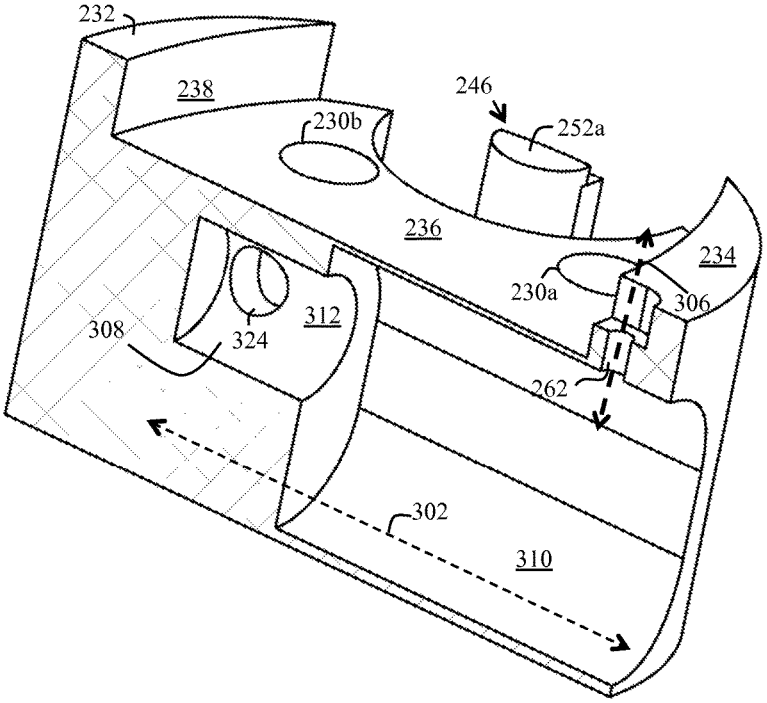
Figure 3C:
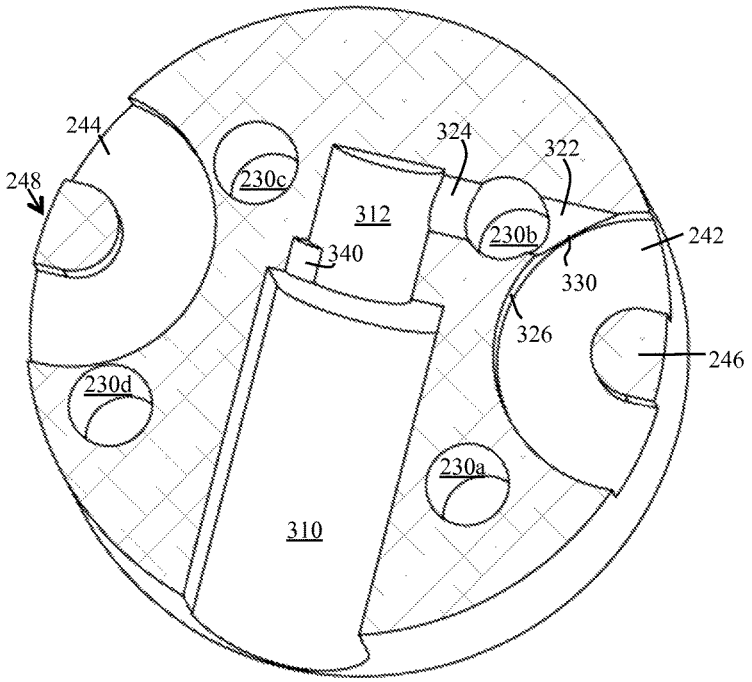
Figure 3D:
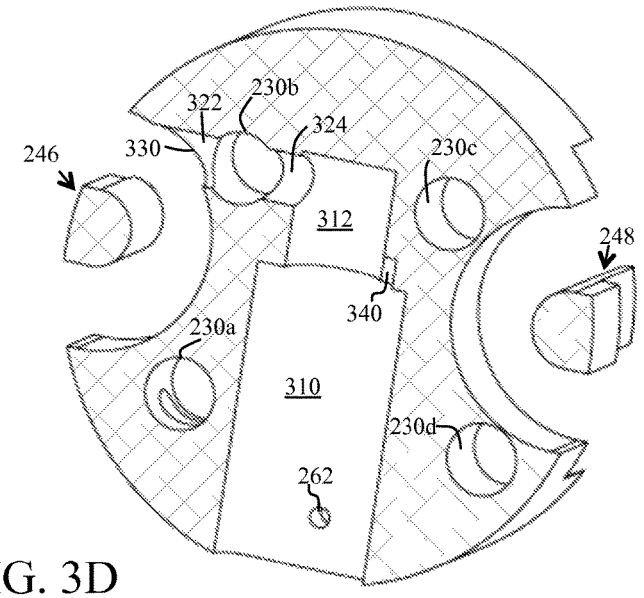
Figure 3E:
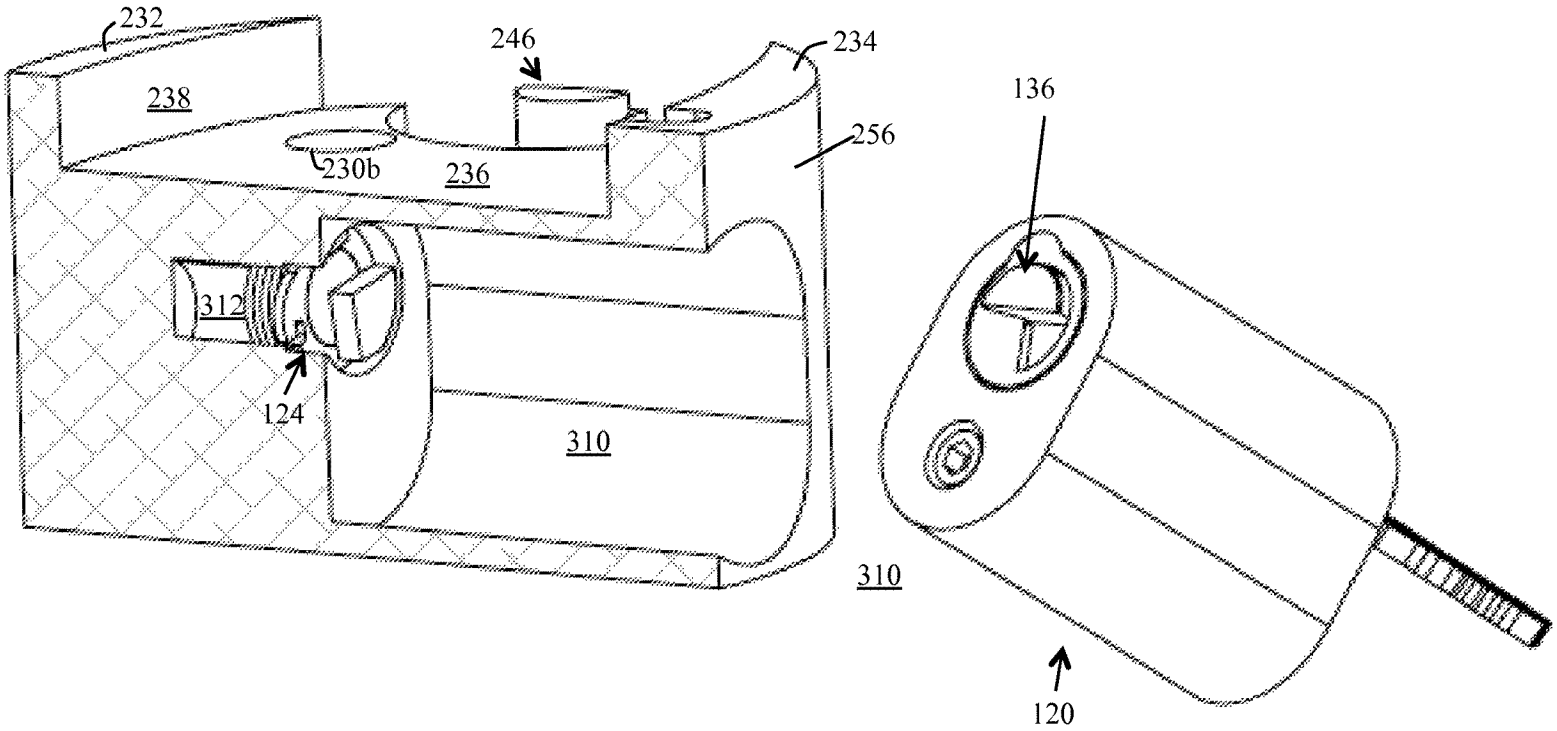
Figure 3F:
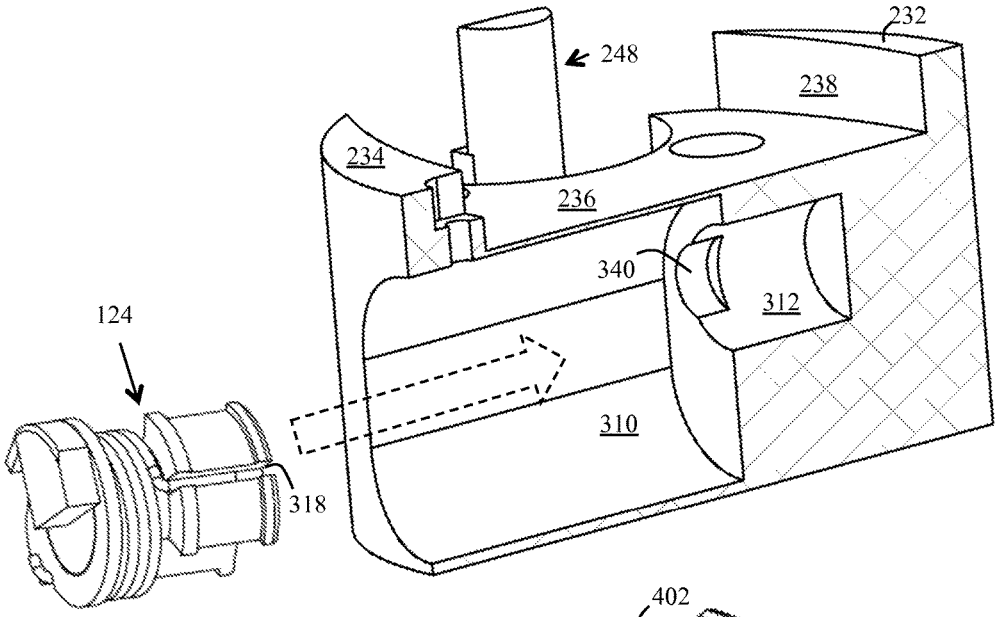
Figure 3G:
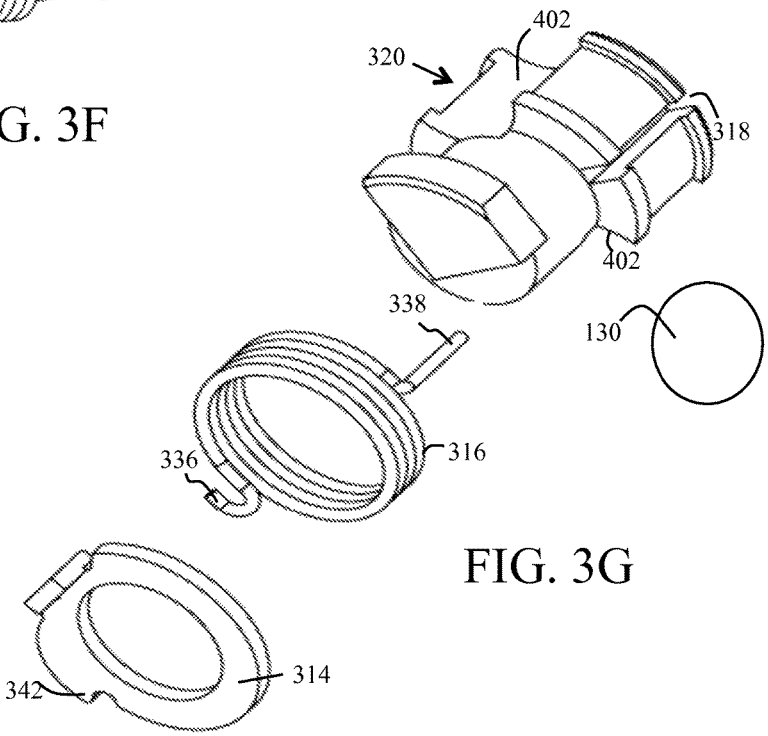
Figure 3H:
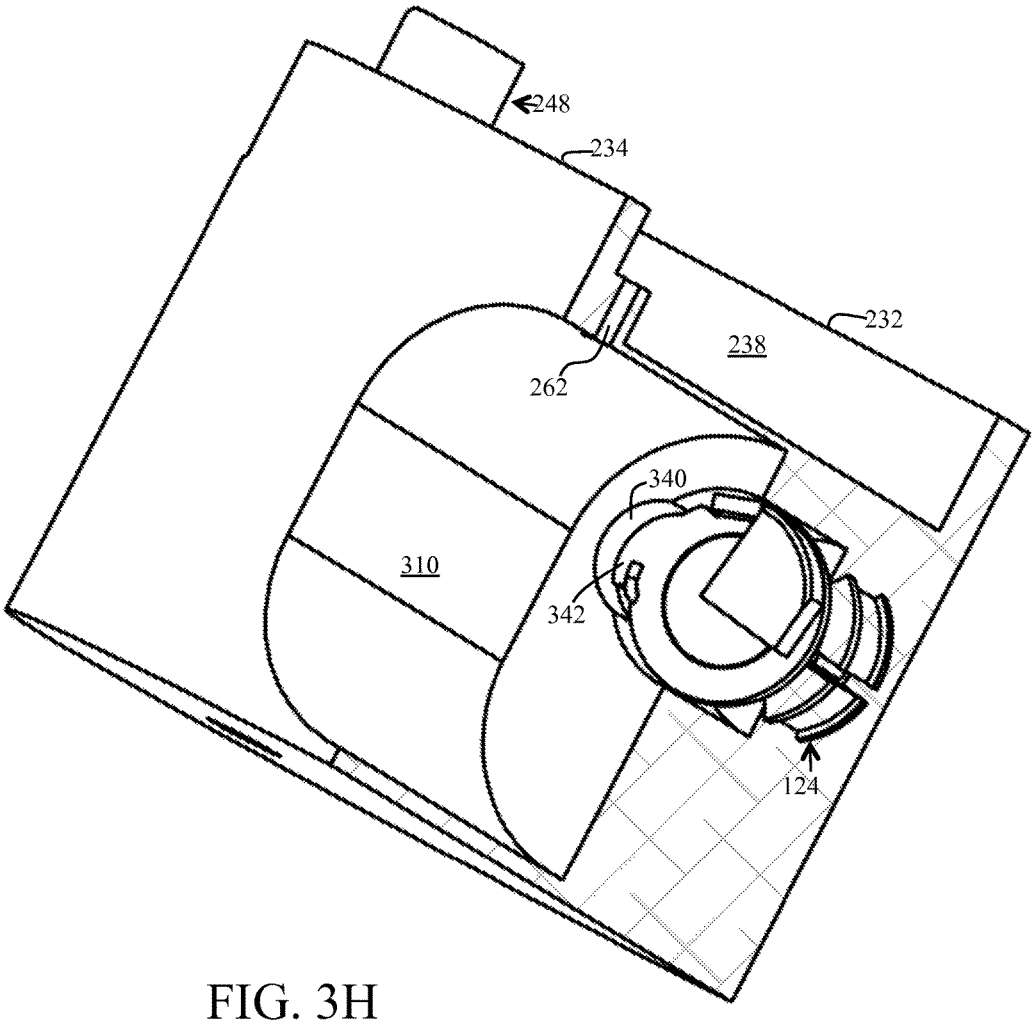
Figure 3I:
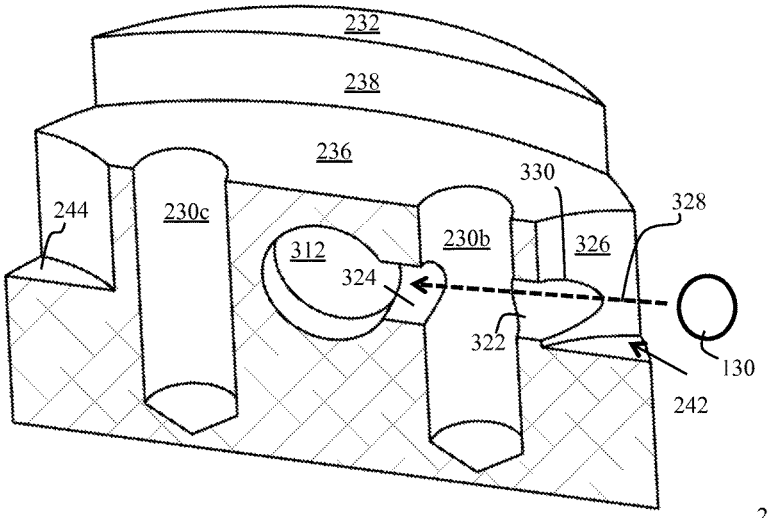
Figure 3J:
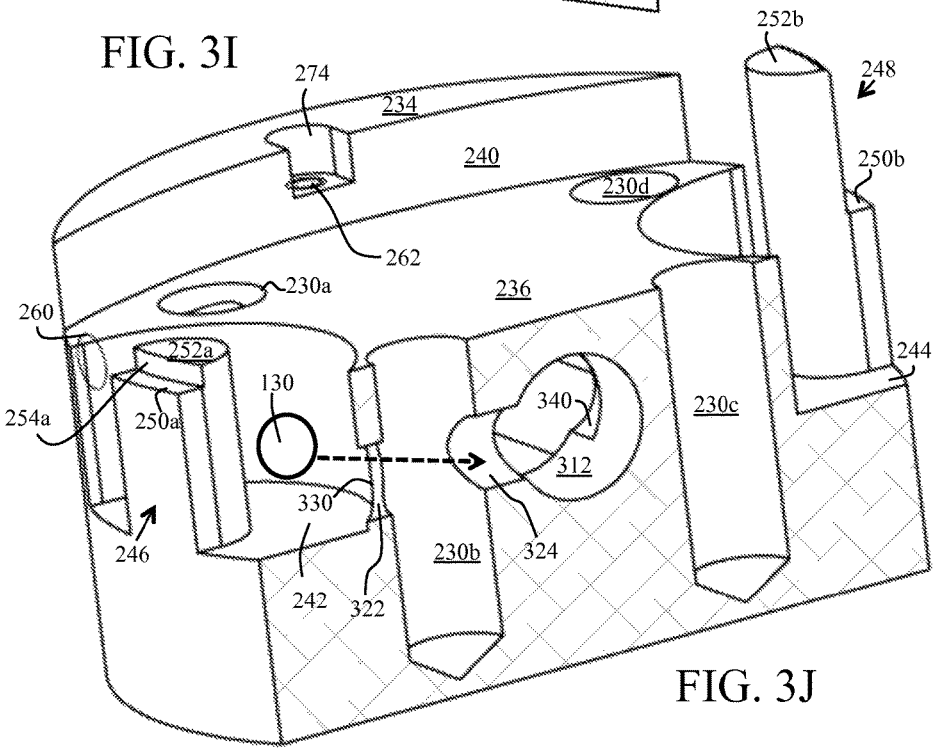
Figures 1, 8J:
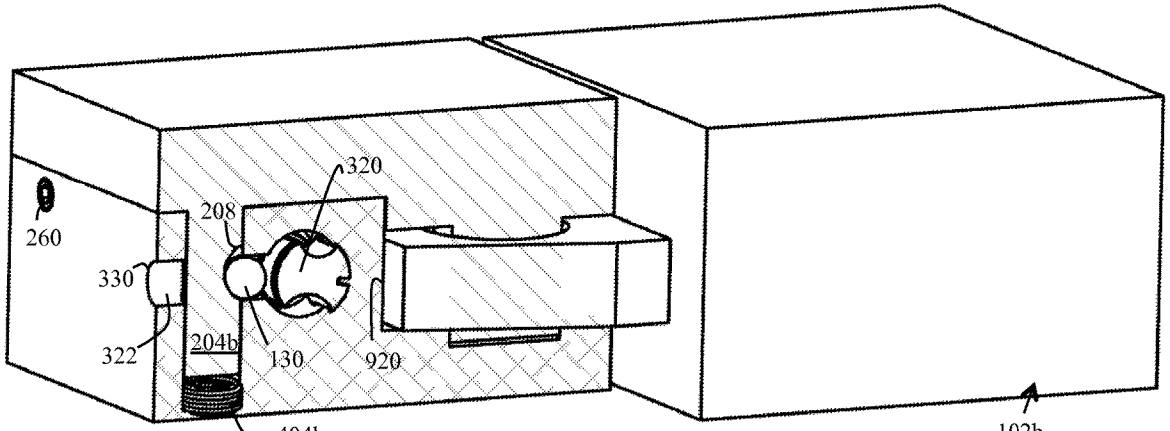
Figures 2, 8J:
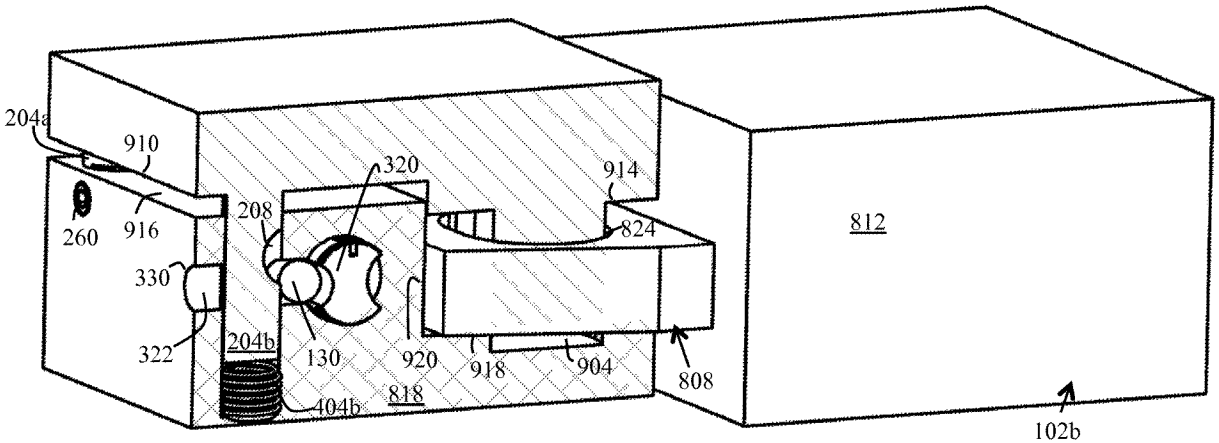
Figures 3, 8J:
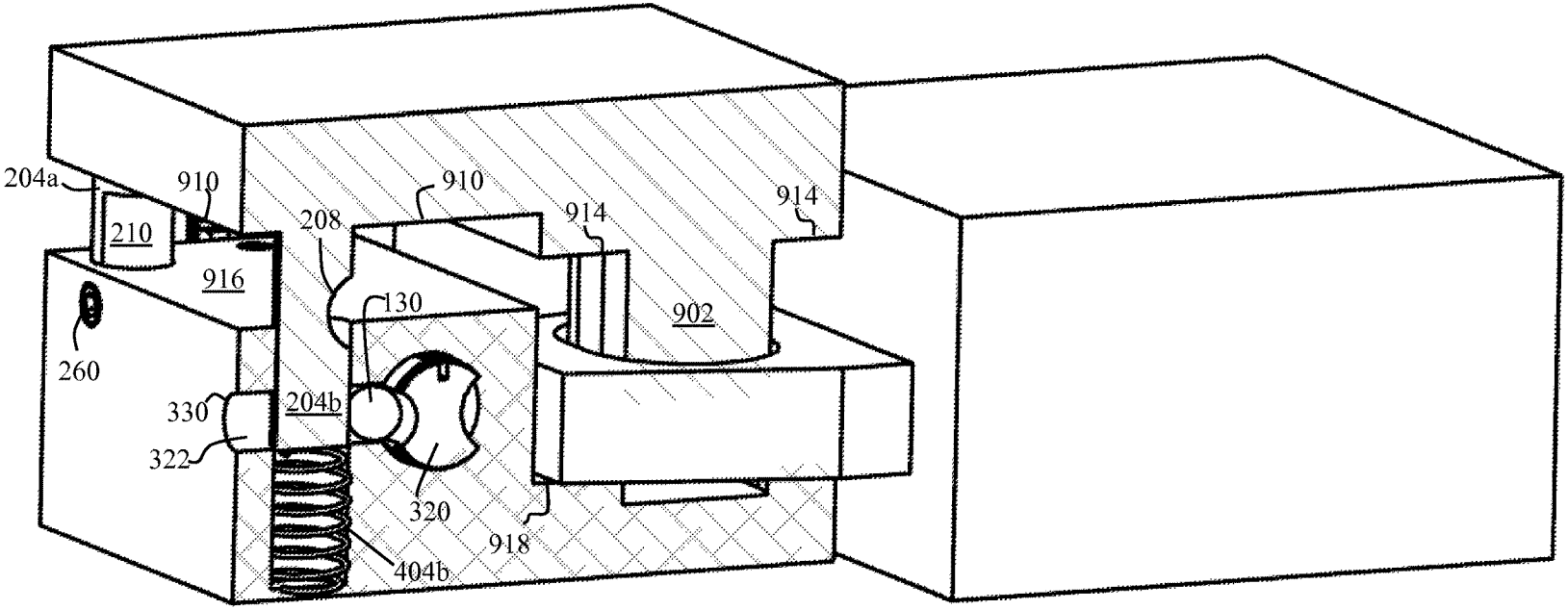
Figures 4, 8J:
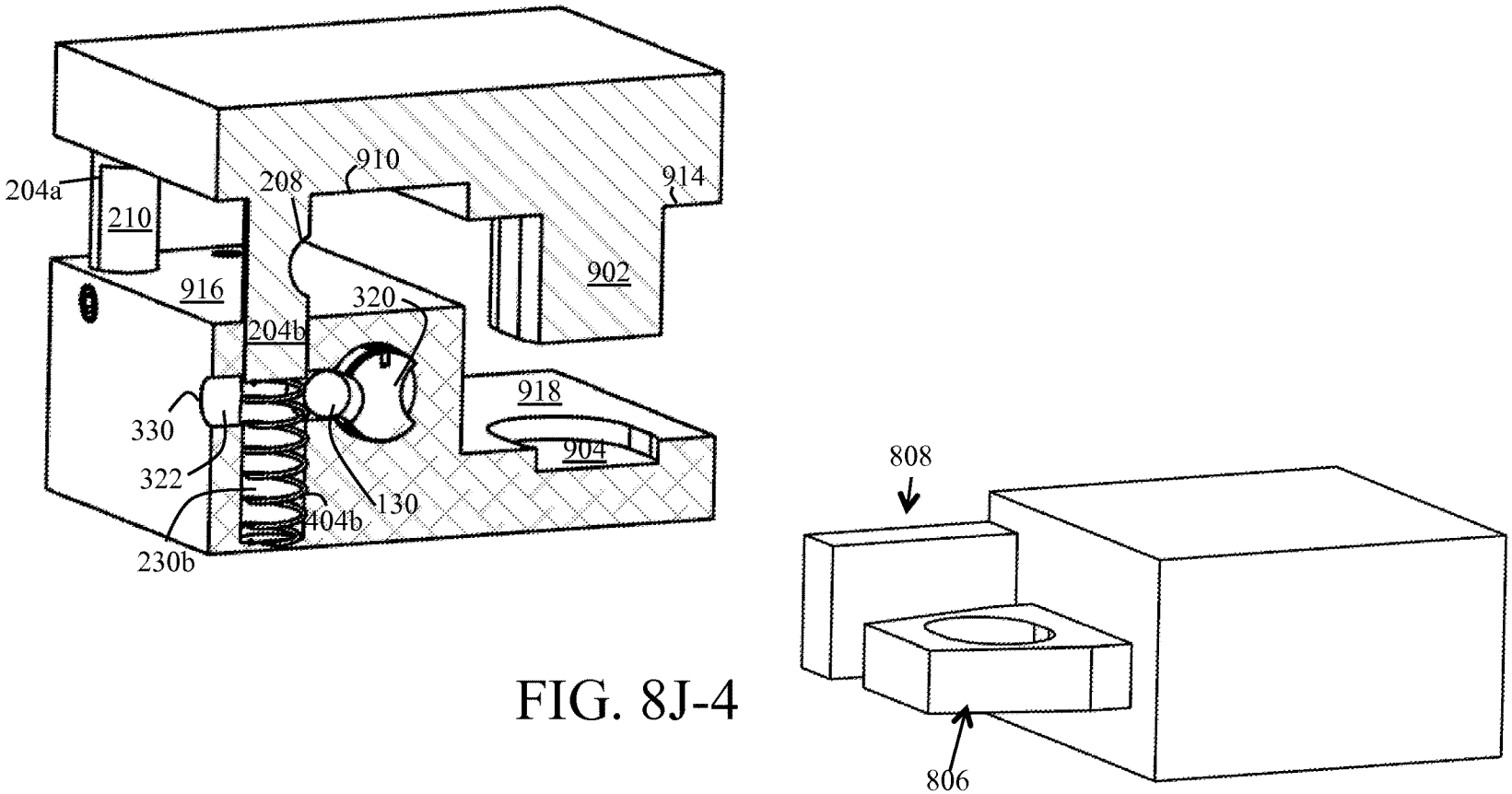
Figures 5, 8J:
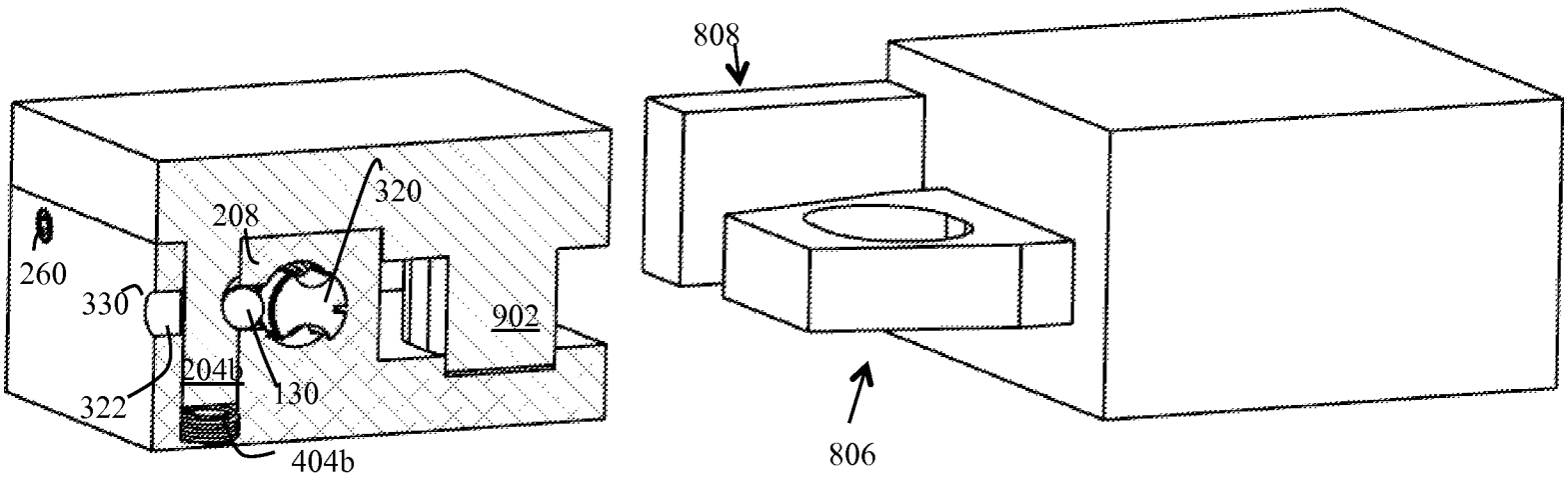
Figures 6, 8J:
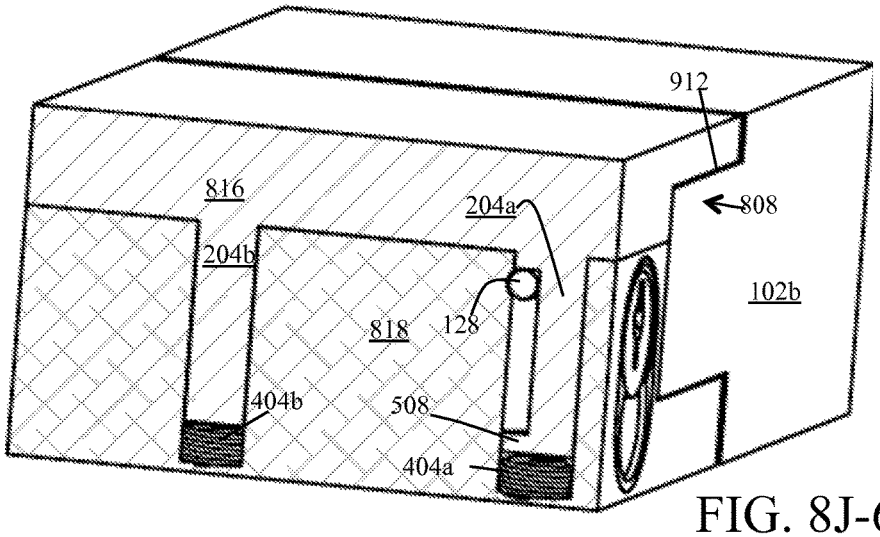
Figures 7, 8J:
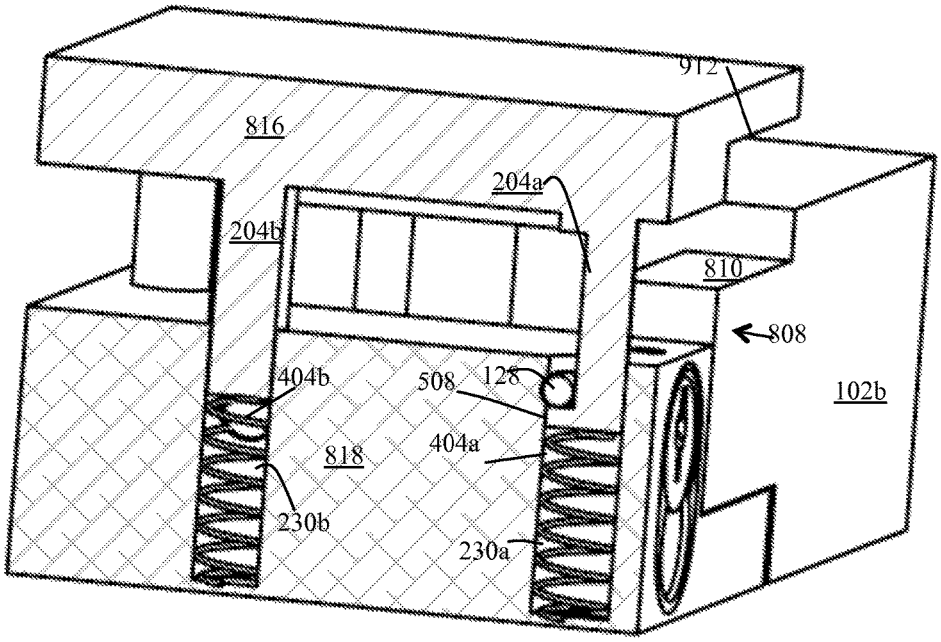

FIGS. 8J-1 to 8J-5 are non-limiting, exemplary sectional illustrations, detailing cover—securing member—link assembly in view of actuator assembly and supports, and progressively illustrating unlocking of cover from link and securing member, the operations of which is identical in relation to previously above-described embodiments. FIGS. 8J-6 and 8J-7 are non-limiting, exemplary sectional illustrations, detailing cover—link assembly in view of engagement opening and engagement member, and progressively illustrating continuous interlocking or engagement of cover with link from locked to unlocked position, the operations of which is identical to those described above.

FIGS. 9A to 9G-3 are non-limiting, exemplary illustrations of a locking link that uses a single support and a lock that has a shackle in accordance with another embodiment of the present invention. Locking link 100*e* illustrated in FIGS. 9A to 9G-3 includes similar corresponding or equivalent components, interconnections, functional, operational, and or cooperative relationships as locking links 100*a*, 100*b*, 100*c*, 100*d* that are shown in FIGS. 1A to 8J-7, and described above. Therefore, for the sake of brevity, clarity, convenience, and to avoid duplication, the general description of FIGS. 9A to 9G-3 will not repeat every corresponding or equivalent component, interconnections, functional, operational, and or cooperative relationships that has already been described above in relation to locking links 100*a*, 100*b*, 100*c*, 100*d* that are shown in FIGS. 1A to 8J-7.

As illustrated in FIGS. 9A to 9G-3 and further detailed below, locking link 100*e* is comprised of cover 830 that has a single support 832 that includes an engagement portion 210 that moveably maintains engagement of cover 830 interlocked with link 834 and a lock portion 924 that locks cover 830 with link 834.

Figure 9A:
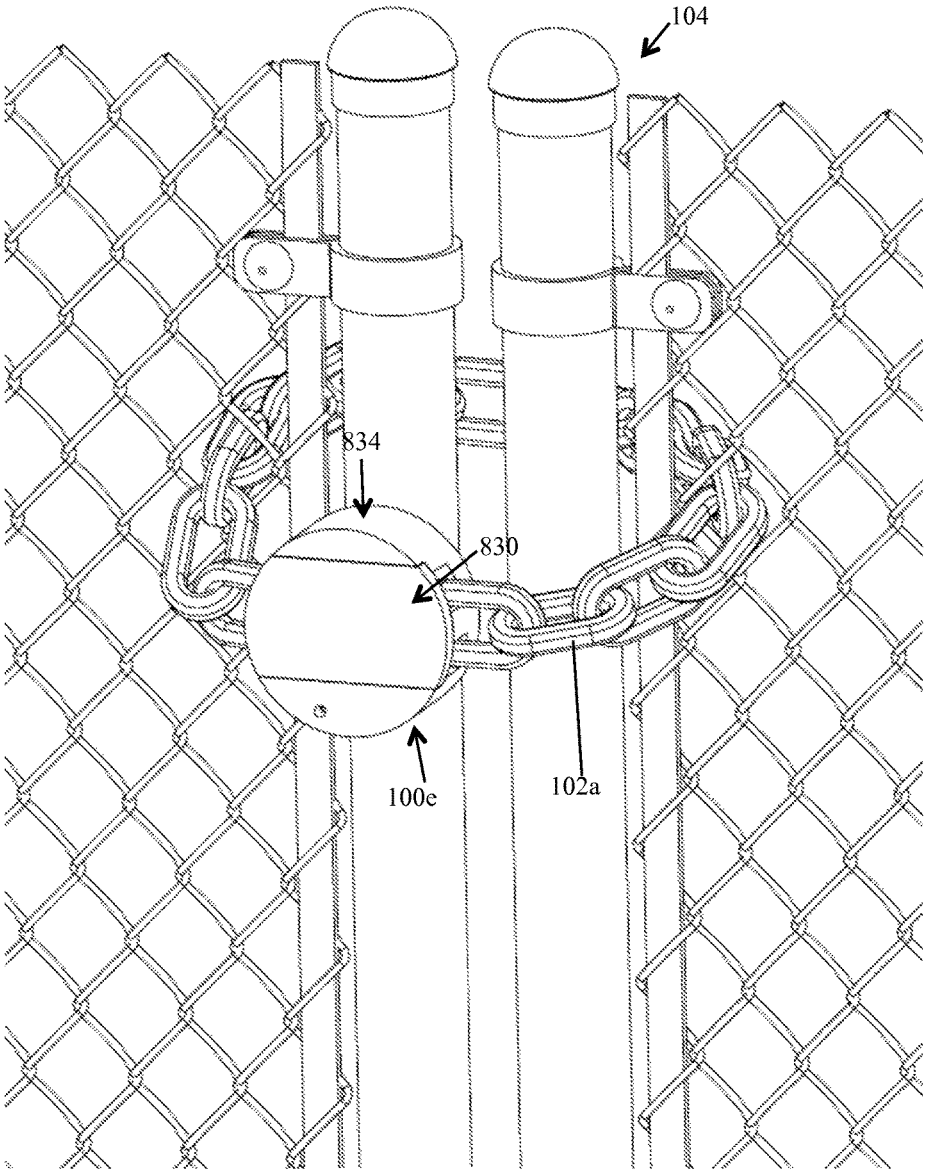
Figures 1, 9B:
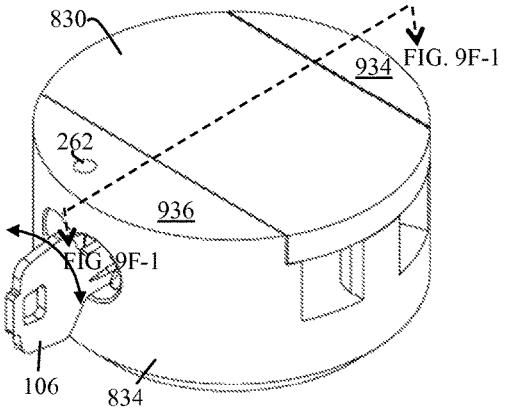
Figures 2, 9B:
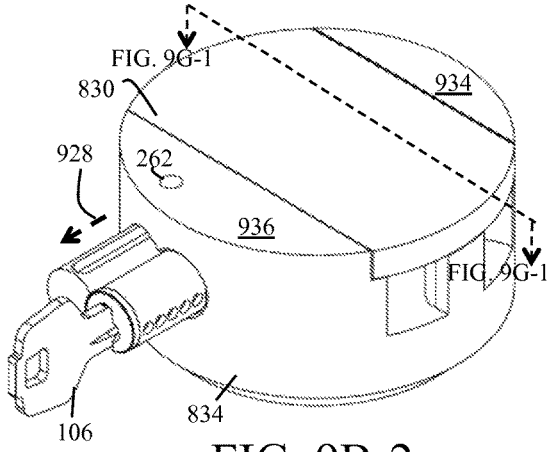
Figures 3, 9B:
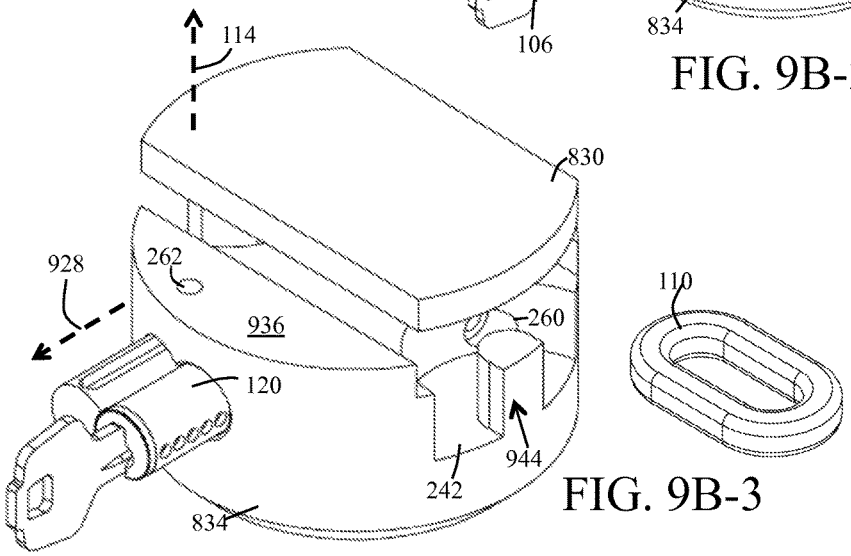

In particular, FIGS. 9A to 9B-3 are non-limiting, exemplary illustrations of locking link 100*e* in accordance with one or more embodiments of the present invention. FIGS.

9B-1 to 9B-3 are non-limiting, exemplary illustrations of locking link 100*e* illustrated in FIG. 9A, which progressively illustrate a non-limiting, exemplary method of unlocking and re-locking of locking link 100*e*.

As illustrated in FIGS. 9A to 9B-3, locking link 100*e* may be used to lock securing member 102*a* onto gate 104. As best illustrated in FIGS. 9A and 9B-1 to 9B-3 along with FIGS. 9F-1 to 9F-3, removing securing member 102*a* from locking link 100*e* includes insertion of a key 106 into key-cylinder 120 of lock 118 of locking link 100*e* (FIG. 9B-1), turning key 106 to an unlock position, partially pulling out lock 118 from locking link 100*e* (direction of arrow 928 indicated in FIGS. 9B-2 and 9B-3) until it clears support 832 (detailed below), and removing linking-end 110 of securing member 102*a* from locking link 100*e* (FIG. 9B-3). Once lock 118 clears support 832, cover 830 of locking link 100*e* automatically (or mechanically) "pops" up (or opens) away from a link 834 using biasing scheme 404 (FIGS. 9F-1 to 9F-3) as indicated by arrow 114 to enable users to remove and release linking-end 110 of securing member 102*a* (FIGS. 9B-3). As best illustrated in FIG. 9B-3, locking securing member 102*a* to locking link 100*e* includes users mounting linking-end 110 of securing member 102*a* onto link 834 of locking link 100*e*, and pressing down on cover 830, re-inserting lock 118 so that it engages support 832 and pins 930 of link 834 (detailed below), and locking the lock to lock securing member 102*a* with locking link 100*e*.

Figure 9C:
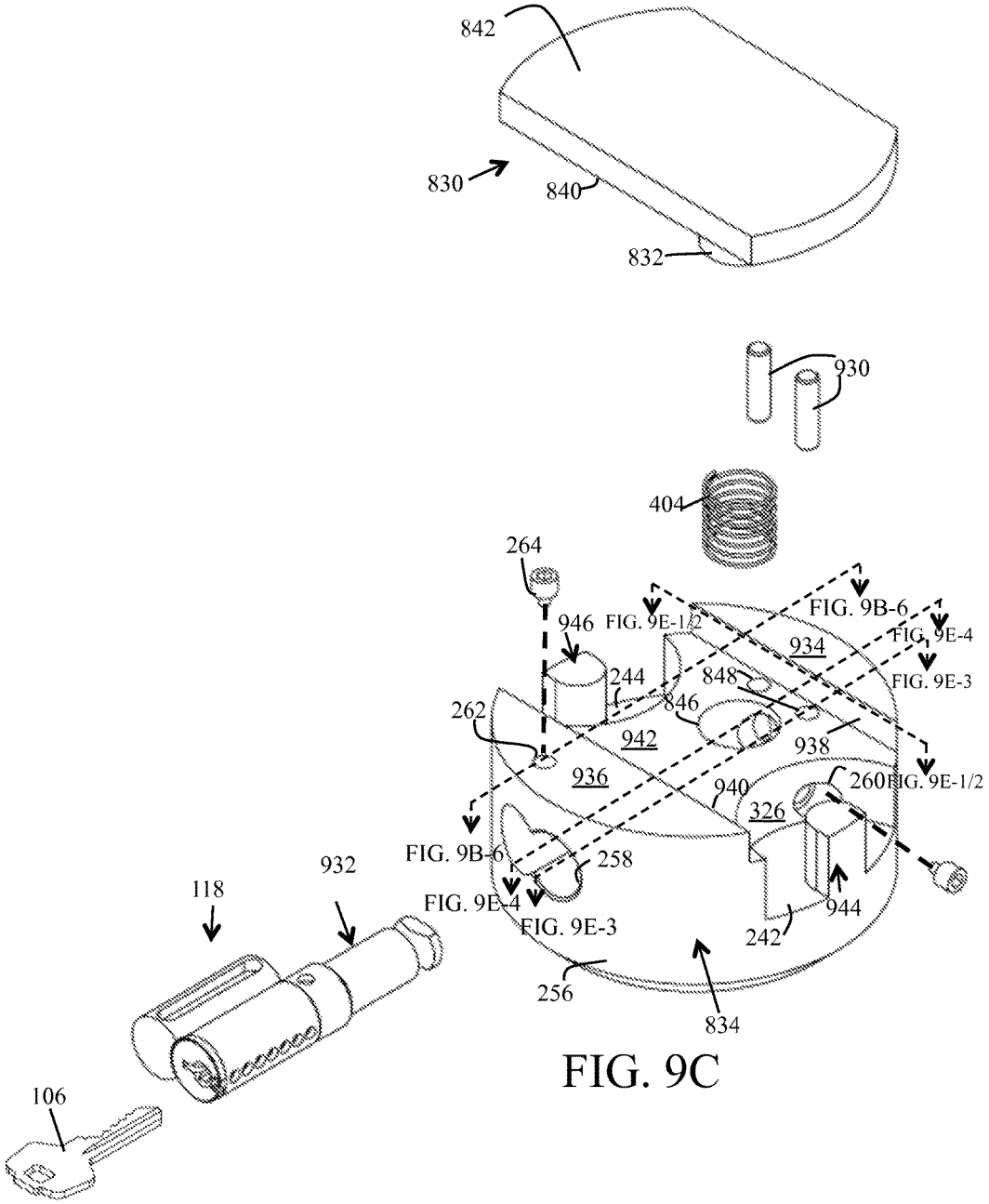

Accordingly, locking link 100*e* is comprised of cover 830 and link 834, wherein cover 830 moves in relation to link 834 while continuously interlocked (or engaged) with link 108*c*. This way, cover 830 does not dislodge from link 834, facilitating ease of locking and unlocking. In general, cover 830 automatically (or mechanically) moves from the first interlock position to the second interlock position, and cover 830 is manually moved from the second interlock position to the first interlock position to lock with link 834. FIG. 9C is a non-limiting, exemplary exploded view of the locking link 100*e* illustrated in FIGS. 9A to 9G-3, including a lock 118. As illustrated, locking link 100*e* accommodates lock 118, which may comprise of a well-known key-cylinder 120 with shackle 932 that may be associated with link 834 and cover 830 of locking link 100*e*.

Figures 1, 9D:
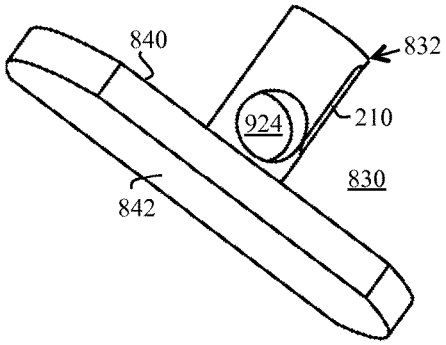
Figures 2, 9D:
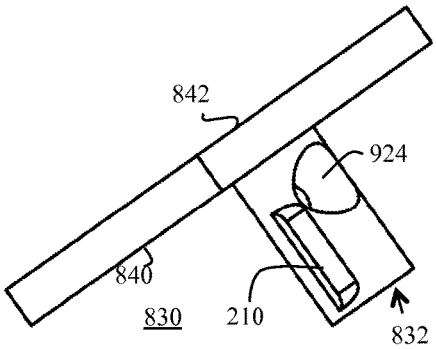
Figures 3, 9D:
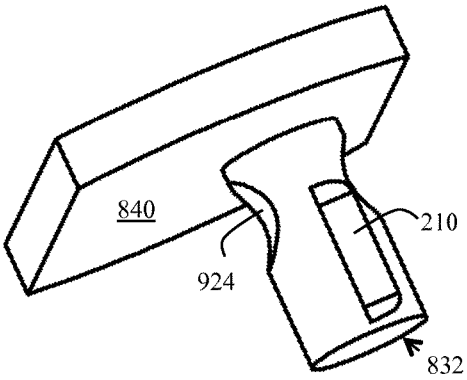
Figures 4, 9D:
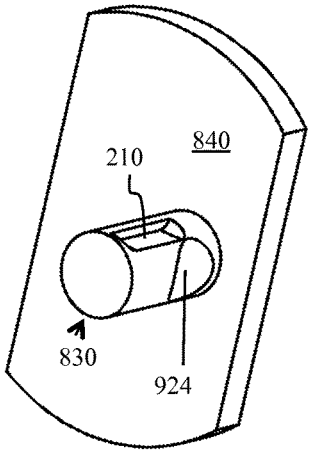

FIGS. 9D-1 to 9D-4 are non-limiting, exemplary illustrations of various perspective views cover 830 of the locking link 100*e* illustrated in FIGS. 1A to 9C. As illustrated, cover 830 has a first (or bottom) side 840 that includes a single support 832 that protrudes from the first cover side 840 at an angle (e.g., 90° degrees). The single support 832 is comprised of an engagement portion 210 that includes a notched cut-out along a first portion of the support 832 that moveably maintains engagement of cover 830 interlocked with link 108*c*. The single support 832 also includes a through-hole 924 that locks cover 830 with link 108*c* using a shackle 926 of lock 118 (detailed below). As detailed below with respect to link 832, when in locked position, an outer or top surface of cover 830 is flush with offset surfaces 934 and 936 of link 834.

Figures 1, 9E:
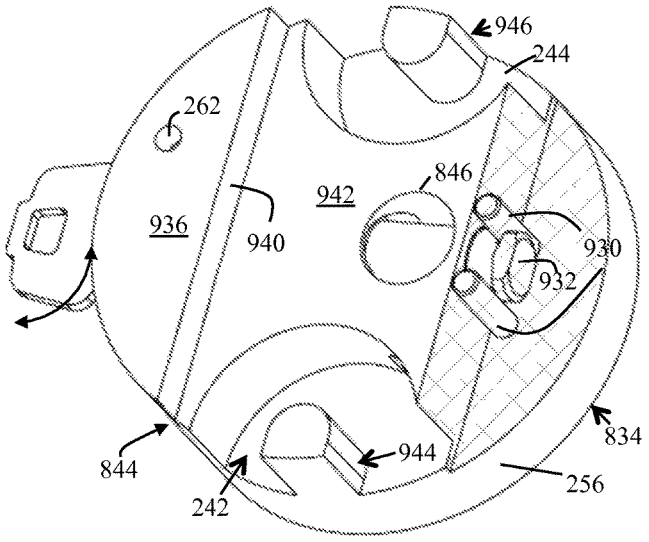
Figures 2, 9E:
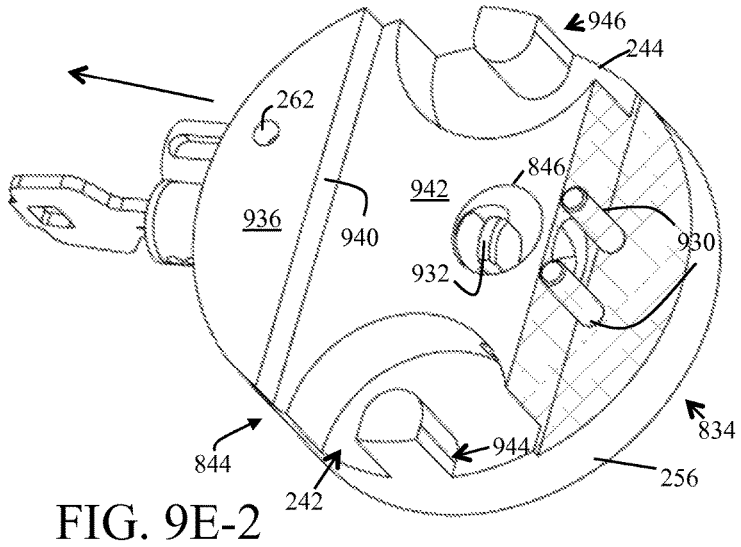
Figures 3, 9E:
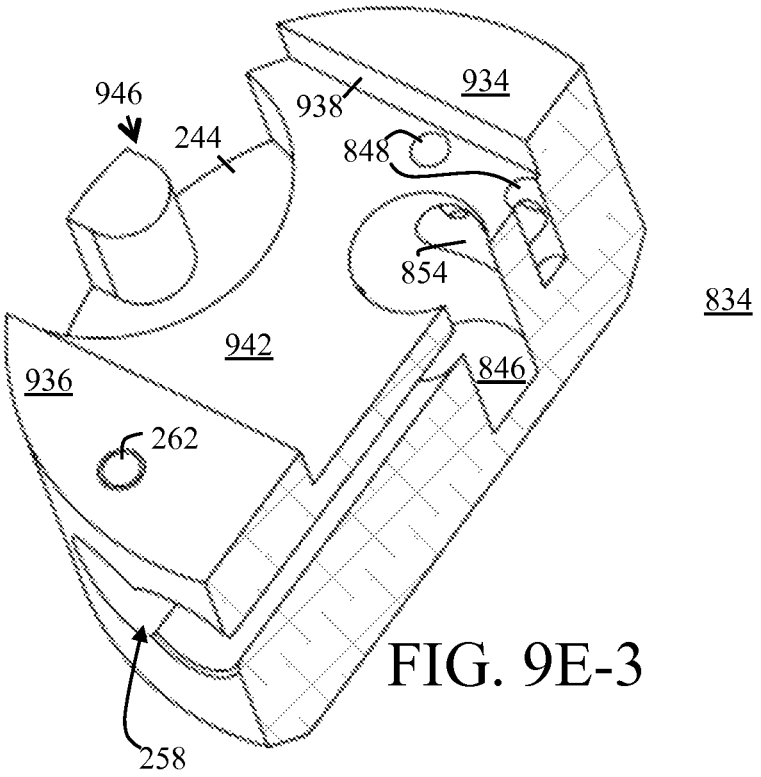
Figures 4, 9E:
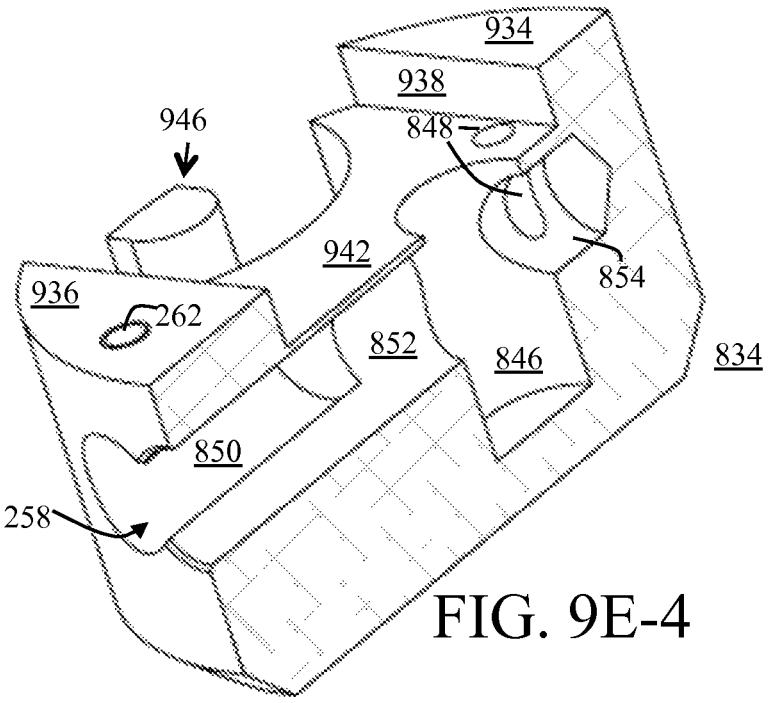
Figures 5, 9E:
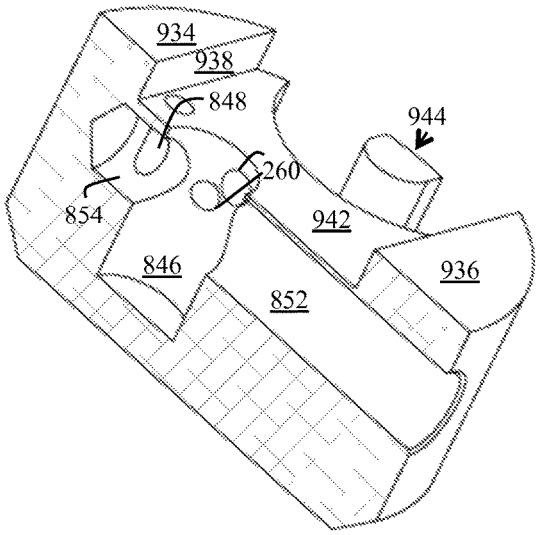
Figures 6, 9E:
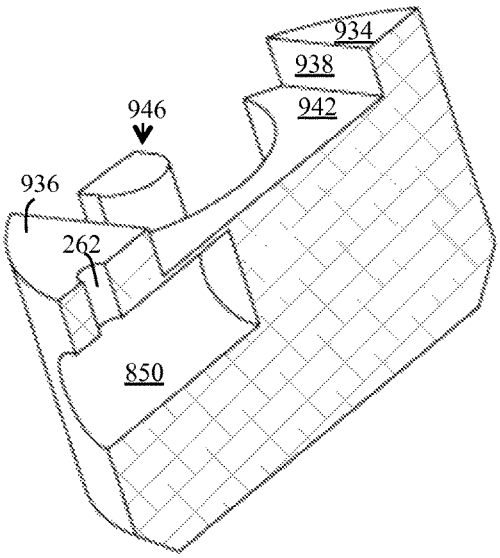

FIGS. 9E-1 to 9E-6 are non-limiting, exemplary illustrations of various perspective views of link 834 (including sectional views thereof). As illustrated, in this non-limiting, exemplary embodiment, link 834 is comprised of a generally cylindrical configuration having a top side 844 that includes single support hole 846 for securing support 832, which also houses a biasing mechanism such as coil spring 404. Top side 844 is comprised of offset, planer surfaces 934 and 936 that form raised edges 938 and 940 in relation to the lowest elevation offset surface 942, with the lowest offset surface 940 and the resulting raised edges 938 and 940 forming a relief or recessed area that receives cover 830. As illustrated, offset surface 936 has a larger expanse to accommodate retainer opening 262 of retaining member 264 of lock 118. It should be noted that as with previous embodiments, bottom side 840 of cover 830 may also include cavities and the posts 944 and 946 may be identical to posts 242 and 244, with the same identical functions and operations. Otherwise, bottom side 840 of cover 830 abuts flat against a top end of posts 944 and 946.

As further illustrated, link 834 is further comprised of curved side 256, side hole 258, and an engagement opening 260. As detailed below, side hole 258 receives and houses lock 118, and engagement opening 260 receives and houses an engagement member 128. Link 834 detachably accommodates a well-known and conventional lock 118, which may be inserted into side hole 258 such that a longitudinal axis of lock 118 is substantially collinear with longitudinal axis 302 of side hole 258.

As indicated above, operation of lock 118 with shackle 932 in relation to side hole 258 is well known, readily found in most hidden shackle padlocks. In this non-limiting, exemplary embodiment side hole 258 is comprised of first and second parallel sections, with the first section of the side hole 258, along a first longitudinal portion of the side hole 258 forms a side cavity 850. Second section of side hole 158 is a through-hole 852, which includes a first distal opening and a second distal opening of side hole 258 that leads into support hole 846. Through-hole 852 has a central longitudinal axis that is parallel, coincides, and is aligned with a central longitudinal axis of a blind-hole 854 (i.e., through-852 and blind hole 854 are collinear). Further included is a set of pin holes 848 that are oriented perpendicular and open into blind hole 854 for interlocking with an end of shackle 932.

Figures 1, 9F:
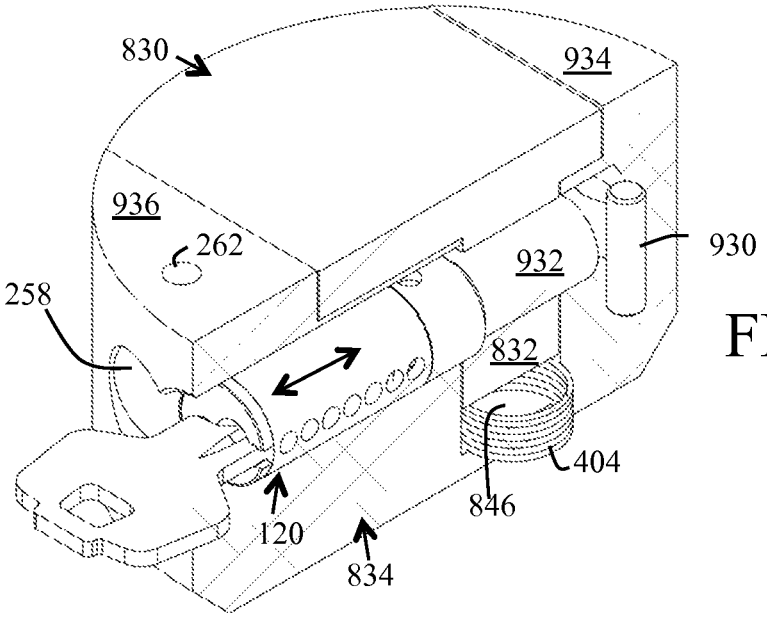
Figures 2, 9F:
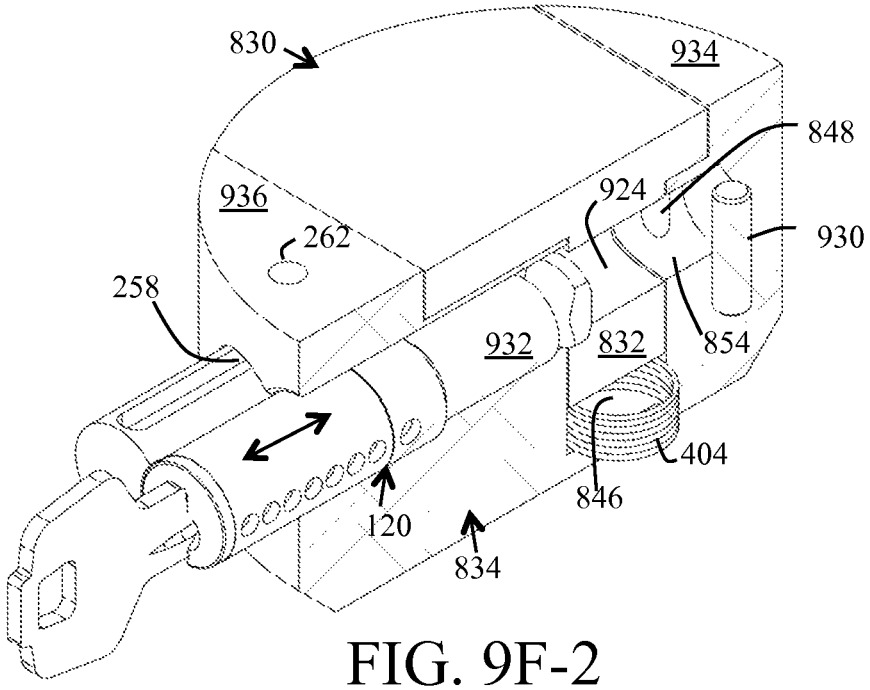
Figures 3, 9F:
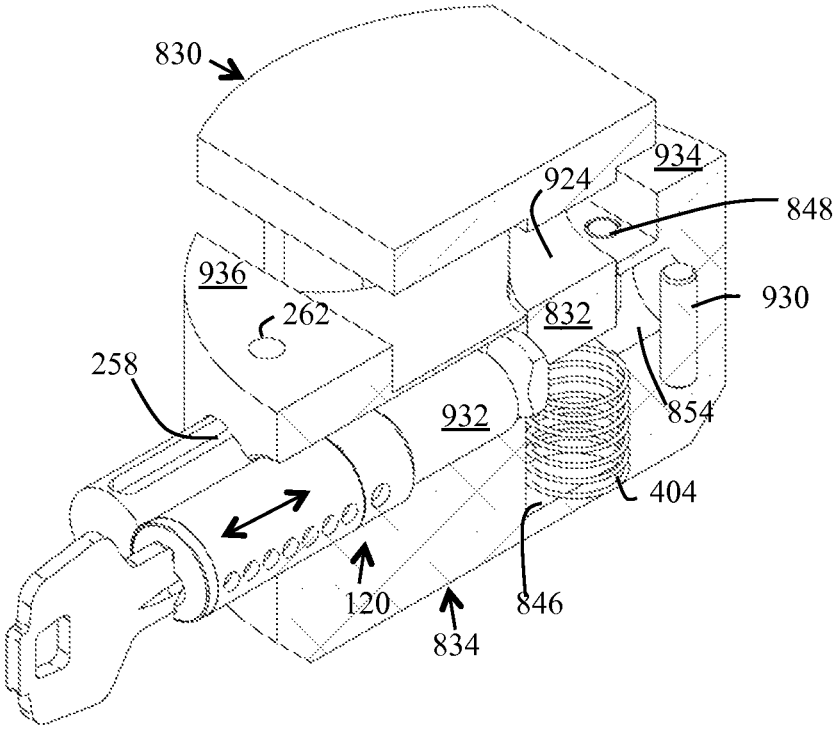

FIGS. 9F-1 to 9F-3 are non-limiting, exemplary sectional illustrations, detailing cover—securing member—link assembly in view of actuator assembly and supports, and progressively illustrating unlocking of cover from link and securing member, the operations of which is similar to those described above. As illustrated, support 832 is first inserted into support hole 846, which is oriented perpendicular to side hole 258. This enables shackle 932 to be inserted and pass through lock portion opening 924 of support 832, and locked between pins 830. To unlock, shackle 932 is simply moved out of locking link until it clears lock portion opening 924 of support 832. Once shackle 932 clears opening 924, cover 830 of locking link 100*e* automatically (or mechanically) "pops" up (or opens) away from a link 108*c* using biasing scheme 404, but continues to remain engaged with link 834 as detailed below.

Figures 1, 9G:
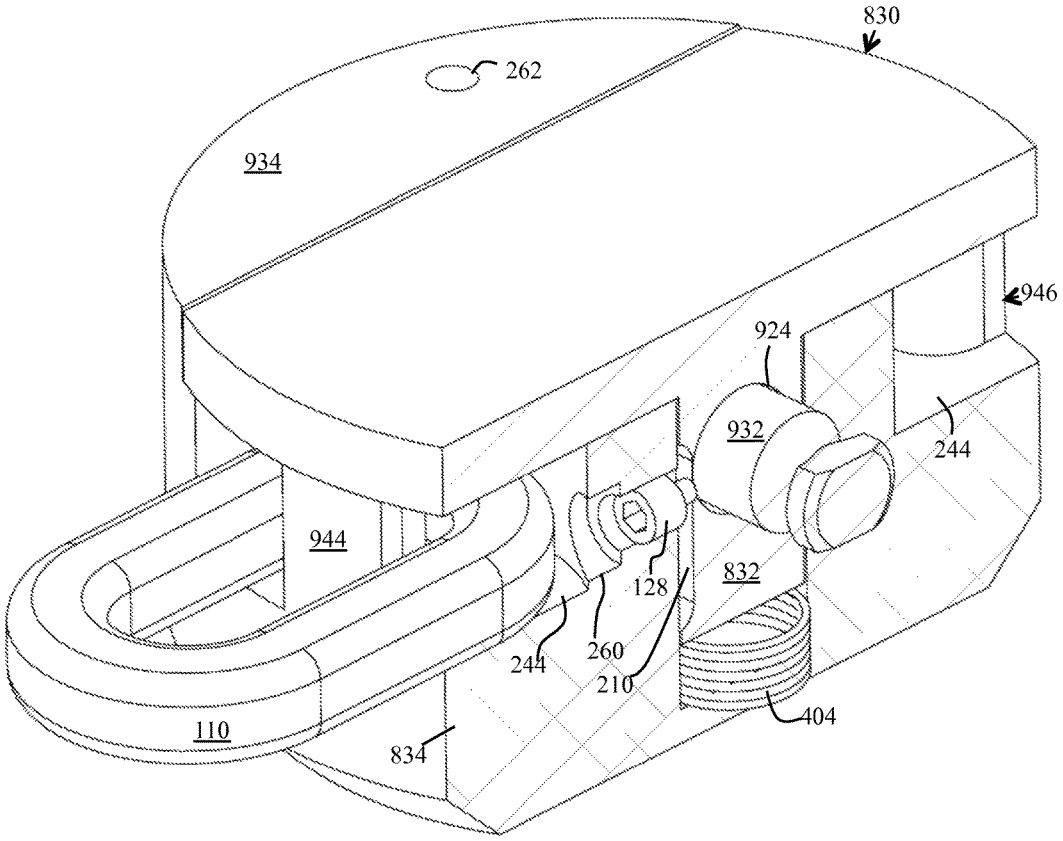
Figures 2, 9G:
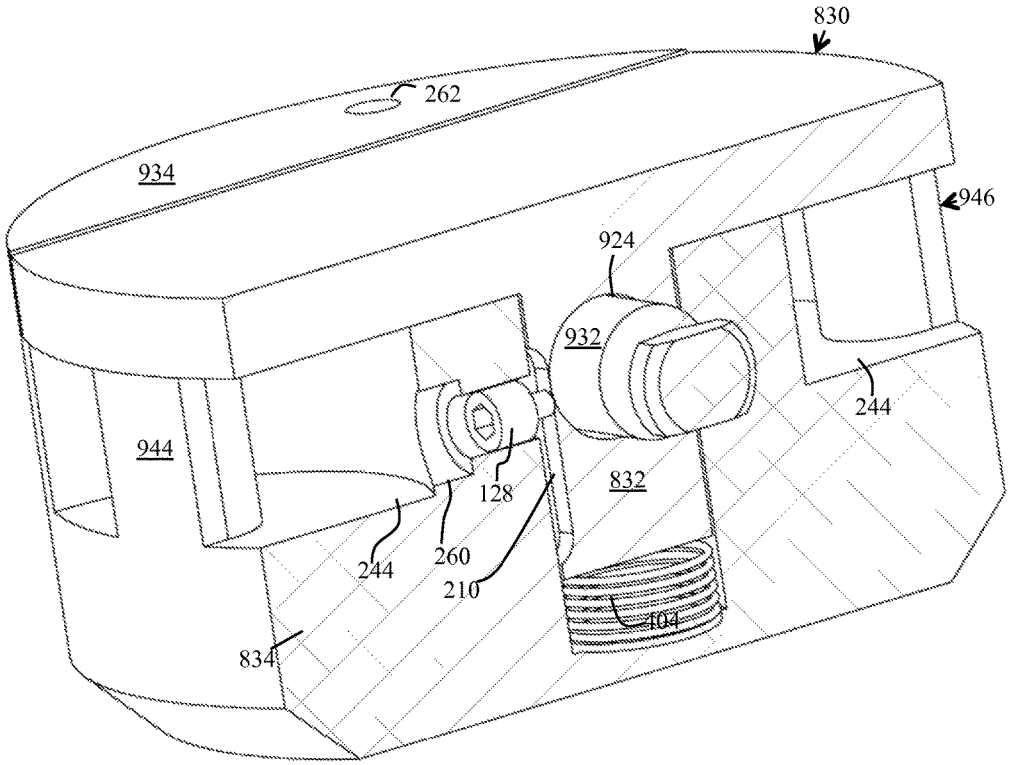
Figures 3, 9G:
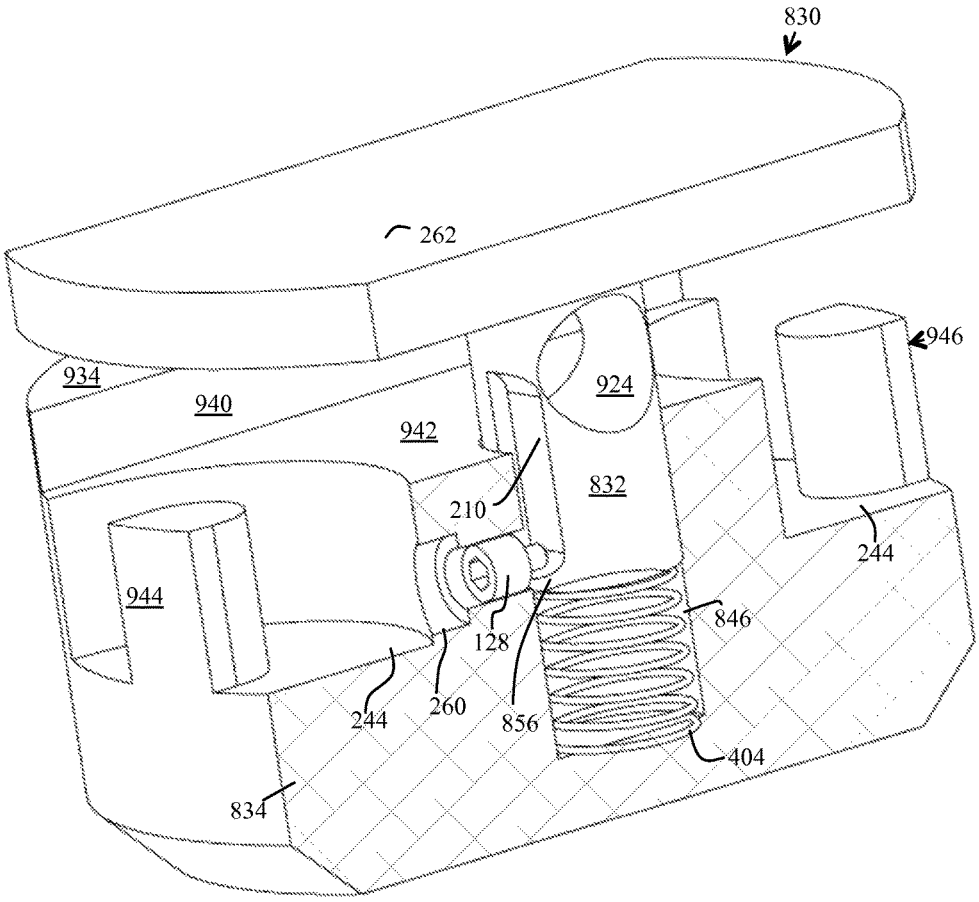

FIGS. 9G-1 and 9G-3 are non-limiting, exemplary sectional illustrations, detailing cover—link assembly in view of engagement opening and engagement member, and progressively illustrating continuous interlocking or engagement of cover with link from locked to unlocked position, the operations of which is similar to those described above. As illustrated in FIGS. 9G-1 to 9G-3, when shackle 932 clears opening 924 of support 832, coil spring 404 pushes cover 830 away from link 834. However, cover 830 continues to remain interlocked with link 834 due to engagement member 128 engaging portion 210 of support 832 and abutting against end portion 856, preventing cover 830 from being disengaged from link 834.

FIGS. 10A to 10F are non-limiting, exemplary illustrations of a locking link that uses a single support, a lock that has a shackle, and a cover that dethatches when unlocked in accordance with another embodiment of the present invention. Locking link 100*f* illustrated in FIGS. 10A to 10F includes similar corresponding or equivalent components, interconnections, functional, operational, and or cooperative relationships as locking links 100*a*, 100*b*, 100*c*, 100*d*, 100*e* that are shown in FIGS. 1A to 9G-3, and described above. Therefore, for the sake of brevity, clarity, convenience, and to avoid duplication, the general description of FIGS. 10A to 10F will not repeat every corresponding or equivalent component, interconnections, functional, operational, and or cooperative relationships that has already been described above in relation to locking links 100*a*, 100*b*, 100*c*, 100*d*, 100*e* that are shown in FIGS. 1A to 9G-3.

As illustrated in FIGS. 10A to 10F, locking link 100*f* is comprised of a cover 1002 with post 1004 and interlocking member 1006, and includes link 1008 that accommodates a shackle 932 that locks with opening 1010 of post 1004 when cover 1002 is in locked position. In this non-limiting, exemplary embodiment, link 1008 is similar to that of link 834 described above with the exception that support hole 1012 accommodating polygonal profile of post 1004 has a wider expanse due to wider expanse of post 1004. Additionally, although very much possible, in this embodiment locking link 100*f* does not use coil springs to pop up cover 1002 and further, no engagement member 128 is used.

Figure 10A:
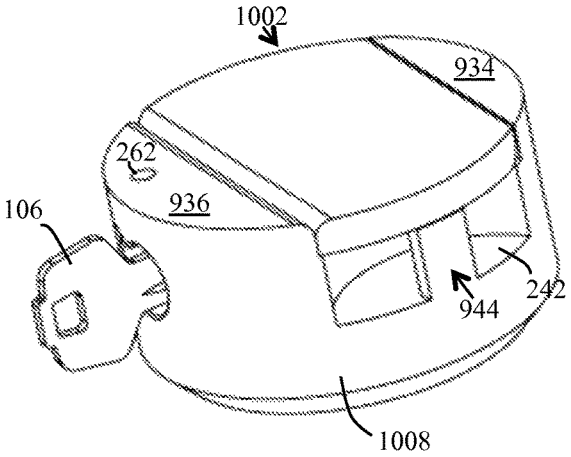
FIGS. 10A to 10F are non-limiting, exemplary illustrations of various views and sectional views of a locking link that uses a single support, a lock that has a shackle, and a cover that dethatches when unlocked in accordance with another embodiment of the present invention.
Figure 10B:
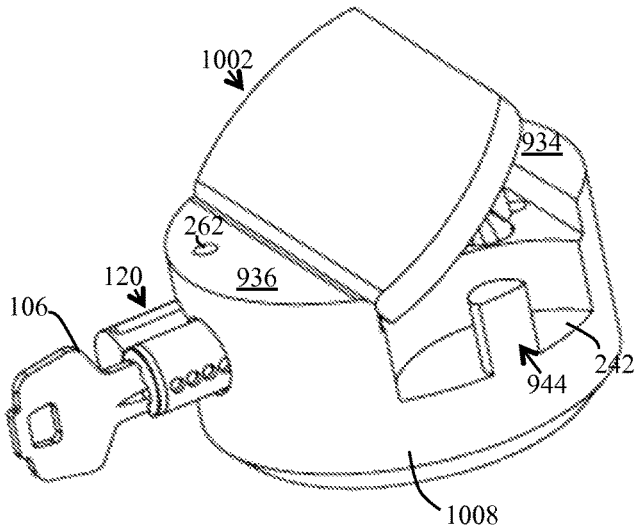
Figure 10C:
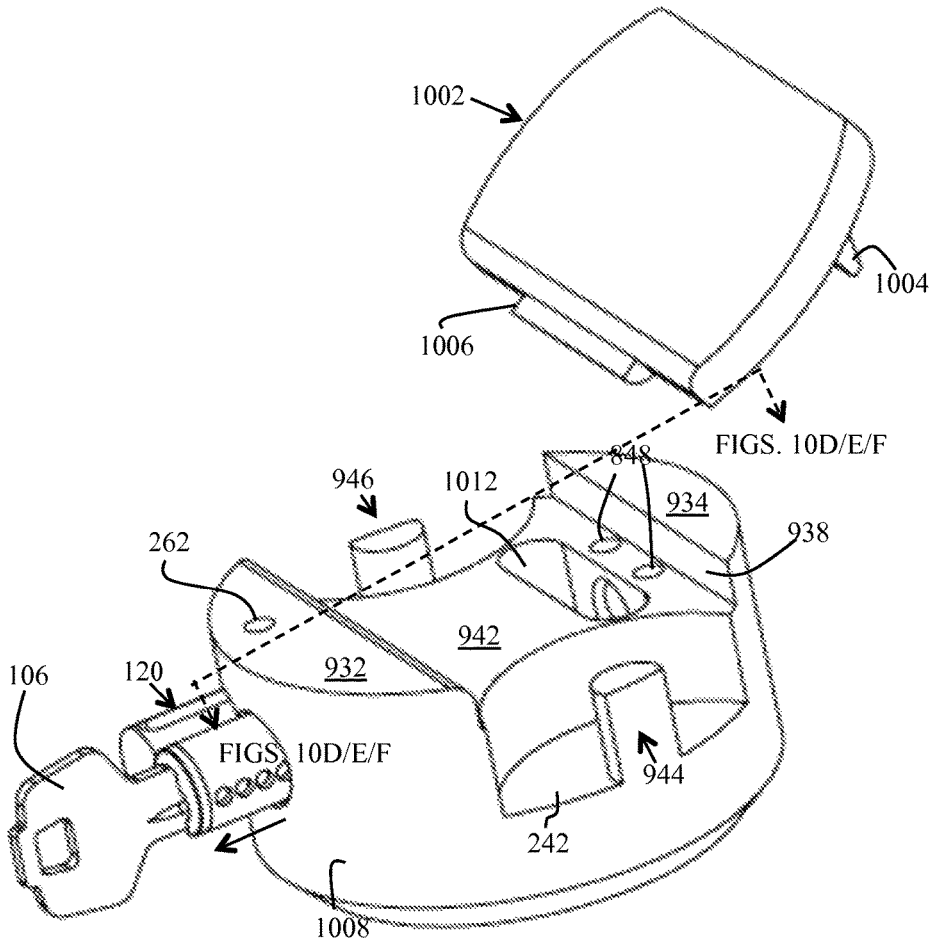
Figure 10D:
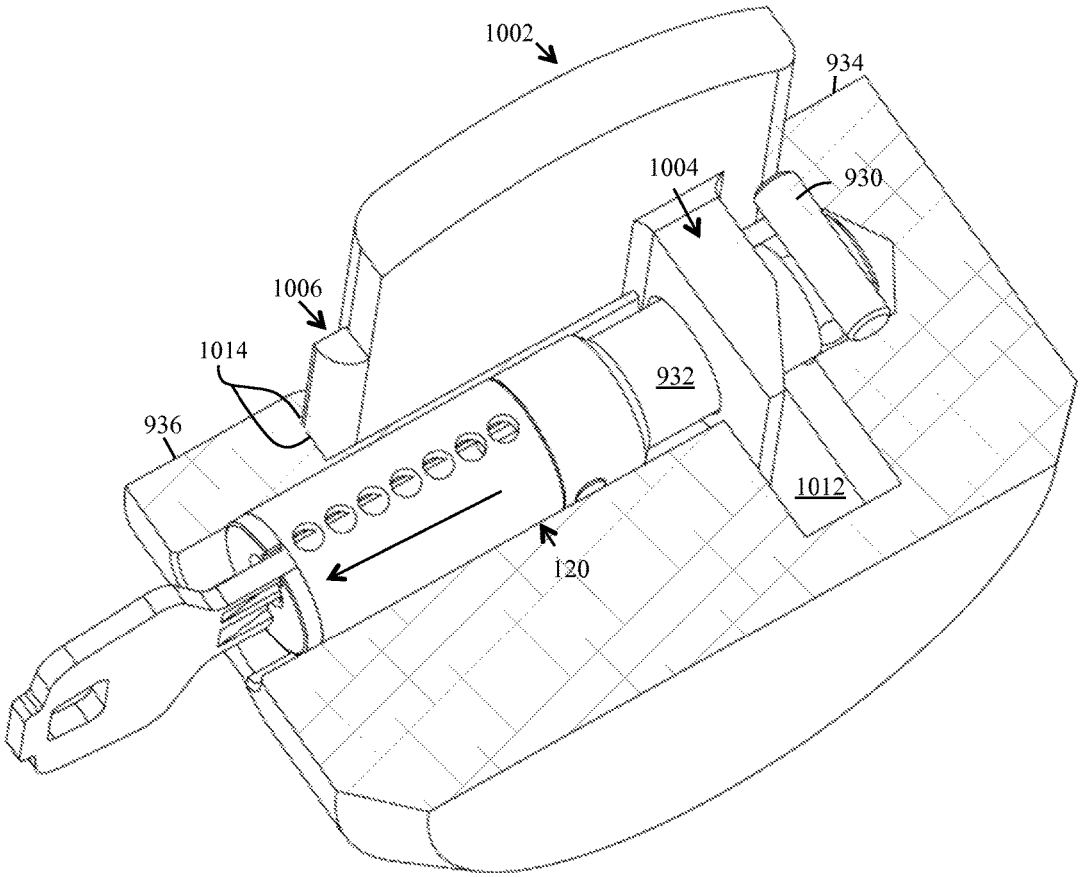
Figure 10E:
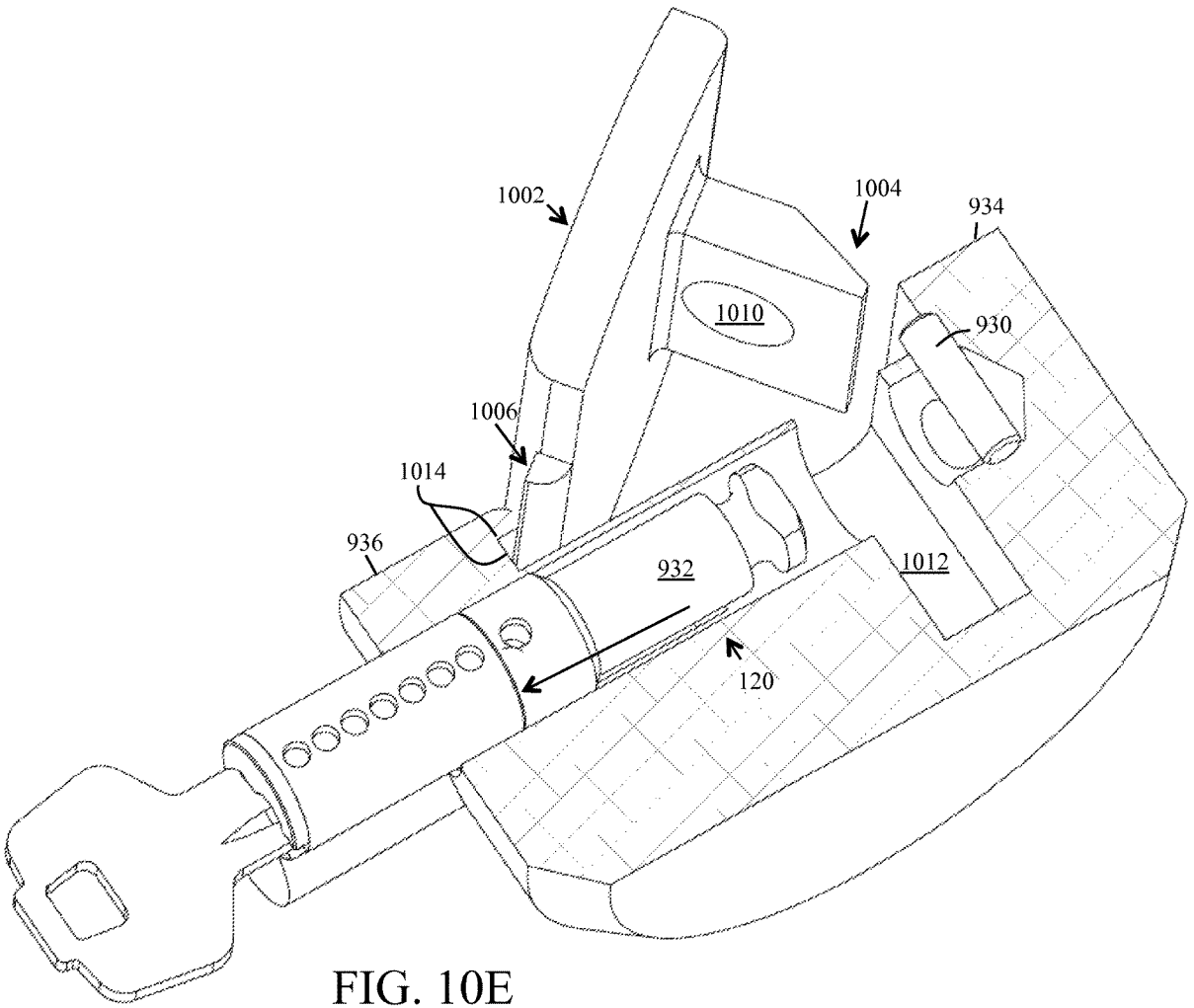
Figure 10F:
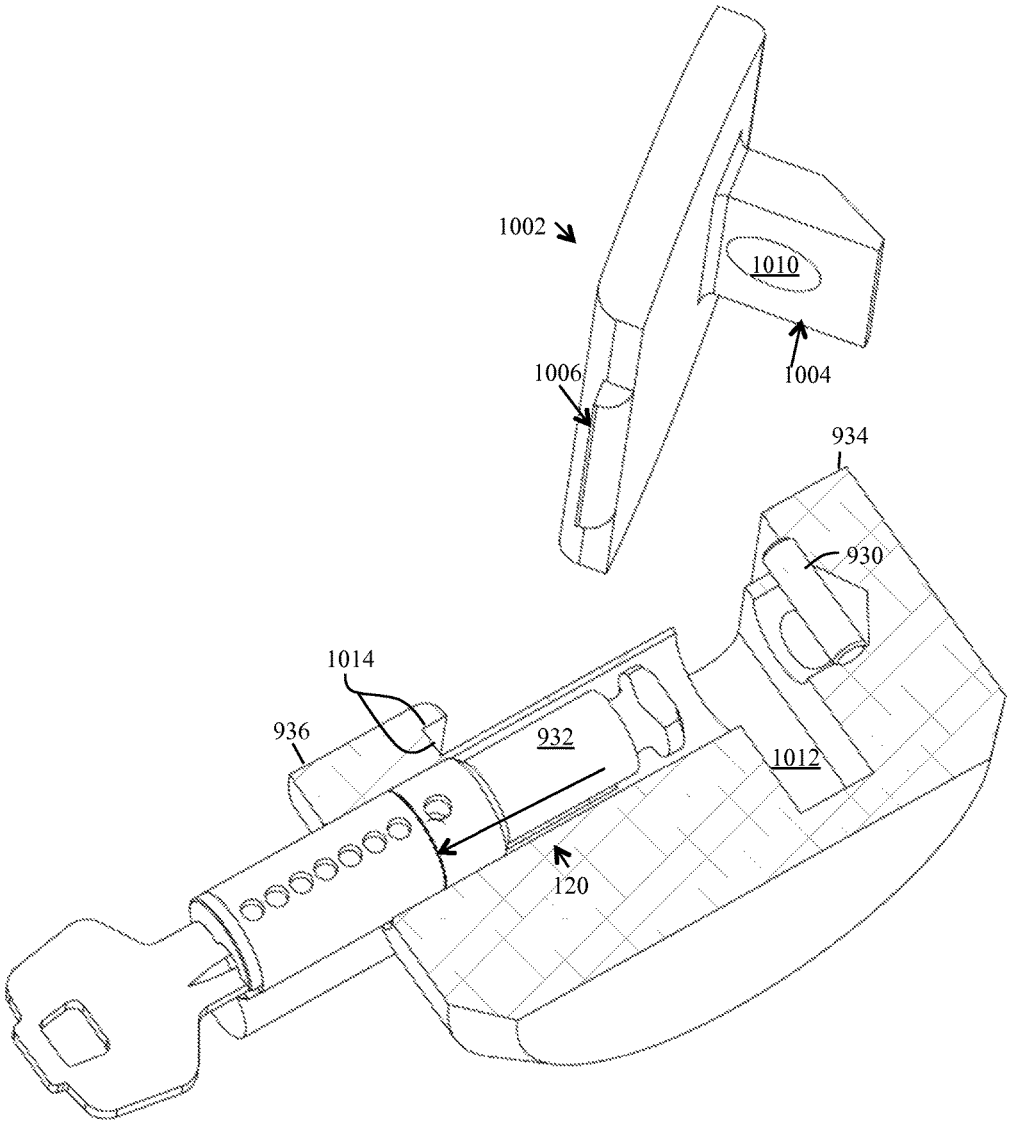

As best illustrated in FIGS. 10D to 10F, cover 1002 includes interlocking member or flange 1006 that interlocks with recess or groove 1014 of link 1008 when in locked position, with cover 1002 fully disengaging from link 1008 when unlocked. It should be noted that cover 1002 may be hinged with link 1008 instead of detachable coupling using interlocking members 1014 and 1006.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, an embodiment can be made to house another type of well known cylinder type the "Large Format Interchangeable Core." Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A locking link, comprising:

a cover moveably engaged with a link;

the cover at a first engaged position is locked with the link, and at a second engaged position is unlocked from the link;

the cover at the first engaged position locks with the link when the cover is manually pressed and moved from the second engaged position to the first engaged position;

the cover at the second engaged position is moveably interlocked with the link and blocked and prevented from being detached from the link the cover automatically moves from the first engaged position to the second engaged position.

2. The locking link as set forth in claim 1, wherein:

the cover is continuously engaged with the link from locked to unlocked positions.

3. The locking link as set forth in claim 1, wherein:

the cover mechanically moves from the first engaged position to the second engaged position.

4. A locking link, comprising:

a cover;

a link;

the cover moves in relation to a link while continuously interlocked with the link;

the cover locks with the link at a first interlock position, and unlocks from the link at a second interlocked position the cover at the first interlock position locks with the link when the cover is manually pressed and moved from the second interlock position to the first interlock position;

the cover at the second interlock position is moveably interlocked with the link and blocked and prevented from being detached from the link the cover automatically moves from the first interlock position to the second interlock position.

5. The locking link as set forth in claim 4, wherein:

at the second interlock position the cover continues to remain interlocked with the link.

6. The locking link as set forth in claim 4, wherein:

the cover mechanically moves from the first interlock position to the second interlock position.

7. The locking link as set forth in claim 4, wherein:

the cover secures and interlocks a portion of a securing member with the link when the cover is locked with the link at the first interlock position.

8. The locking link as set forth in claim 4, wherein:

the cover has a first side that includes:

at least one support that protrudes from the first cover side at an angle.

9. The locking link as set forth in claim 8, wherein:

the support includes a lock portion for locking the cover with the link.

10. The locking link as set forth in claim 8, wherein:

the support includes an engagement portion that moveably maintains engagement of the cover interlocked with the link.

11. The locking link as set forth in claim 8, wherein:
the support includes an engagement portion that moveably maintains engagement of the cover interlocked with the link and a lock portion that locks the cover with the link.

12. The locking link as set forth in claim 4, wherein:
the cover has a first side that includes:
a plurality of supports that protrude from the first cover side at an angle.

13. The locking link as set forth in claim 12, wherein:
a first support of plurality of supports includes a lock portion for locking the cover with the link.

14. The locking link as set forth in claim 12, wherein:
a first support of the plurality of supports includes an engagement portion that moveably maintains engagement of the cover interlocked with the link.

15. The locking link as set forth in claim 12, wherein:
a first support of plurality of supports includes an engagement portion that moveably maintains engagement of the cover interlocked with the link and a lock portion that locks the cover with the link.

16. The locking link as set forth in claim 12, wherein:
a first support of plurality of interlocking supports includes an engagement portion that moveably maintains engagement of the cover interlocked with the link; and
a second support of plurality of interlocking supports includes a lock portion that that locks the cover with the link.

17. The locking link as set forth in claim 4, wherein:
the cover includes:
a bottom side;
a reinforcement structure; and
a support.

18. The locking link as set forth in claim 17, wherein:
the bottom side includes an offset surface that defines a raised edge, with the offset surface and resulting raised edge forming a relief.

19. The locking link as set forth in claim 18 wherein:
the offset surface is comprised of a plurality of offset surfaces that define a plurality of raised edges, with the plurality of offset surfaces and resulting raised edges forming reliefs.

20. The locking link as set forth in claim 17, wherein:
the reinforcement structure is comprised of a cavity that provides reinforcement for a post of the link, with a free end of the post received within the cavity and interlocked when the cover is locked with the link.

21. The locking link as set forth in claim 19, wherein:
the free end of the post includes offset surfaces that defines a raised edge, formed from a notched step, with a lower surface of the offset surfaces engaging the bottom side of the cover, an upper surface of the offset surfaces received within the cavity, and the raised edge within the cavity and contacting a portion of a wall of the cavity.

22. The locking link as set forth in claim 21, wherein:
the link is comprised of one post.

23. The locking link as set forth in claim 21, wherein:
the link is comprised of a first and second posts that include:
a free end that has offset surfaces that defines a raised edge, formed from a notched step, with a lower surface of the offset surfaces engaging the bottom side of the cover, an upper surface of the offset surfaces received within the cavity, and the raised edge within the cavity and contacting a portion of a wall of the cavity.

24. The locking link as set forth in claim 21, wherein:
the link includes a first and a second linking recesses for assembly of the securing member onto link.

25. The locking link as set forth in claim 4, wherein:
the link is comprised of a top side that includes:
at least one support hole securing a support;
a top surface topography that is generally a negative topography of a bottom surface of the cover, including:
a plurality of offset surfaces that define raised edges, with the offset surfaces and resulting raised edges forming recesses that accommodate complementary raised edges of the cover.

26. The locking link as set forth in claim 24, wherein:
the top side further includes a retainer opening.

27. The locking link as set forth in claim 24, wherein:
the link is further comprised of:
a side that includes:
a side hole; and
an engagement opening.

28. The locking link as set forth in claim 26, further comprising:
the locking member is a ball bearing;
a rotation of an actuator moves the ball bearing from one of a locked to an unlocked position.

29. The locking link as set forth in claim 26, wherein:
a key-cylinder with an actuator that moves a locking member from a groove of an actuator and into a recess of the support when the actuator is moved by a force of a first biasing mechanism;
the locking member is moved from the recess of the support and into the groove of the actuator when the actuator is moved by a turn of a key.

30. The locking link as set forth in claim 26, wherein:
the link includes:
a top side; and
a curved side;
the curved side includes a side hole for receiving a lock from a first distal opening;
the side hole is comprised of first and second parallel sections;
the first section of the side hole, along a first longitudinal portion of the side hole forms a first side cavity;
the second section of the side hole, along a second longitudinal portion of the side hole forms a second side cavity.

31. The locking link as set forth in claim 30, wherein:
the link includes a tunnel for positioning one or more locking member;
the tunnel is oriented transverse the side hole, parallel an engagement hole;
the tunnel passes through the side of the link, a first support hole, the side hole, and ends at a second support.

32. The locking link as set forth in claim 31, wherein:
the tunnel commences at an interior side, within one of the first or the second link recess so that in locked position, the securing member blocks access to the tunnel.

* * * * *